United States Patent [19]

Takei et al.

[11] Patent Number: 4,931,372

[45] Date of Patent: Jun. 5, 1990

[54] POLYCARBONATE-CONTAINING PHOTORECEPTORS CONTAINING A HINDERED PHENOL COMPOUND

[75] Inventors: Yoshiaki Takei; Eiichi Sakai, both of Hachioji, Japan

[73] Assignee: Konica Corporation, Tokyo, Japan

[21] Appl. No.: 262,486

[22] Filed: Oct. 25, 1988

[30] Foreign Application Priority Data

Oct. 30, 1987 [JP] Japan ..... 62-277070
Oct. 30, 1987 [JP] Japan ..... 62-277071

[51] Int. Cl.[5] ..... G03G 5/02
[52] U.S. Cl. ..... 430/66; 430/69
[58] Field of Search ..... 430/96, 69, 64, 66

[56] References Cited

U.S. PATENT DOCUMENTS 4,637,971 1/1987 Takei et al. ..... 430/96

FOREIGN PATENT DOCUMENTS 0237953 9/1987 European Pat. Off. .
2201255A 9/1987 United Kingdom .

OTHER PUBLICATIONS

Photographic Chemistry, Week 8534, page 4.

*Primary Examiner*—John L. Goodrow
*Attorney, Agent, or Firm*—Jordan B. Bierman

[57] ABSTRACT

An electrophotographic photoreceptor is disclosed, which is improved in layer casting property, mechanical strength and scratch and abrasion resistance, and also improved in electric property in repetitive use. The photoreceptor is comprised of a support having thereon a photoreceptive layer, and a surface portion of the layer, which is outermost from the support, contains a polycarbonate having at least one of principal repetition units represented by the following formulas I and II, and a compound having a hindered phenol structural unit in the molecules thereof;

Formula I

Formula II

21 Claims, 1 Drawing Sheet

POLYCARBONATE-CONTAINING PHOTORECEPTORS CONTAINING A HINDERED PHENOL COMPOUND

FIELD OF THE INVENTION

This invention relates to an electrophotographic photoreceptor.

BACKGROUND OF THE INVENTION

In electrophotographic copiers of Carlson's type, the surface of a photoreceptor is charged an electrostatic latent image is formed thereon by exposing to light and is then developed with toner and the resulted visible image is transferred to a sheet of paper or the like and then fixed. At the same time, the photoreceptor is made ready for long, repetitive use after removing adhered toner, neutralizing the static, and cleaning the surface thereof.

Such electrophotographic photoreceptors are therefore required to have excellent electric charging properties and excellent electrophotographic characteristics such as an excellent sensitivity, a properly limited dark-decay and so forth as the matter of course and, in addition, excellent physical properties such as copying durability, abrasion resistance, moisture resistance and so forth in repetitive use, and excellent resistance against environmental impacts such as resistance against ozone generated by a corona discharge, UV rays generated by an exposure to light, and so forth.

For a long time now, an inorganic photoreceptor having a photoreceptive layer principally comprising such an inorganic photoconductive material such as selenium, zinc oxide, cadmium sulfide or the like has popularly been used for an electrophotographic photoreceptor.

In recent years, on the other hand, some researches and developments have actively been attempted to utilize various types of organic photoconductive materials as the materials for the photoreceptive layers of electrophotographic photoreceptors.

For example, an organic photoreceptor having a photoreceptive layer containing poly-N-vinyl carbazole and 2,4,7-trinitro-9-fluorenone is described in Japanese Patent Examined Publication No. 10496/1975. This photoreceptor does not always satisfy sensitivity and durability. With the purpose of overcoming the above-mentioned defects, some attempts have been made to develop an organic photoreceptor having a high sensitivity and a great durability, in which two materials different from each other are assigned separately to display the charge generation and charge transport functions in the photoreceptive layer, respectively. In this kind of the so-called function-separated type electrophotographic photoreceptors, the materials capable of displaying the above-mentioned functions may be selected from a wide range of materials. It is therefore comparatively easier to prepare an electrophotographic photoreceptors having any desirable properties.

The efforts have gone into the development of an electrophotographic photoreceptor having an excellent electrophotographic properties and a layer strength, in such a manner that a low molecular weight organic compound is used for a charge transportation material, and a material capable of generating a desired charge and a high molecular binder are used in combination.

The above-mentioned high molecular binders include, for example, polycarbonates which are excellent in the properties of electric charge, repetitive use, and so forth.

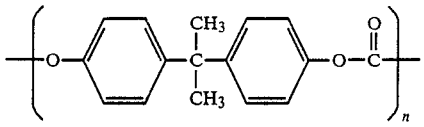

These polycarbonates have such a structure that two methyl groups are symmetrically bonded to a carbon atom being in the center of bisphenol A. Upon examination, it was found that the above-mentioned polycarbonates have the following defects:

(1) Mechanical strength, especially, scratch and abrasion resistance are so unsatisfactory that any organic photoreceptors may not be made more durable.

(2) Compatability with a carrier transportation material (hereinafter sometimes abbreviated to CTM) is so poor that CTM crystal deposition is apt to be produced, so that there may be some instances where a layer may be cracked.

(3) When using the above-mentioned polycarbonates having been highly concentrated in a dip-coating method for example, the gelation of a coating solution is liable to be produced due to the crystallization of the polycarbonates, so that the life of the coating solution will be shortened.

(4) When forming a layer, the gel-like material forms a protrusion on the surface of the layer and then the protrusion has a comet produced on the layer so as to lower the yield, or, when using a photoreceptor, toner adheres to the surface of the protrusion and remains uncleaned as it is, so that an image defect is liable to be produced by the so-called toner-filming.

The reason why the above-mentioned polycarbonates are liable to be crystallized is seemed to be that, in the above-mentioned polycarbonates, the groups bonded to the carbon atom being in the center of bisphenol A are comprised of the lowest methyl groups which produce a high grade molecular chain orientation.

For solving the problems derived from the polycarbonates liable to be crystallized, Japanese Patent O.P.I. Publication Nos. 60-172004/1985 and 60-172045/1985 have proposed to use a non-crystallizing polycarbonate in a photoreceptive layer. With such non-crystallizing polycarbonates, the above-mentioned problems may be solved and a photoreceptor having excellent mechanical strength and scratch and abrasion resistance may be provided.

However, after the inventors repeated examination, they have resultingly found that every photoreceptor using the above-mentioned non-crystallizing polycarbonates deteriorates the electric property and increase the residual potential, when using repeatedly.

As described above, it has been difficult to provide excellent electrophotographic photoreceptors capable of satisfying the requirements such as layer casting property, mechanical strength and scratch and abrasion resistance as well as electric property in repetitive use. Accordingly, there have so far been the demands for a photoreceptor capable of satisfying the above-mentioned every requirement altogether.

SUMMARY OF THE INVENTION

It is, accordingly, an object of the invention to provide a photoreceptor which is excellent in layer casting property, mechanical strength and scratch and abrasion resistance and is also excellent in electric property in repetitive use.

This invention relates to a photoreceptor comprising a support having thereon an photoreceptive layer, wherein a portion of the photoreceptive layer, which is outermost from the support, contains polycarbonate having the principal repetition unit, i.e., the structural units represented by the following formulas I and/or II, and a compound having a hindered phenol structural unit in the molecules thereof.

Formula I

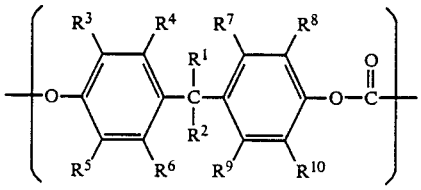

In the formula, $R^1$, $R^2$ each represent a hydrogen atom, a substituted or unsubstituted aliphatic group, a substituted or unsubstituted carbon ring group, or a substituted or unsubstituted aromatic group; and at least either one of $R^1$ and $R^2$ is a bulky group;

$R^3$, $R^4$, $R^5$, $R^6$, $R^7$, $R^8$, $R^9$, $R^{10}$ each represent a hydrogen atom, a halogen atom, a substituted or unsubstituted aliphatic group, or a substituted or unsubstituted carbon ring group.

Formula II

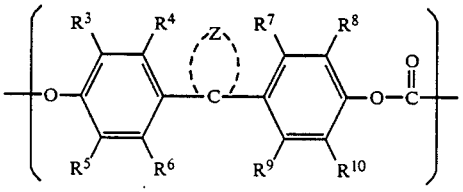

In the formula, $R^3$, $R^4$, $R^5$, $R^6$, $R^7$, $R^8$, $R^9$, $R^{10}$ each represent the same as above-given.

Z represents a group of atoms necessary for completing a substituted or unsubstituted carbon ring or a substituted or unsubstotuted heterocyclic ring.

DETAILED DESCRIPTION OF THE INVENTION

Figure 1:
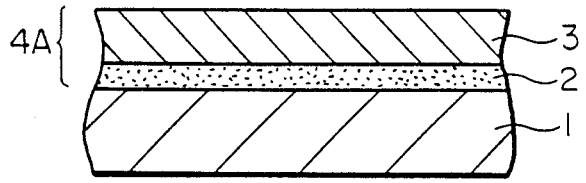
FIG. 1 through FIG. 4 are the cross-sectional views illustrating the examples of the photoreceptors of this invention, respectively.

In this specification, the expression, 'The surface portion of an image forming layer', means a portion on the surface side of a photoreceptor, i.e., a portion on the opposite side of an electroconductive substrate. This meaning include that, for example, a portion on a layer provided onto the surface of a photoreceptor, such as a charge generation layer, a charge transportation layer, a surface or protective layer, a surface modifying layer and so forth and, besides, in the case that a layer is not so clearly formed, the meaning also include that, for example, the surface portion of a charge transportation layer to which a compound having a hindered phenol structural unit in the molecules thereof is diffused or added.

In the invention, an essential point is that the surface portion of an image forming layer contains a polycarbonate having the structural unit represented by the above-given formulas I and/or II, as the principal repetion unit.

To be more concrete, these polycarbonates are excellent in mechanical strength, scratch and abrasion resistance, press life, electric chargeability, transparency, insulating property, compatibility with CTM and, particularly, the surface is hard and slidability is moderate.

In the above-mentioned polycarbonates, the carbon atom which is in the center of bisphenol A bonds to $R^1$ and/or $R^2$ at least one of which is bulky or the carbon atom forms a ring with the afore-given Z. Therefore, the molecular chain of the polycarbonate is effectively hindered from making the orientation thereof in a specific direction by these $R^1$ and/or $R^2$ or Z. This hindrance makes the polycarbonate neither be crystallized nor be deposited on the surface of a photoreceptive layer when forming the layer, so as to prevent the property deteriorations such as a lowered yield caused by an abnormal protrusion, an image defect caused by a toner-filming and so forth, a rapid gelation of a coating solution, and so forth. These remarkable effects may further be displayed, provided that, in the aforegiven formula I, $R^1$ and $R^2$ are different from each other or are asymmetrically bonded. In the aforegiven formula II, The ring completed with the aforegiven Z contributes directly to display the above-mentioned remarkable effects.

Further in this invention, an essential point is that 'a compound having a hindered phenol structural unit in the molecules thereof' (hereinafter sometimes called a hindered phenol type compound) is contained in the surface portion of an image forming layer.

By making combination use of a polycarbonate having a structural unit represented by the aforegiven formula I or II which serves as the principal repetition unit thereof and a hindered phenol type compound, it is possible to fully enjoy the aforementioned effects and advantages derived from the polycarbonate represented by the formula I or II having been contained in the surface portion of an image forming layer and, at the same time, to prevent the electric property deteriorations which are the defects of the polycarbonates caused in repetition use.

Thanks to such a constitution as mentioned above, the electric properties may be remarkably improved in repetition use and the increase in residual potentials, decrease in required potentials and deterioration in sensitivity may also be prevented.

As mentioned above, by making combination use of a polycarbonate having a structural unit represented by Formula I or II which serves as the principal repetition unit thereof and a compound having a hindered phenol structural unit in the molecules thereof, it is possible to provide a photoreceptor excellent in layer casting property, mechanical strength, scratch and abrasion resistance, electric charging property in repetition use and residual potential property, so that the durability of the photoreceptor may be remarkably improved as a whole.

The reason why such be able to display the above-mentioned effects and advantages is seemed to be the followig. The compounds having a hindered phenol structural unit in the molecules are chemically stable in an atmosphere of ozone, under the exposure to UV rays and/or in the condition of a high temperature. Particularly, the remarkable improvement effects can be displayed on the decrease of charging capacity caused from ozone or the other active materials produced when charging, or on such a phenomenon as the increase in dark conductivity and so forth. Further, the improvement on charge potentials and the decrease in dark decay can be effectively obtained. It is, therefore, possible to obtain the excellent properties such as that the initial properties are excellent, fatigue and deterioration can be remarkably reduced in repetition use, and the lowering of chargeable potential level, sensitivity deterioration, residual potential increase and so on may also be remarkably reduced.

The mechanism of these effects is still not clear, but the effects is seemed to be derived from the fact that the thermal oscillation of a phenol hydroxyl group is inhibited or the influence of an external active material is hindered, by the steric hindrance produced by a group of bulky atoms.

The polycarbonates having a structural unit represented by Formula I or II serving as the principal repetition unit will further be described.

First, the structural unit represented by Formula I or II will be described.

In the structural unit represented by Formula I, it is inevitable that at least one of $R^1$ and $R^2$ should be a bulky group. Such a bulky group is preferably to have not less than three carbon atoms and to function a steric hindrance so as to hinder a molecular chain orientation. Such bulky groups may be exemplified as follows:

(1)

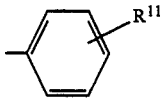

wherein $R^{11}$ represents a hydrogen atom, an alkyl group such as methyl group, or an alkyl ester group represented by $-CH_2)_mCOOR$ in which R represents an alkyl group and m is equal to or not less than 1.

(2)

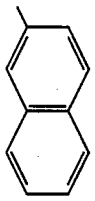

(3) An alkyl group represented by $-C_mH_{2m+1}$, in which m is not less than 4.

(4) an alkyl ester group represented by $-CH_2)_mCOOR^{12}$ in which $R^{12}$ represents an alkyl group and m is not less than 2.

When one of the $R^1$ and $R^2$ is a bulky group, the other may be a hydrogen atom or such an alkyl group as a methyl group or the like.

Next, $R^3$ through $R^{10}$ denoted in the above-given Formulas I and II each represent a hydrogen atom, such a halogen atom as Cl, Br, F or the like, such an alkyl group as methyl group or the like, and such a carbon ring group as cyclohexyl group.

In the structural unit represented by the aforegiven Fomula II, the above-mentioned Z may be a group of atoms capable of completing a 5- or 6-membered carbon or heterocyclic ring. These rings include, for example, a cyclohexyl ring, a cyclopentyl ring and so forth, and it is also allowed to introduce such a substituent as an acetyl, acetylamino or the like group into a portion of the rings.

The structural units represented by Formulas I and II may be typically given the following units as the examples thereof.

(I-1)

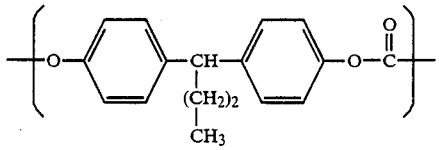

(I-2)

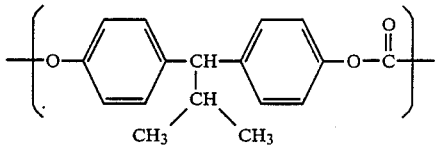

(I-3)

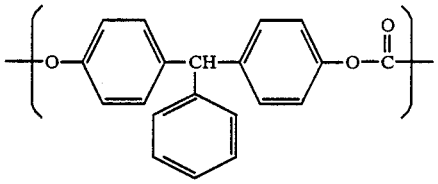

(I-4)

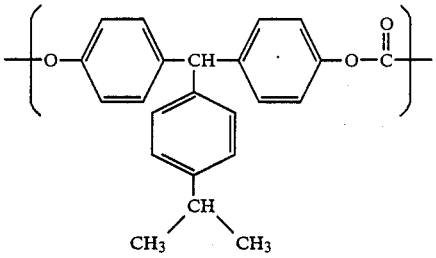

(I-5)

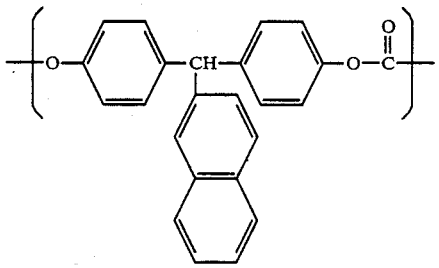

(I-6)

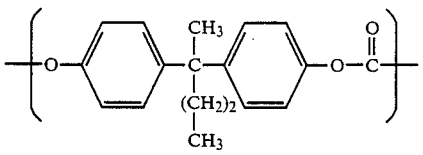

-continued
(I-7)
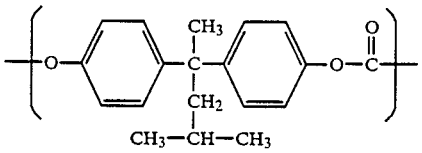
(I-8)
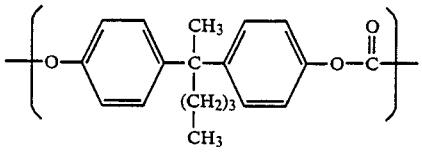
(I-9)
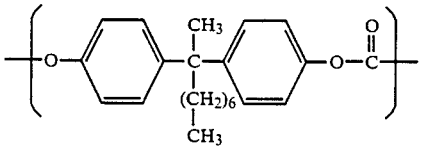
(I-10)
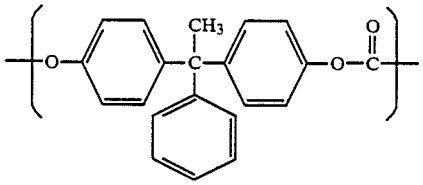
(I-11)
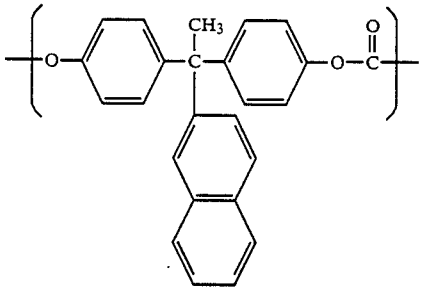
(I-12)
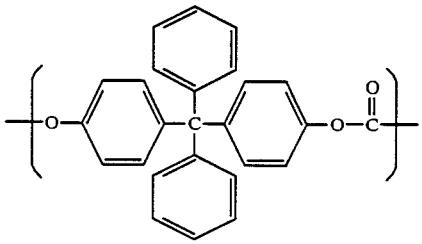
(I-13)
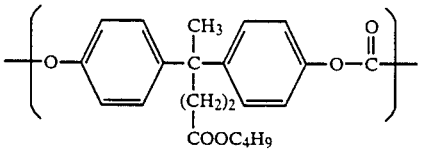
-continued
(I-14)
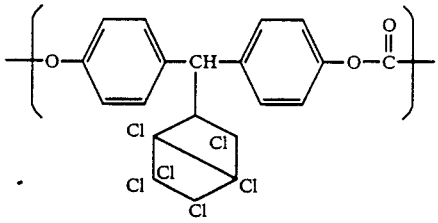
(I-15)
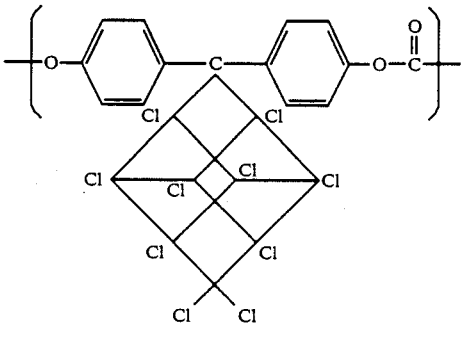
(II-1)
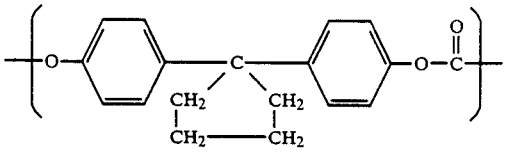
(II-2)
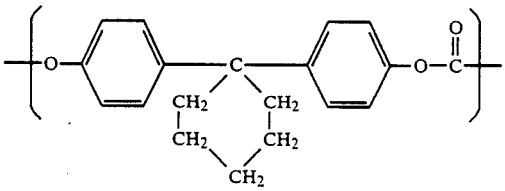
(II-3)
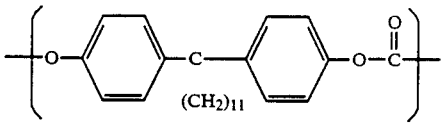
(II-4)
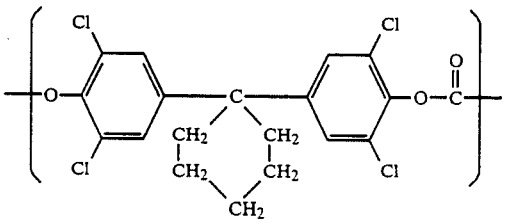
(II-5)
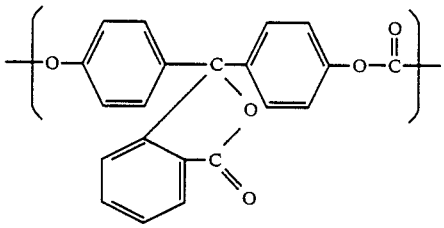

-continued (II-6)

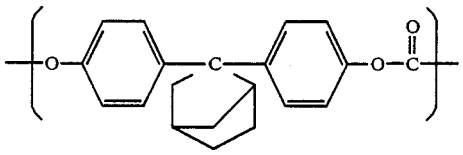

(II-7)

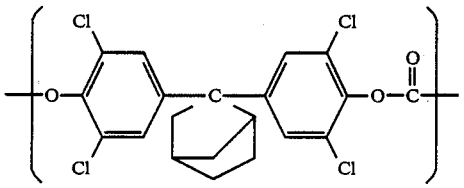

(II-8)

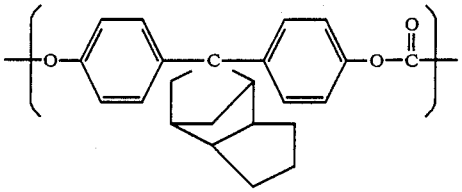

(II-9)

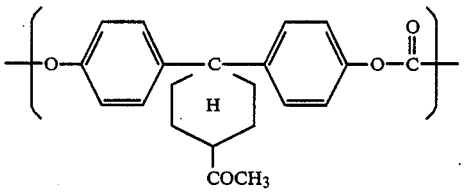

(II-10)

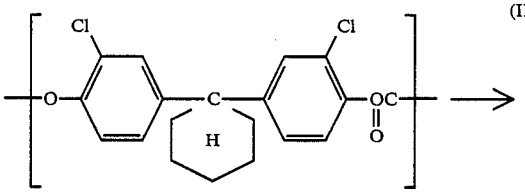

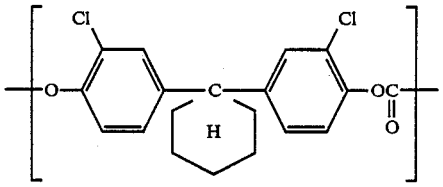

(II-11)

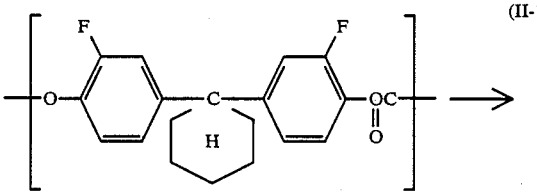

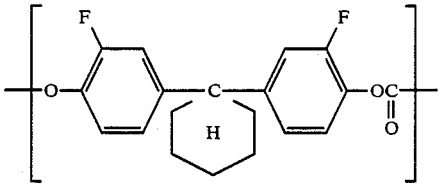

-continued (II-12)

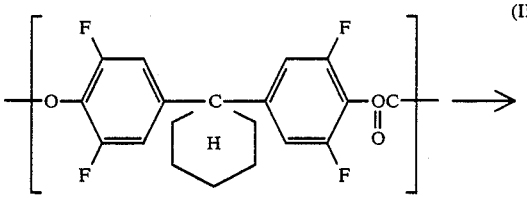

(II-13)

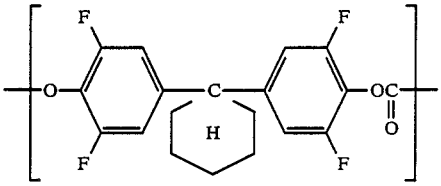

(II-14)

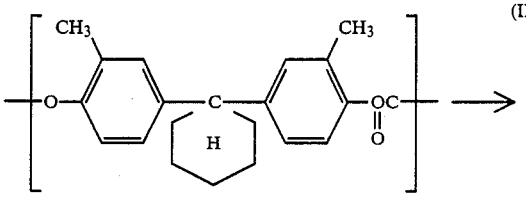

(II-15)

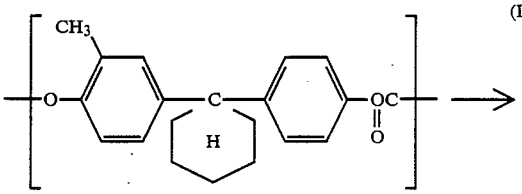

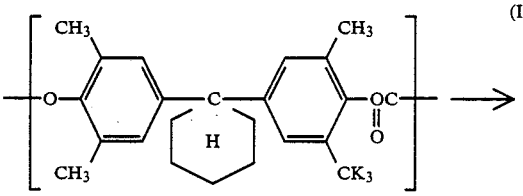

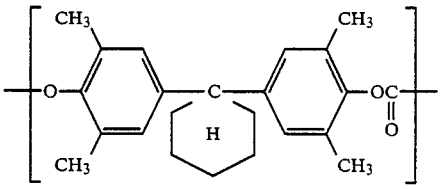

The polycarbonates of the invention have a structural unit represented by the aforegiven Fomula I and/or a structural unit represented by Formula II so as to serve as the principal repetition unit. These structural units may be only a single kind of the various kinds of structural units represented by Formula I and II, such as the one one comprising (I-2) and may also be those copolycondensated with many kinds of them. Further, the polycarbonates of the invention include a copolycondensation type polycarbonate containing a small amount of other repetition units than the repetition units represented by Formulas I and II, provided that an occasion demands to improve a physical, chemical or electrical property, and that these type polycarbonates may not affect the performance and advantages of this invention.

The typical exemplification include a polycarbonate which is copolycondensated with a material prepared by mixing 4,4'-dohydroxyphenyl-1,1-cyclohexane with a small amount of bisphenol A; a polycondensate of 4,4'-dihydroxyphenyl-1,1-cyclohexane and such an aromatic dicarboxylic acid as terephthalic acid, isophthalic acid or the like; and so forth.

In the above-mentioned polycarbonates, the repetition number n is preferably from 10 to 5000 and more preferably from 50 to 1000.

Among the above-given polycarbonates, the polycarbonates represented by the following Formula Ia and IIa may further be exemplified.

Formula Ia

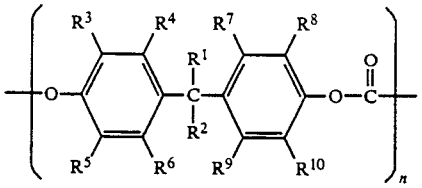

wherein $R^1$, $R^2$, $R^3$, $R^4$, $R^5$, $R^6$, $R^7$, $R^8$, $R^9$ and $R^{10}$ each are the same as the above-given;

n is from 10 to 5000 and preferably from 50 to 1000.

Formula IIa

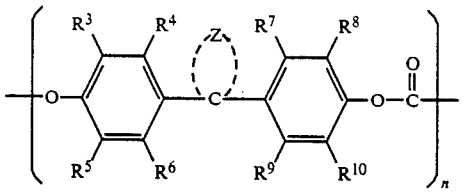

wherein $R^3$, $R^4$, $R^5$, $R^6$, $R^7$, $R^8$, $R^9$ and $R^{10}$ each, Z and n are the same as the above-given.

Among the polycarbonates of the invention, those having the structural unit represented by Formula II should be preferred from the viewpoint of that the performance and advantages of the invention can be remarkably displayed. Particularly preferable structural units are those having a cyclohexane ring bonded to the carbon atom of bisphenol A as represented by (II-2), (II-4) and (II-9), and the structural units represented by (II-2) should be more particularly preferable.

Next, the compounds having a hindered phenol structural unit in the molecules thereof will be described below.

The term, a 'hindered phenol structural unit', means a phenol structural unit characterized in that a bulky group of atoms is present at the ortho position of a phenolic hydroxyl group.

As for the bulky groups of atoms, a branched alkyl group is generally used conveniently.

Further, the compounds having a hindered phenol structural unit in the molecules thereof (hereinafter sometimes called an oxidation inhibitor or an antioxidant.) will be exemplified below. It is the matter of course that those shall not be limited to the exemplifications.

The compounds of this kind should preferably have the structural units represented by the following Formula IIIa in the molecules of the compounds.

Formula IIIa

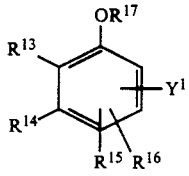

wherein $R^{13}$ represents a branched alkyl group; $R^{14}$, $R^{15}$ and $R^{16}$ each represent a hydrogen atom, a hydroxy group, an alkyl group or an aryl group, and $R^{15}$ and $R^{16}$ may be coupled to each other to complete a ring; and $R^{17}$ represents a hydrogen atom, an alkyl group or an alkylidene group.

The above-given $R^{13}$ should preferably be a tert- or sec-alkyl group having 3 to 40 carbon atoms.

The alkyl groups represented by $R^{14}$, $R^{15}$ or $R^{16}$ include, preferably, those having 1 to 40 carbon atoms, and the aryl groups represented thereby include, for example, a phenyl, naphthyl or pyridyl group and so forth.

When a ring is completed by $R^{15}$ and $R^{16}$, the ring should preferably include a chroman ring.

The alkyl groups or alkylidene groups represented by $R^{17}$ include those having carbon atoms of, preferably, from 1 to 40 and, more preferably, from 1 to 18.

$Y^1$ represents a hydrogen atom or an organic residual group and, more preferably, the latter. These organic residual groups are of hindered amine structural units, hindered phenol structural units or other organic structural units, and they constitute a portion of the molecular structure of a compound relating to the invention, as shown in the afore-given Formula IIIa. It is allowed as the matter of course that each of the compounds constituted thereby may have plural kinds of the structural units represented by Formula IIIa in the molecules of the compound. It is also allowed that they have a plurality of the same structural units represented by the same formula, in the molecules.

As for such organic residual groups as mentioned above, those having various chemical structures may be used for the purpose of endowing a compound with such a property as crystallizing property, compatibility with a binder, solubility to an organic solvent, bleed-out property or diffusibility to a surface or non-bleed-out property or non-diffusibility, and so forth. Any of them may be used freely, because these structures may not reduce the effects of the group of hindered phenol atoms.

As for the compounds at least having a hindered phenol structural unit, the compounds at least having the structural unit represented by the following Formula IIIb in the molecules of the compounds should also be preferable.

Formula IIIb

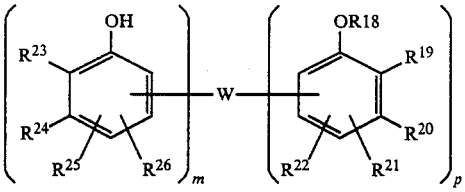

wherein $R^{18}$ represents a hydrogen atom, an alkyl group, an aryl group or an aralkyl group; $R^{19}$ and $R^{23}$ each represent a branched alkyl group; $R^{20}$, $R^{21}$, $R^{22}$ and $R^{24}$, $R^{25}$, $R^{26}$ represent a hydrogen atom or a substituent.

m and p each are zero or a positive integer, and a sum of m plus p is from 2 to 4; and W represents a linkage group.

The alkyl grops represented by the above-given $R^{18}$ include, for example, those having 1 to 40 carbon atoms which may also have a substituent. As for the substituents to $R^{18}$, those of aryl, alkoxy, acid, amide, halogen or the like may be used.

The aralkyl groups include, for example, a benzyl group, a phenetyl group and so forth.

The branched alkyl groups represented by $R^{19}$ or $R^{23}$ include those having 1 to 40 carbon atoms, such as a t-butyl, a sec-butyl, a sec-octyl, a t-octyl ot the like groups.

The substituents which $R^{20}$ through $R^{22}$ and $R^{24}$ through $R^{26}$ are allowed to have include, for example, those of an aryl, an alkoxy, an acid, an amide, a halogen and so forth.

The linkage groups represented by W may be varied according to the values of m and p. W includes, typically, the group of methylene, ethylene, propylene, phenylene, sulfido or polysulfido. There also include the case where phenyl groups are directly bonded each other without W.

The preferable compounds at least having a hindered phenol structural unit in the molecules thereof also include a compound having a structural unit represented by the following Formula IIIc, IIId or IIIe in the molecule thereof.

Formula IIIc

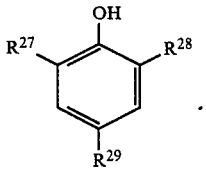

Formula IIId

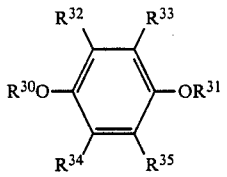

-continued

Formula IIIe

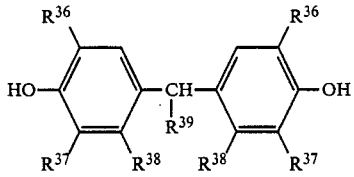

In Formula IIIc, the alkyl groups each having 1 to 4 carbon atoms, which are represented by $R^{27}$, $R^{28}$ or $R^{29}$ may be straight-chained or branched. Those alkyl groups include, typically, a group of methyl, ethyl, propyl, i-propyl, butyl, sec-butyl, t-butyl or the like.

Among those groups, a t-butyl group should particularly be preferable. $R^{27}$, $R^{28}$ and $R^{29}$ may be the same with or the different from each other.

In Formula IIId, $R^{30}$ and $R^{31}$ each represent a group of alkyl, alkenyl, cycloalkyl, aryl or heterocyclic. $R^{32}$, $R^{33}$, $R^{34}$ and $R^{35}$ each represent an atom of hydrogen or halogen, or a group of alkyl, alkenyl, cycloalkyl, aryl, alkoxy, alkylthio, aryloxy, arylthio, acyl, acylamino, alkylamino, alkoxycarbonyl or sulfonamido.

In Formula IIIe, $R^{36}$ represents an alkyl group having 1 to 18 carbon atoms; $R^{37}$ and $R^{38}$ each represent a hydrogen atom or an alkyl group having 1 to 18 carbon atoms; and $R^{39}$ represents a hydrogen atom or an alkyl group having 1 to 10 carbon atoms.

Further, in Formula IIIe, the alkyl groups having 1 to 18 carbon atoms, each represented by $R^{36}$, $R^{37}$ and $R^{38}$ may be straight-chained or branched, and they include, for example, a group of methyl, ethyl, propyl, i-butyl, t-butyl, pentyl, octyl, dodecyl or the like.

The alkyl groups each having 1 to 10 carbon atoms, which is represented by $R^{39}$, may be straight-chained or branched, and they include, for example, a group of methyl, ethyl, propyl, butyl, t-butyl, sec-pentyl, hexyl, nonyl or the like.

The typical examples of the compounds having a hindered phenol structural unit in their molecules will be given below. It is, however, to be understood that the invention shall not be limited thereto.

Formula IIIc

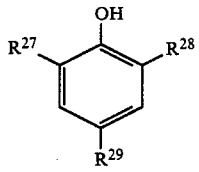

| Compound | $R^{27}$ | $R^{28}$ | $R^{29}$ |
|---|---|---|---|
| III-1 | t-$C_4H_9$ | t-$C_4H_9$ | $C_4H_9$ |
| III-2 | t-$C_4H_9$ | t-$C_4H_9$ | t-$C_4H_9$ |
| III-3 | t-$C_4H_9$ | t-$C_4H_9$ | sec-$C_4H_9$ |
| III-4 | t-$C_4H_9$ | t-$C_4H_9$ | $CH_3$ |
| III-5 | t-$C_4H_9$ | t-$C_4H_9$ | $C_2H_5$ |
| III-6 | t-$C_4H_9$ | $CH_3$ | $CH_3$ |
| III-7 | t-$C_4H_9$ | $CH_3$ | t-$C_4H_9$ |
| III-8 | t-$C_4H_9$ | $CH_3$ | $C_4H_9$ |
| III-9 | t-$C_4H_9$ | $CH_3$ | sec-$C_4H_9$ |
| III-10 | t-$C_4H_9$ | $CH_3$ | $C_2H_5$ |
| III-11 | t-$C_4H_9$ | $C_2H_5$ | $C_4H_9$ |
| III-12 | t-$C_4H_9$ | $C_2H_5$ | t-$C_4H_9$ |
| III-13 | t-$C_4H_9$ | $C_2H_5$ | sec-$C_4H_9$ |
| III-14 | t-$C_4H_9$ | $C_2H_5$ | $CH_3$ |
| III-15 | t-$C_4H_9$ | $C_2H_5$ | $C_2H_5$ |
| III-16 | $C_2H_5$ | $C_2H_5$ | sec-$C_4H_9$ |
| III-17 | $C_2H_5$ | $C_2H_5$ | t-$C_4H_9$ |
| III-18 | i-$C_4H_9$ | i-$C_4H_9$ | $CH_3$ |

-continued

Formula IIIc

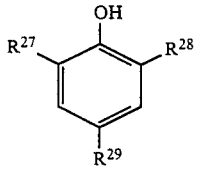

| Compound | $R^{27}$ | $R^{28}$ | $R^{29}$ |
|---|---|---|---|
| III-19 | sec-$C_4H_9$ | sec-$C_4H_9$ | $C_3H_7$ |
| III-20 | sec-$C_4H_9$ | sec-$C_4H_9$ | sec-$C_4H_9$ |

Formula IIId

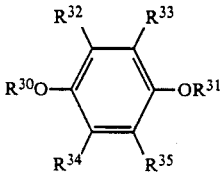

| Compound | $R^{30}$ | $R^{31}$ | $R^{32}$~$R^{35}$ (Blank = H) | |
|---|---|---|---|---|
| III-21 | $C_7H_{15}$ | $C_7H_{15}$ | $R^{32}$: $C_{12}H_{25}$(sec) | $R^{35}$: $CH_3$ |
| III-22 | $C_{10}H_{21}$ | $C_{10}H_{21}$ | $R^{32}$: $C_8H_{17}$(t) | $R^{35}$: $CH_3$ |
| III-23 | $C_{20}H_{41}$ | $C_{20}H_{41}$ | $R^{32}$: $C_4H_9$(t) | $R^{35}$: $CH_3$ |
| III-24 | $C_4H_9$ | $C_4H_9$ | $R^{32}$: $C_{12}H_{25}$(sec) | $R^{35}$: $CH_3$ |
| III-25 | $C_4H_9$ | $C_4H_9$ | $R^{32}$: $C_8H_{17}$(t) | $R^{35}$: $CH_3$ |
| III-26 | $C_4H_9$ | $C_4H_9$ | $R^{32}$: $C_{18}H_{37}$(sec) | $R^{35}$: $CH_3$ |
| III-27 | $C_8H_{17}$ | $C_8H_{17}$ | $R^{32}$: $C_{18}H_{37}$(sec) | $R^{35}$: $CH_3$ |
| III-28 | $C_8H_{17}$ | $C_8H_{17}$ | $R^{32}$: $C_8H_{17}$(t) | $R^{35}$: $CH_3$ |
| III-29 | $C_8H_{17}$ | $C_8H_{17}$ | $R^{32}$: $C_4H_9$(t) | $R^{35}$: $CH_3$ |
| III-30 | $C_8H_{17}$ | $C_8H_{17}$ | $R^{32}$: $C_4H_9$(t) | $R^{35}$: $CH_3$ |
| III-31 | $C_{12}H_{25}$ | $C_{12}H_{25}$ | $R^{32}$: $C_4H_9$(t) | $R^{35}$: $CH_3$ |
| III-32 | $C_{12}H_{25}$ | $C_{12}H_{25}$ | $R^{32}$: $C_8H_{17}$(t) | $R^{35}$: $CH_3$ |
| III-33 | $C_{12}H_{25}$ | $C_{12}H_{25}$ | $R^{32}$: $C_{12}H_{25}$(sec) | $R^{35}$: $CH_3$ |
| III-34 | $C_{16}H_{33}$ | $C_{16}H_{33}$ | $R^{32}$: $C_4H_9$(sec) | $R^{35}$: $CH_3$ |
| III-35 | $C_{16}H_{33}$ | $C_{16}H_{33}$ | $R^{32}$: $C_4H_9$(t) | $R^{35}$: $CH_3$ |
| III-36 | $C_{16}H_{33}$ | $C_{16}H_{33}$ | $R^{32}$: $C_{12}H_{25}$(sec) | $R^{35}$: $CH_3$ |
| III-37 | $C_8H_{17}$ | $C_8H_{17}$ | $R^{32}$: $CH_3$ $R^{34}$: $CH_3$ | $R^{35}$: $CH_3$ |
| III-38 | $C_{12}H_{25}$ | $C_{12}H_{25}$ | $R^{32}$: $CH_3$ $R^{34}$: $CH_3$ | $R^{35}$: $CH_3$ |
| III-39 | $C_{16}H_{33}$ | $C_{16}H_{33}$ | $R^{32}$: $CH_3$ $R^{34}$: $CH_3$ | $R^{35}$: $CH_3$ |
| III-40 | $CH_2CH{=}CH_2$ | $CH_2CH{=}CH_2$ | $R^{32}$: $C_8H_{17}$(t) | $R^{35}$: $C_8H_{17}$(t) |
| III-41 | $C_8H_{17}$ | $C_8H_{17}$ | $R^{32}$: $C_4H_9$(t) | $R^{35}$: $C_4H_9$(t) |
| III-42 | $C_8H_{17}$ | $C_8H_{17}$ | $R^{32}$: $CH_2$—N O | $R^{35}$: $CH_2$—N O |
| III-43 | $C_{18}H_{33}$ | $C_{18}H_{33}$ | $R^{32}$: $CH_2$—N O | $R^{35}$: $CH_2$—N O |
| III-44 | $C_{18}H_{37}$ | $C_{18}H_{37}$ | $R^{32}$: $C_{12}H_{25}$ | $R^{35}$: $CH_3$ |
| III-45 | $C_{16}H_{33}$ | $C_{16}H_{33}$ | $R^{32}$: $C_{12}H_{25}$ | $R^{35}$: $C_{12}H_{25}$ |
| III-46 | $C_{12}H_{25}$ | $C_{12}H_{25}$ | $R^{32}$: $C_{16}H_{33}$(sec) | $R^{35}$: $C_{16}H_{33}$(sec) |
| III-47 | $C_2H_5$ | $C_2H_5$ | $R^{32}$: $(CH_2)_{11}OCH_3$ | $R^{35}$: $(CH_2)_{11}OCH_3$ |
| III-48 | —$C_6H_4$—$C_4H_9$(t) | —$C_6H_4$—$C_4H_9$(t) | $R^{32}$: $C_{11}H_{23}$ | $R^{35}$: $C_{11}H_{23}$ |
| III-49 | $C_{18}H_{35}$ | $C_{18}H_{35}$ | $R^{32}$: $C_{12}H_{25}$(sec) | $R^{35}$: $C_{12}H_{25}$(sec) |
| III-50 | $CH_3$ | $(CH_2)_{10}Br$ | $R^{32}$: $OCH_3$ | |
| III-51 | H | H | $R^{32}$: $C_{16}H_{33}$ | $R^{35}$: $C_{16}H_{33}$ |
| III-52 | $C_8H_{17}$ | $C_8H_{17}$ | $R^{32}$: O O | $R^{35}$: O O |

-continued

Formula IIId

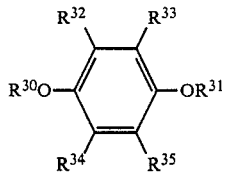

| Compound | $R^{30}$ | $R^{31}$ | $R^{32}$~$R^{35}$ (Blank = H) | |
|---|---|---|---|---|
| III-53 | 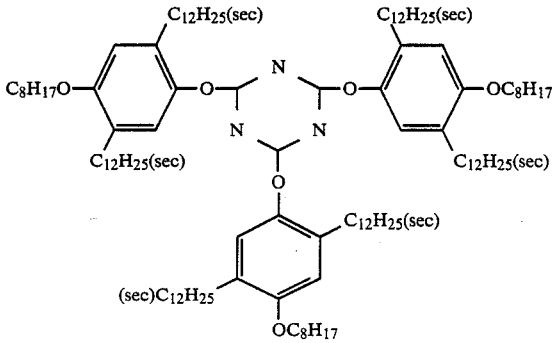 | | | |
| III-54 | 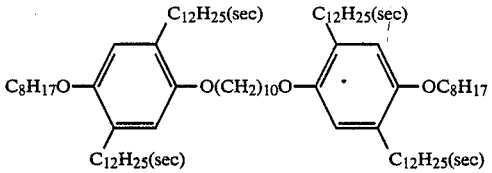 | | | |
| III-55 | $C_3H_7$(i) | $C_3H_7$(i) | $R^{32}$: $(CH_2)_{11}OCH_3$ | |
| III-56 | $C_{18}H_{37}$ | $C_{18}H_{37}$ | $R^{32}$: $CH_2$— 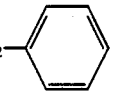 | $R^{35}$: $CH_3$ |
| III-57 | $CH_2$— 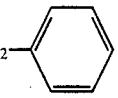 | $CH_2$— 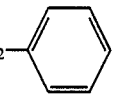 | $R^{32}$: $C_{16}H_{33}$(sec) | $R^{35}$: $C_{16}H_{33}$(sec) |
| III-58 | $C_{12}C_{25}$ | $C_{16}C_{33}$ | $R^{33}$: $CH_3$ | |
| III-59 | $C_{18}C_{37}$ | $C_{18}C_{37}$ | $R^{33}$: $CH_3$ | |
| III-60 | $C_4H_9$ | $C_4H_9$ | $R^{33}$: Cl | $R^{35}$: Cl |
| III-61 | $C_5H_{11}$(sec) | $C_5H_{11}$(sec) | $R^{33}$: $N(CH_2CH_2OH)_2$ | |
| III-62 | $C_3H_7$(i) | 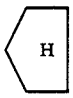 | $R^{32}$: $C_8H_{17}$(t) | $R^{35}$: $CH_3$ |
| III-63 | $C_7H_{15}$(sec) | $C_7H_{15}$(sec) | $R^{32}$: $CH_2CO_2C_2H_5$ | $R^{35}$: $CH_2CO_2C_2H_5$ |
| III-64 | $C_8H_{17}$ | $C_8H_{17}$ | $R^{32}$: $COCH_3$ | |
| III-65 | $C_{16}H_{33}$ | $C_{16}H_{33}$ | $R^{32}$: $COC_{11}H_{23}$ | |
| III-66 | $C_{12}H_{25}$(sec) | $C_{12}H_{25}$(sec) | $R^{32}$: $CO_2C_2H_5$ | |
| III-67 | $C_{16}H_{33}$ | $C_{16}H_{33}$ | $R^{32}$: $OC_2H_5$ | $R^{35}$: $OC_2H_5$ |
| III-68 | $CH_2CO_2C_2H_5$ | $CH_2CO_2C_2H_5$ | $R^{32}$: $C_4H_9$(t) | $R^{35}$: $C_4H_9$(t) |
| III-69 | $CHCO_2C_2H_5$ \| $C_{12}H_{25}$ | $C_3H_7$ | $R^{32}$: $C_4H_9$(t) | $R^{35}$: $CH_3$ |
| III-70 | $C_2H_5$ | $CH_2CH_2$— 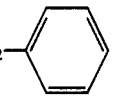 | $R^{32}$: $NHCOCH_3$ | |
| III-71 | $C_{12}H_{25}$ | $C_{12}H_{25}$ | $R^{32}$: $C_4H_9$(t) | $R^{35}$: $C_4H_9$(t) |
| III-72 | $C_8H_{17}$ | $C_8H_{17}$ | $R^{32}$: $C_8H_{17}$(t) | $R^{35}$: $C_8H_{17}$(t) |

-continued

Formula IIId

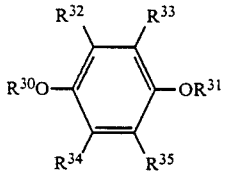

| Compound | $R^{30}$ | $R^{31}$ | $R^{32}$~$R^{35}$ (Blank = H) | |
|---|---|---|---|---|
| III-73 | $C_2H_5$ | $C_2H_5$ | $R^{32}$: $C_6H_{13}$(t) | $R^{35}$: $C_6H_{13}$(t) |
| III-74 | $CH_3$ | $CH_3$ | $R^{32}$: $C_4H_9$(t) | $R^{35}$: $C_4H_9$(t) |
| III-75 | $C_4H_9$ | $C_4H_9$ | $R^{32}$: $C_4H_9$(t) | $R^{35}$: $C_4H_9$(t) |
| III-76 | 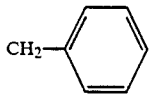 | 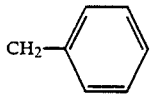 | $R^{32}$: $C_4H_9$(t) | $R^{35}$: $C_4H_9$(t) |
| III-77 | $C_{18}H_{37}$ | $C_{18}H_{37}$ | $R^{32}$: $C_4H_9$(t) | $R^{35}$: $C_4H_9$(t) |
| III-78 | $C_{16}H_{33}$ | $C_{16}H_{33}$ | $R^{32}$: $C_4H_9$(t) | $R^{35}$: $C_4H_9$(t) |
| III-79 | 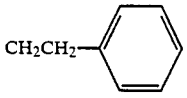 | 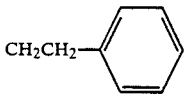 | $R^{32}$: $C_4H_9$(t) | $R^{35}$: $C_4H_9$(t) |
| III-80 | $C_4H_9$ | $C_4H_9$ | $R^{32}$: $C_5H_{11}$(t) | $R^{35}$: $C_5H_{11}$(t) |
| III-81 | $C_2H_5$ | $C_2H_5$ | $R^{32}$: $C_5H_{11}$(t) | $R^{35}$: $C_5H_{11}$(t) |
| III-82 | $C_3H_7$ | $C_3H_7$ | $R^{32}$: $C_5H_{11}$(t) | $R^{35}$: $C_5H_{11}$(t) |
| III-83 | $CH_3$ | $CH_3$ | $R^{32}$: $C_5H_{11}$(t) | $R^{35}$: $C_5H_{11}$(t) |
| III-84 | 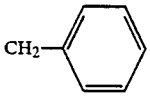 | 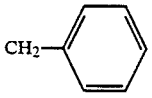 | $R^{32}$: $C_5H_{11}$(t) | $R^{35}$: $C_5H_{11}$(t) |
| III-85 | $CH_3$ | $CH_3$ | $R^{32}$: $C_6H_{13}$(t) | $R^{35}$: $C_6H_{13}$(t) |
| III-86 | $C_3H_7$ | $C_3H_7$ | $R^{32}$: $C_6H_{13}$(t) | $R^{35}$: $C_6H_{13}$(t) |
| III-87 | $C_4H_9$ | $C_4H_9$ | $R^{32}$: $C_6H_{13}$(t) | $R^{35}$: $C_6H_{13}$(t) |
| III-88 | 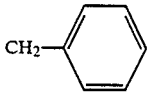 | 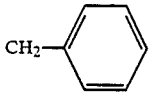 | $R^{32}$: $C_6H_{13}$(t) | $R^{35}$: $C_6H_{13}$(t) |
| III-89 | $CH_3$ | $CH_3$ | $R^{32}$: $C_8H_{17}$(t) | $R^{35}$: $C_8H_{17}$(t) |
| III-90 | $C_2H_5$ | $C_2H_5$ | $R^{32}$: $C_8H_{17}$(t) | $R^{35}$: $C_8H_{17}$(t) |
| III-91 | $C_3H_7$ | $C_3H_7$ | $R^{32}$: $C_8H_{17}$(t) | $R^{35}$: $C_8H_{17}$(t) |
| III-92 | $C_4H_9$ | $C_4H_9$ | $R^{32}$: $C_8H_{17}$(t) | $R^{35}$: $C_8H_{17}$(t) |
| III-93 | 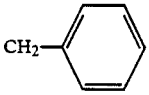 | 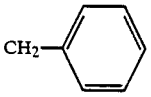 | $R^{32}$: $C_8H_{17}$(t) | $R^{35}$: $C_8H_{17}$(t) |
| III-94 | $CH_3$ | $CH_3$ | $R^{32}$: $C_{12}H_{25}$(t) | $R^{35}$: $C_{12}H_{25}$(t) |
| III-95 | $C_2H_5$ | $C_2H_5$ | $R^{32}$: $C_{12}H_{25}$(t) | $R^{35}$: $C_{12}H_{25}$(t) |
| III-96 | $C_3H_7$ | $C_3H_7$ | $R^{32}$: $C_{12}H_{25}$(t) | $R^{35}$: $C_{12}H_{25}$(t) |
| III-97 | $C_4H_9$ | $C_4H_9$ | $R^{32}$: $C_{12}H_{25}$(t) | $R^{35}$: $C_{12}H_{25}$(t) |
| III-98 | 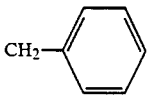 | 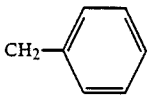 | $R^{32}$: $C_{12}H_{25}$(t) | $R^{35}$: $C_{12}H_{25}$(t) |

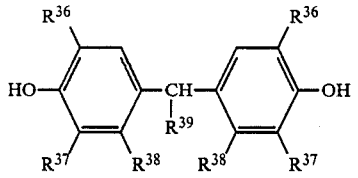
Formula IIIe
| Compound | $R^{36}$ | $R^{37}$ | $R^{38}$ | $R^{39}$ |
|---|---|---|---|---|
| III-99 | $CH_3$ | H | H | H |
| III-100 | $CH_3$ | $CH_3$ | H | H |
| III-101 | $CH_3$ | t-$C_4H_9$ | H | H |
| III-102 | t-$C_4H_9$ | t-$C_4H_9$ | H | H |
| III-103 | t-$C_4H_9$ | H | H | $CH_3$ |
| III-104 | $CH_3$ | H | H | t-$C_4H_9$ |
| III-105 | H | $CH_3$ | $C_3H_7$ | $CH_3$ |
| III-106 | t-$C_4H_9$ | H | $CH_3$ | H |
| III-107 | $CH_3$ | H | $CH_3$ | $C_3H_7$ |
| III-108 | t-$C_4H_9$ | H | $CH_3$ | $C_5H_{11}$ |
| III-109 | $CH_3$ | $CH_3$ | H | $C_9H_{19}$ |
| III-110 | $C_{12}H_{25}$ | $CH_3$ | H | H |
| III-111 | t-$C_4H_9$ | H | $CH_3$ | $C_4H_9$ |
Other compounds
(III-112)
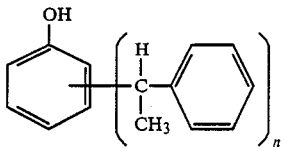
(III-113)
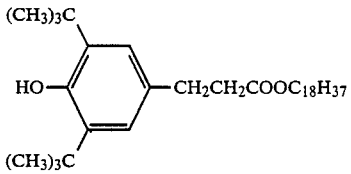
(III-114)
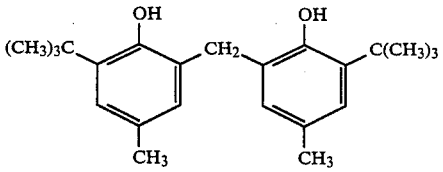
(III-115)
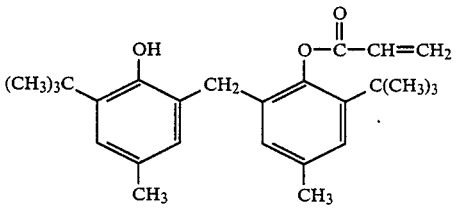
(III-116)
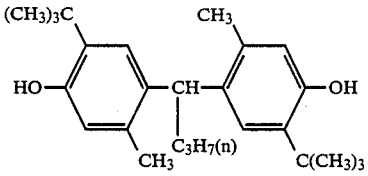
(III-117)
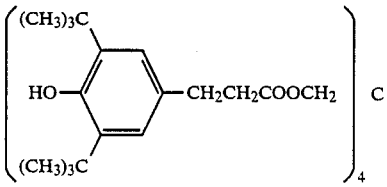
(III-118)
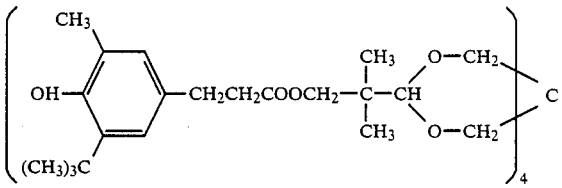

-continued
(III-119)
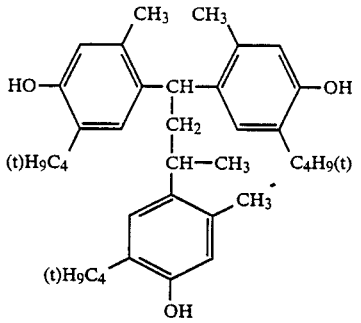
(III-120)
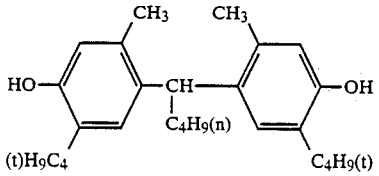
(III-121)
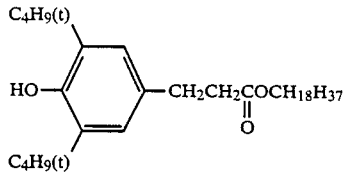
(III-122)
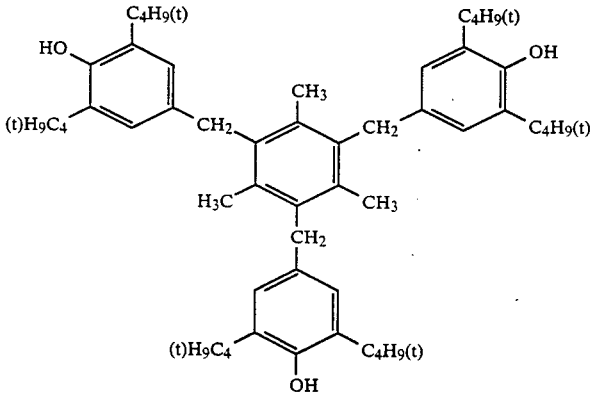
(III-123)
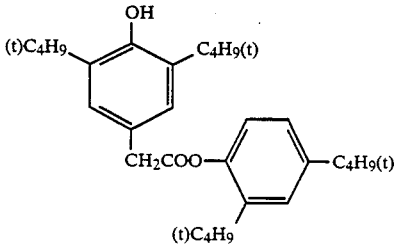
(III-124)
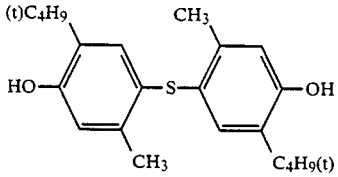

-continued
(III-125)
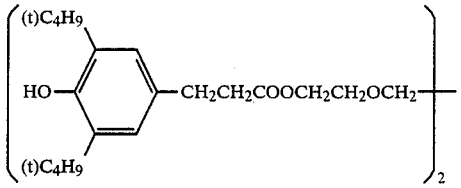
(III-126)
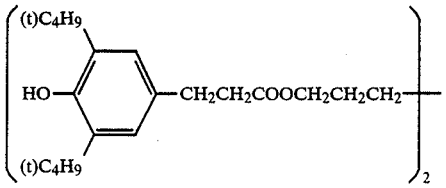
(III-127)
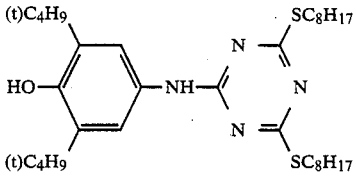
(III-128)
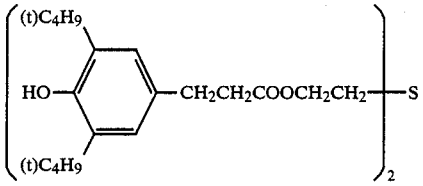
(III-129)
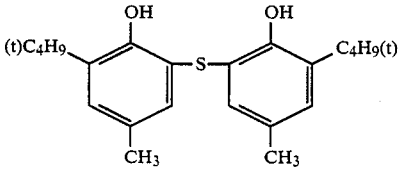
(III-130)
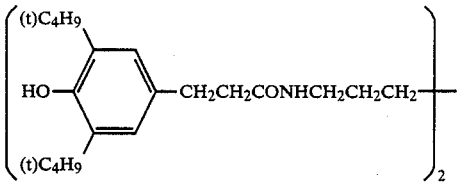
(III-131)
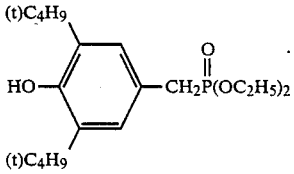
(III-132)
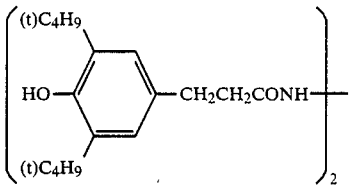

-continued
(III-133)
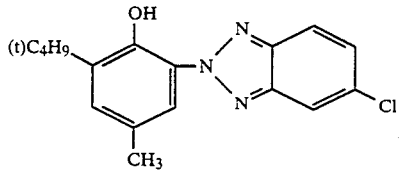
(III-134)
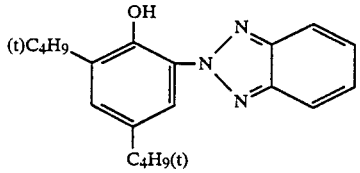
(III-135)
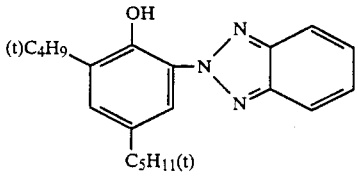
(III-136)
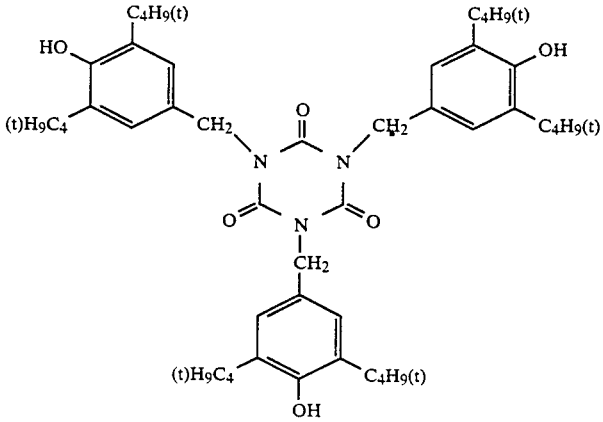
(III-137)
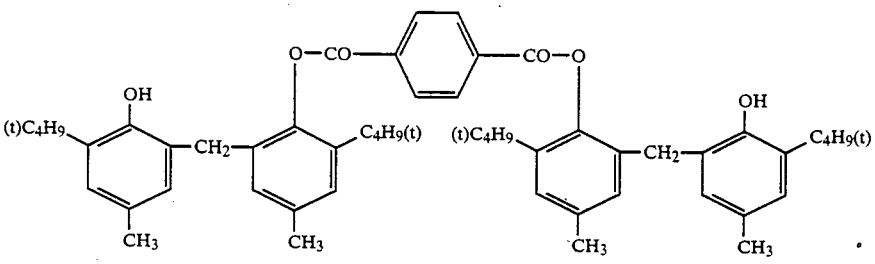
(III-138)
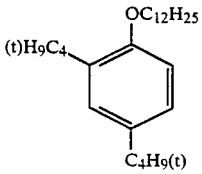
(III-139)
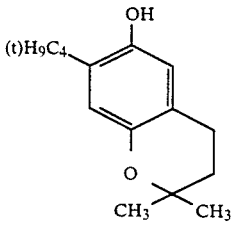

-continued (III-140)

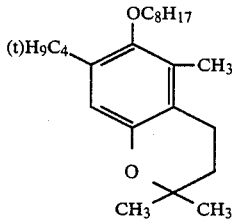

These compounds may readily be synthesized or available.

For example, such a compound as those represented by Formulas IIIa or IIIb are available on the market. They are avaiable under the brand names such as Irganox-245, 259, 565, 1010, 1035, 1076, 1081, 1098, 1222, 1330 and MD1024 (manufactured by Ciba Geigy; Mark AO-20, AO-30, AO-40, AO-50, AO-60 (manufactured by Adeka-Argus); Sumilizer BMT, S, BP-76, MDP-S, GM, BBM-S, WX-R (manufactured by Sumitomo Chemical); and so forth. Besides the above, they may readily be synthesized in any conventionally known methods.

2,4,6-trialkylphenol type compounds such as those represented by Formula IIIc may be available in the form of such an oxidation inhibitor as rubbers, plastics, oils and fats, and so forth.

The compounds represented by Formula IIId may readily be synthesized in such a method as described in, for example, 'Journal of the Chemical Society', pp. 2904–2914, 1965; 'The Journal of Organic Chemistry', Vol. 23, pp. 75–76; and so forth.

The alkylidene bisphenol type compounds represented by Formula IIIe include, for example, those available on the market as oxidation inhibitors for using in plastics, synthetic fibres, elastomers, waxes. oils and fats, and so forth. They may also be synthesized in such a method as those mentioned in, for example, U.S. Pat. Nos. 2,792,428, 2,796,445 and 2,841,619; Japanese Patent Examined Publication No. 40-16539 (1965); Japanese Patent O.P.I. Publication No. 50-6338 (1975); 'Journal of the Chemical Society', 243, 1954; and so forth.

Among the 'compounds having a hindered phenol structural unit in the molecule thereof' relating to the invention, those more preferably used in the invention include a compound containing a hindered amine structural unit in its molecular structure, that is, in other words, a 'compound containing a hindered amine structural unit and a hindered phenol structural unit'.

Next, the compounds each having a hindered amine structural unit and a hindered phenol structural unit in their molecules will be exemplified below. The invention shall not be limited to the following exemplification.

More preferable compounds of this kind should be those having at least one of a hindered amine structural unit represented by the following Formula IIIf and a hindered phenol structural unit represented by the following Formula IIIg in the molecule of the compound; and the particularly preferable ones should be those having both of the structural units represented by Formulas IIIf and IIIg, respectively.

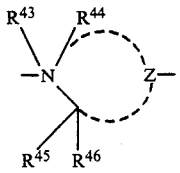

Formula IIIf

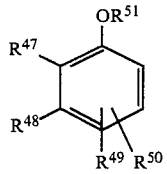

Formula IIIg wherein $R^{43}$, $R^{44}$, $R^{45}$ and $R^{46}$ each represent a hydrogen atom or a group of alkyl or aryl; and Z represents a group of atoms necessary to complete a nitrogen-containing aliphatic ring. In a pair of $R^{43}$ and $R^{44}$ and a pair of $R^{45}$ and $R^{46}$, one of each pair may be incorporated into Z so as to give a double bond.

Besides, $R^{47}$ represents a branched alkyl group; $R^{48}$, $R^{49}$ and $R^{50}$ each represent a hydrogen atom or a group of hydroxy, alkyl or aryl, and $R^{49}$ and $R^{50}$ are allowed to couple to each other so as to complete a ring; and $R^{51}$ represents a hydrogen atom or a group of alkyl or alkylidene.

The above-mentioned $R^{43}$, $R^{44}$, $R^{45}$ and $R^{46}$ each are preferably an alkyl group having 1 to 40 carbon atoms which is allowed to have such a substituent as any of those of aryl, alkoxy, acid, amide, halogen and so forth.

Z represents a group of atoms necessary to complete a nitrogen-containing aliphatic ring and more preferably a group of atoms for completing a 5- or 6-membered ring.

The preferable ring structures include, for example, each of the rings of piperidine, piperazine, morpholine, pyrrolidine, imidazolidine, oxazolidine, thiazolidine, selenazolidine, pyrroline, imidazoline, isoindoline, tetrahydroisoquinoline, tetrahydropyridine, dihydropyridine, dohydroisoquinoline, oxazoline, thiazoline, selenazoline, pyrrole and so forth, and, more preferably, each of the rings of piperidine, piperazine, morpholine and pyrrolidine.

The above-mentioned $R^{41}$ represents preferably a tert- or sec-alkyl group having 3 to 40 carbon atoms.

The alkyl groups represented by $R^{48}$, $R^{49}$ or $R^{50}$ are preferably those having 1 to 40 carbon atoms. The aryl groups represented thereby include, preferably, a group of phenyl, naphthyl, pyridyl or the like.

When $R^{49}$ and $R^{50}$ complete a ring, the ring should preferably be a chroman ring.

The alkyl and alkylidene groups represented by $R^{51}$ include, preferably, those having 1 to 40 carbon atoms and, more preferably, those having 1 to 18 carbon atoms.

Next, the following compounds will be given as the typical examples of the hindered amine-hindered phenol type compounds which should preferably be used in the invention. It is the matter of course that the invention shall not be limited thereto.
Exemplified compounds
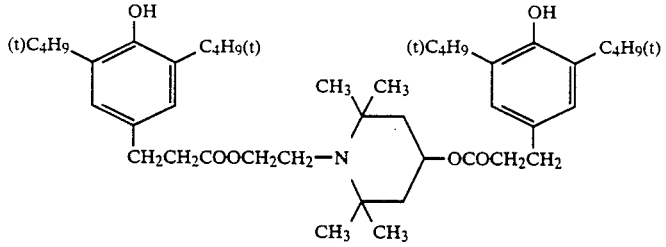
III-141
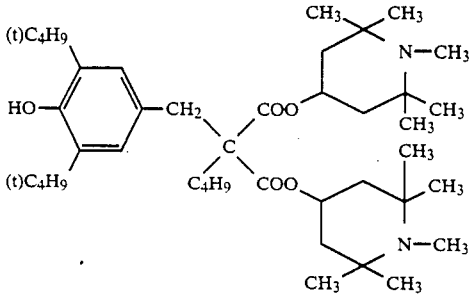
III-142
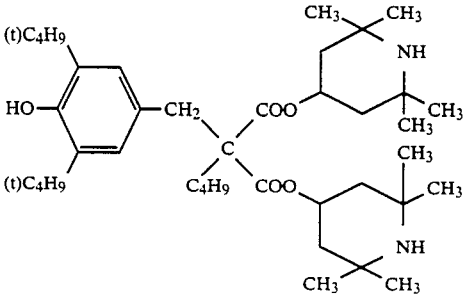
III-143
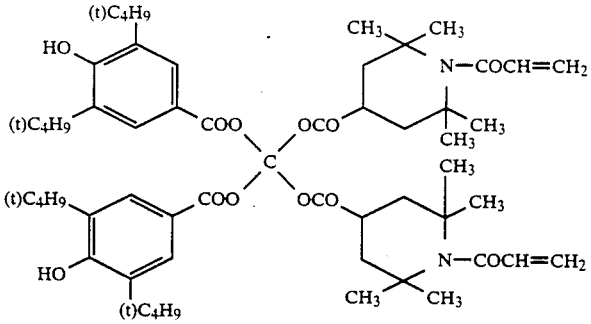
III-144
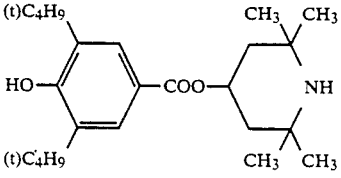
III-145
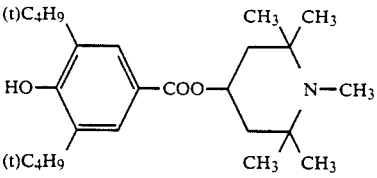
III-146

-continued
III-147
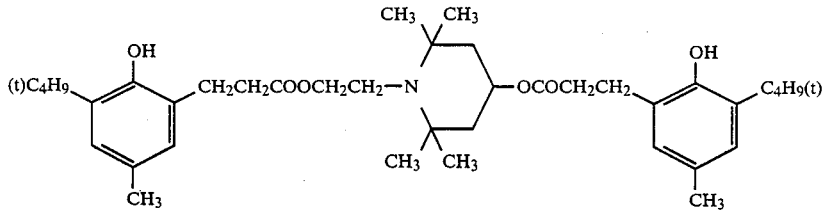
III-148
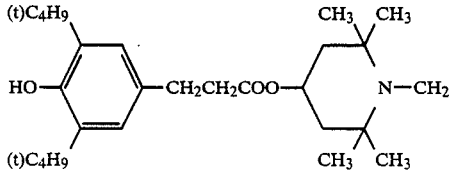
III-149
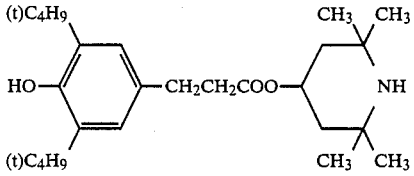
III-150
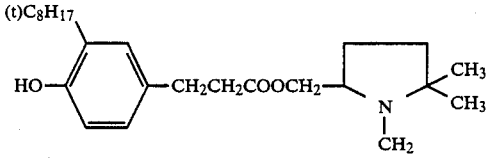
III-151
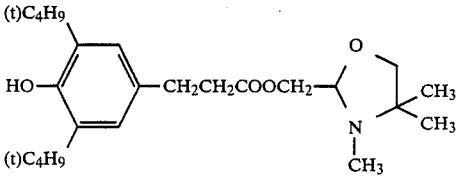
III-152
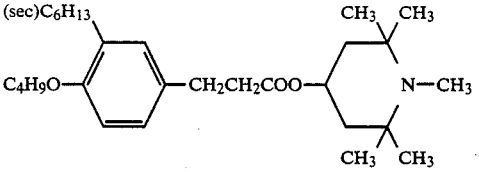
III-153
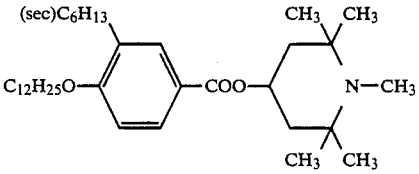
III-154
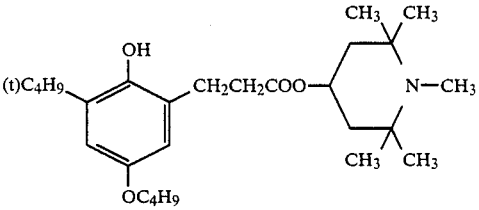

-continued

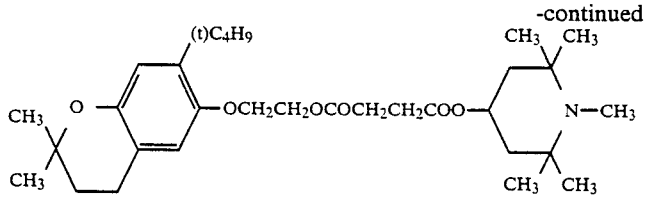

III-155

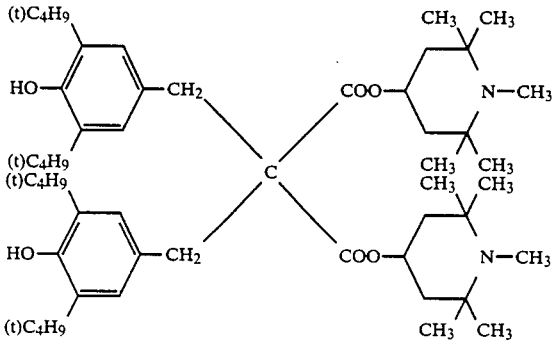

III-156

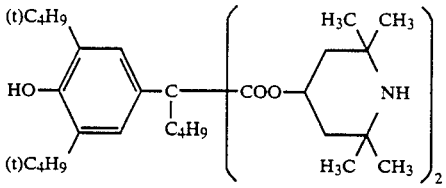

III-57

The above-given compounds are well-known as light stabilizers and may readily be synthesized and available.

For example, the compounds such as those represented by Formulas IIIf and IIIg are available on the market under the brand names such as Tinuvin-144, Ingapalm-1994, Sanol LS-2626 (manufactured by Sankyo Co., Ltd.) and so forth and, besides, those compounds may be synthesized with reference to the mehods described in, for example, Japanese Patent O.P.I. Publication No. Sho 59-133543 (1984).

Figure 2:
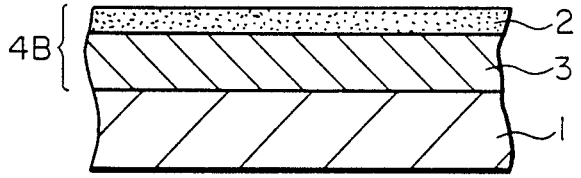
Figure 3:
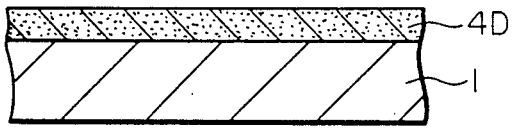
Figure 4:
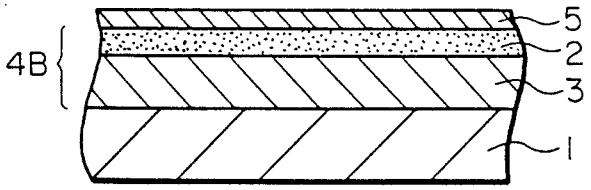

The photoreceptors of the invention include, for example, those, as shown in FIG. 1, comprising a support 1, that is a conductive support or a sheet having a conductive layer thereon, bearing thereon a photoreceptive layer 4A multilayered with the lower layer that is a carrier generation layer 2 (hereinafter sometimes called CGL) containing a carrier generation material (hereinafter sometimes called CGM) and a binder resin, if required, and the upper layer that is a carrier transportation layer 3 (hereinafter sometimes called CTL) containing a carrier transportation material (hereinafter sometimes called CTM) and a binder resin, if required; those, as shown in FIG. 1, comprising a support 1 bearing thereon a photo- receptive layer 4B multilayered with the lower layer that is CTL 3 and the upper layer that is CGL 2; those, as shown in FIG. 3, comprising a support 1 bearing thereon a single-layered photoreceptive layer 4D containing CGM and CTM and, besides, a binder resin, if required; those, as shown in FIG. 4, comprising a multilayered photoreceptive layer 4B (See FIG. 2) bearing thereon an overcoat layer 5 (hereinafter sometimes called OCL); and so forth.

CGL is also allowed to contain both of CGM and CTM, and photoreceptive layers 4A and 4D are further allowed to bear the respective OCLs thereon. Still further, an interlayer and an undercoat layer may be interposed between a support and a photoreceptive layer.

In the invention, the polycarbonate having the principal repetition unit, that is a structural unit represented by the aforegiven Formula I or II and the compound having a hindered phenol structural unit in its molecule, both of them are to be contained in CGL 2 in FIG. 2, CTL 3 in FIG. 1, single-layered photoreceptive layer 4D, OCL 5 in FIG. 5, or the like. It is also allowed to contain both of the polycarbonate and the hindered phenol type compound or a hindered phenol and hindered amine containing compound into the other areas of a photoreceptor than the surface area thereof, such as CGL 2 in FIG. 1, CTL 3 in FIG. 2, photoreceptive layer 4B in FIG. 4. It is further allowed to contain them into a plurality of the layers of the photoreceptor.

When applying the invention to a multilayered photoreceptor comprising CGL as the upper layer and CTL as the lower layer as exemplified in FIGS. 2 and 4, the effects and advantages of the invention can be displayed excellently. This type of photoreceptors have had the problems so far particularly in press life, scratch and abrasion resistance, and so forth, because the thickness of the layer on the surface side is substantially thinner. It may, therefore, be considered that the durability of the photoreceptor may be remarkably improved by adopting the polycarbonates of the invention as described above.

The compounds of the invention containing a hindered phenol or a hindered amine and hindered phenol as their structural units are to be added into a photoreceptor. The amount of the compound to be added may be varied according to the kinds of CTMs. It is, however, preferred to add them in an amount within the following range.

When adding them into CGL, they should be added in an amount of, preferably, from 0.01 to 50 parts by weight to 100 parts by weight of the polycarbonates of the invention and more preferably, from 0.1 to 10 parts by weight.

When adding them into CTL, they should be added in an amount of, preferably, from 0.01 to 50 parts by weight to 100 parts by weight of the polycarbonates of the invention and, more preferably, from 0.1 to 10 parts by weight.

When adding them into a surface layer or OCL and a single-layered photoreceptive layer, it is also preferable to add in the same amount as mentioned above.

As mentioned above, it is desirable to specify the amount of the compounds to be added, because, if the amount added is too small, the residual potential will be increased in repetition use or in continuous use, so that there may be some instances where images may be fogged.

On the other hand, if the amount added is too large, there may be a tendency to lower sensitivity, produce fog, or lower contrast.

Next, as to the CGM suitably applicable to the invention, any inorganic pigments and organic dyes may be used, provided that they may be able to absorb visible rays of light so as to generate a free charge. It is also allowed to use such inorganic pigments include, for example, amorphous selenium, trigonal system selenium, selenium-arsenic alloy, selenium-tellurium alloy, cadmium sulfide, cadmium selenide, cadmium sulfoselenide, mercury sulfide, lead oxide, lead sulfide and so forth. Besides the above, it is also allowed to use the organic pigments such as those given in the following typical examples:

(1) Azo pigments such as monoazo pigments, polyazo pigments, metal complex azo pigments, pyrazolone azo pigments, stilbene azo and thiazole azo pigments, and so forth;
(2) Perylene pigments such as perylene tetracarboxylic acid anhydride, perylene tetracarboxylic acid imide and so forth;
(3) Anthraquinone or polycyclic quinone pigments such as anthraquinone derivatives, anthanthrone derivatives, dibenzpyrenequinone derivatives, pyranthrone derivatives, violanthrone derivatives, isoviolanthrone derivatives and so forth;
(4) Indigoid pigments such as indigo derivatives, thioindigo derivatives and so forth;
(5) Phthalocyanine pigments such as metallo-phthalocyanine, non-metallo-phthalocyanine and so forth;
(6) Carbonium pigments such as diphenylmethane pigments, triphenylmethane pigments, xanthene pigments, acridine pigments and so forth;
(7) Quinoneimine pigments such as azine pigments, oxazine pigments, thiazine pigments and so forth;
(8) Methine pigments such as cyanine pigments, azomethine pigments and so forth;
(9) Quinoline pigments;
(10) Nitro pigments;
(11) Nitroso pigments;
(12) Benzoquinone and naphthoquinone pigments;
(13) Napthalimide pigments; and
(14) Perylene pigments such as bisbenzimidazole derivatives and so forth.

Various azo pigments having an electron attractive group are used, because they have excellent electrophotographic properties including sensitivity, memory phenomena, residual potential and so forth. Among those, polycyclic quinone pigments are most preferable from the viewpoint of ozone resistance.

It may be considered that this preference may be derived from the fact that this type of pigments are inert to ozone.

Phthalocyanine pigments may be exemplified as follows:

(IV-1) X type non-metallo-phthalocyanine,
(IV-2) ζ type non-metallo-phthalocyanine,
(IV-3) Chloroalminium phthalocyanine,
(IV-4) Titanyl phthalocyanine,
(IV-5) Vanadyl phthalocyanine,
(IV-6) ϵ type copper phthalocyanine, and
(IV-7) Chloroindium phthalocyanine.

Phthalocyanine pigments are described in, for example, Japanese Patent Examined Publication No. 49-4338/1974.

The azo pigments applicable to the invention may be given in the following groups V through IX of exemplified compounds.

Exemplified compound group V

| | $X'-N=N-A^1-N=N-X^1$ | |
|---|---|---|
| Compound No. | $-A^1-$ | $-X^1$ |
| V-1 | 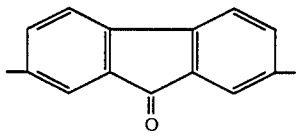 | 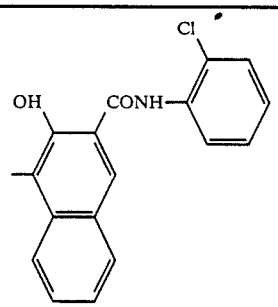 |

-continued
$X'-N=N-A^1-N=N-X^1$
| Compound No. | $-A^1-$ | $-X^1$ |
|---|---|---|
| V-2 | " | 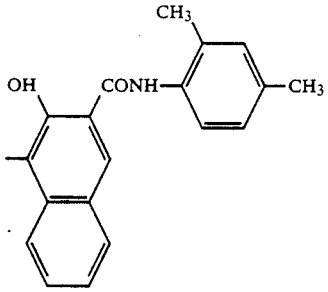 |
| V-3 | 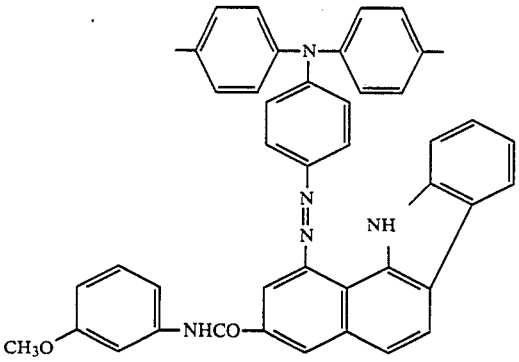 | 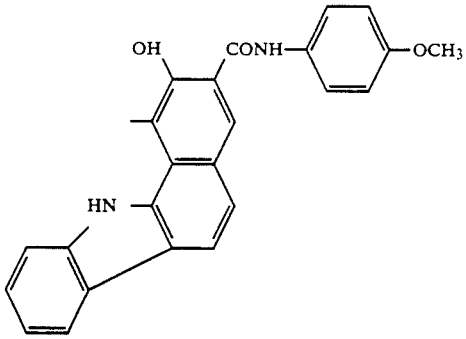 |
| V-4 | 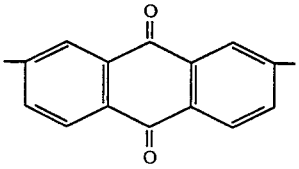 | 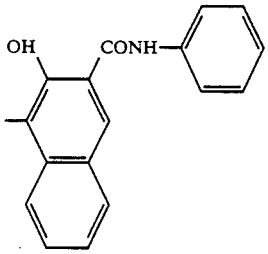 |
| V-5 | 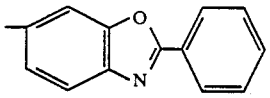 | 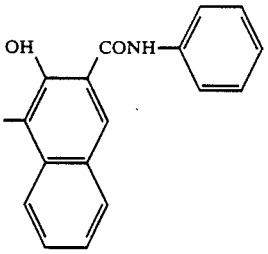 |
| V-6 | 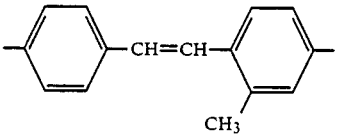 | " |
| V-7 | 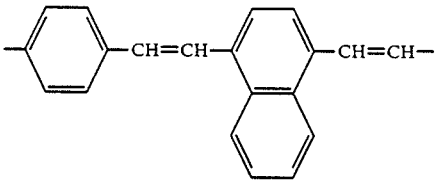 | " |

-continued
| Compound No. | $X'-N=N-A^1-N=N-X^1$ | |
|---|---|---|
| | $-A^1-$ | $-X^1$ |
| V-8 | 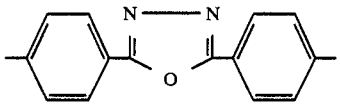 | 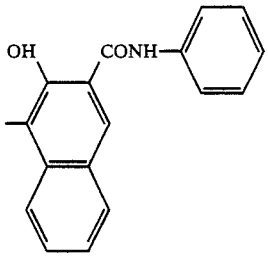 |
Exemplified compound group VI
| Compound No. | $X^2-N=N-A^2-N=N-A^3-N=N-X^3$ | | |
|---|---|---|---|
| | $-A^2-$ | $-A^3-$ | $-X^2, -X^3$ |
| VI-1 | 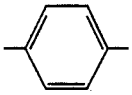 | 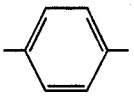 | 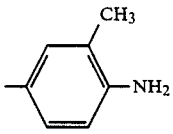 |
| VI-2 | " | " | 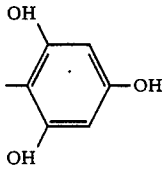 |
| VI-3 | " | " | 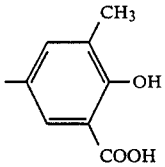 |
| VI-4 | " | " | 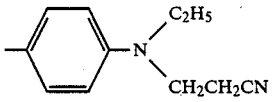 |
| VI-5 | " | " | 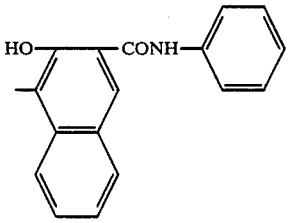 |
| VI-6 | " | " | 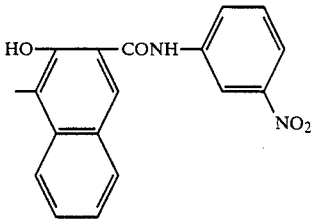 |

-continued
| Compound No. | $X^2-N=N-A^2-N=N-A^3-N=N-X^3$ | | |
|---|---|---|---|
| | $-A^2-$ | $-A^3-$ | $-X^2, -X^3$ |
| VI-7 | " | " | 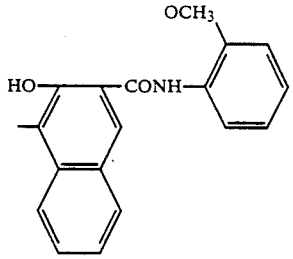 |
| VI-8 | " | " | 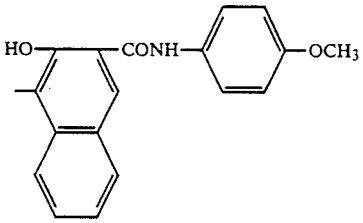 |
| VI-9 | " | " | 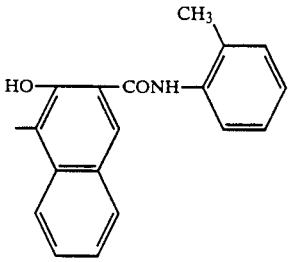 |
| VI-10 | " | " | 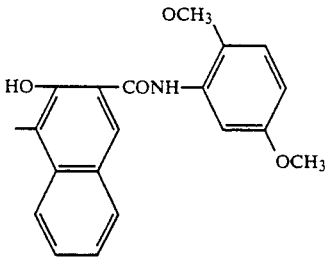 |
| VI-11 | " | " | 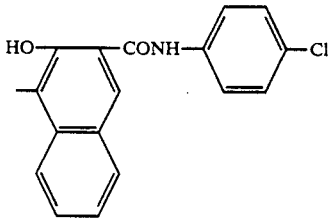 |
| VI-12 | " | " | 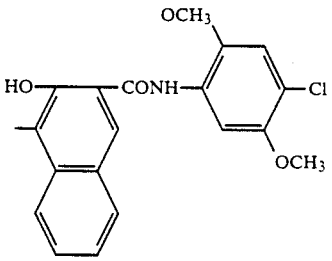 |

-continued
$X^2—N=N—A^2—N=N—A^3—N=N—X^3$
| Compound No. | $—A^2—$ | $—A^3—$ | $—X^2$, $—X^3$ |
|---|---|---|---|
| VI-13 | " | " | 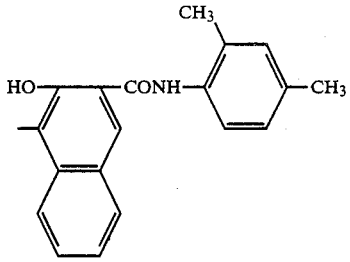 |
| VI-14 | " | " | 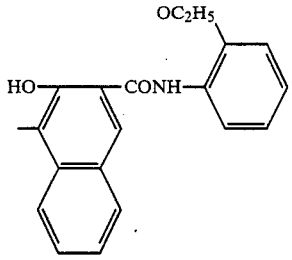 |
| VI-15 | " | " | 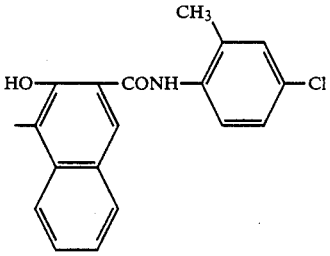 |
| VI-16 | " | " | ($—X^2$) 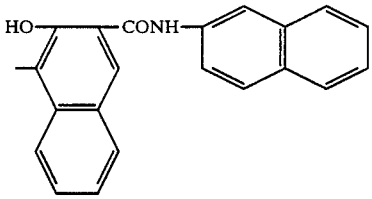 ($—X^3$) 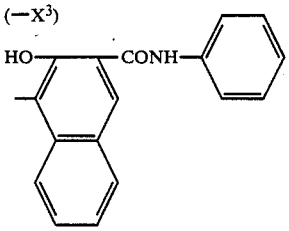 |
| VI-17 | " | " | 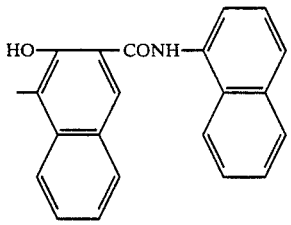 |

-continued
$X^2—N=N—A^2—N=N—A^3—N=N—X^3$
| Compound No. | $—A^2—$ | $—A^3—$ | $—X^2, —X^3$ |
|---|---|---|---|
| VI-18 | " | " | 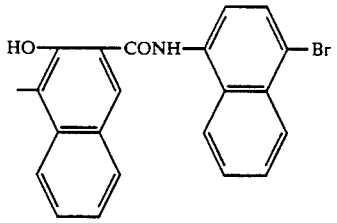 |
| VI-19 | " | " | 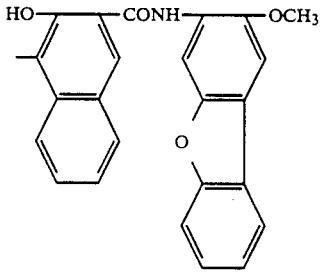 |
| VI-20 | " | " | 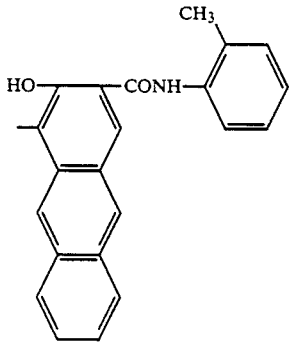 |
| VI-21 | " | " | 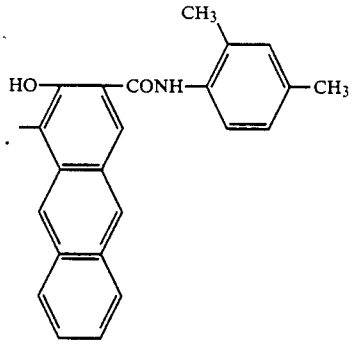 |
| VI-22 | " | " | 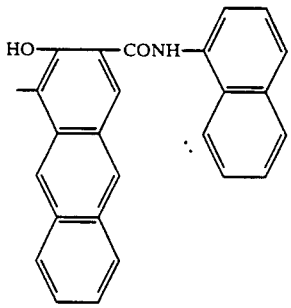 |

-continued
$X^2—N=N—A^2—N=N—A^3—N=N—X^3$
| Compound No. | $—A^2—$ | $—A^3—$ | $—X^2, —X^3$ |
|---|---|---|---|
| VI-23 | " | " | 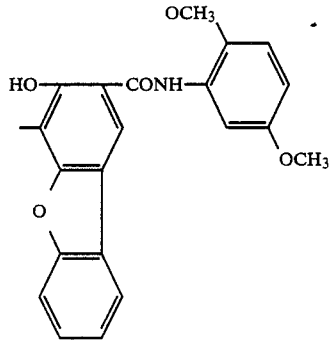 |
| VI-24 | " | " | 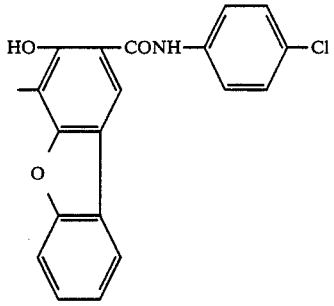 |
| VI-25 | " | " | 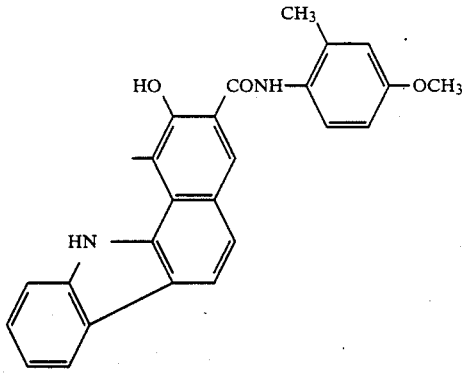 |
| VI-26 | " | " | 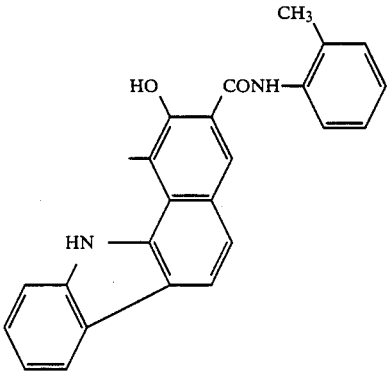 |

-continued
$X^2—N=N—A^2—N=N—A^3—N=N—X^3$
| Compound No. | $—A^2—$ | $—A^3—$ | $—X^2, —X^3$ |
|---|---|---|---|
| VI-27 | " | " | 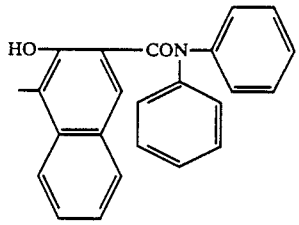 |
| VI-28 | " | " | 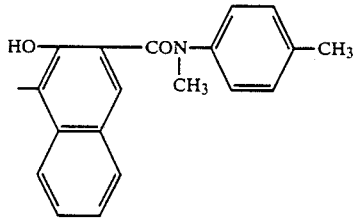 |
| VI-29 | " | " | 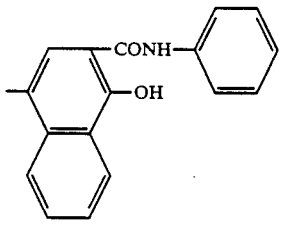 |
| VI-30 | " | " | 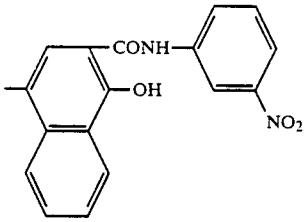 |
| VI-31 | " | " | 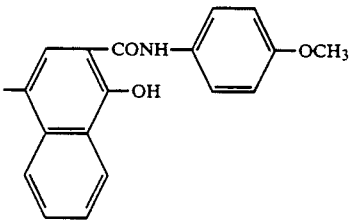 |
| VI-32 | " | " | 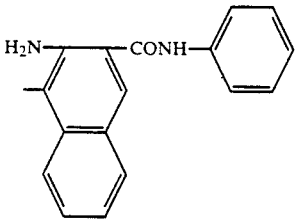 |

-continued
$X^2—N=N—A^2—N=N—A^3—N=N—X^3$
| Compound No. | $—A^2—$ | $—A^3—$ | $—X^2, —X^3$ |
|---|---|---|---|
| VI-33 | " | " | 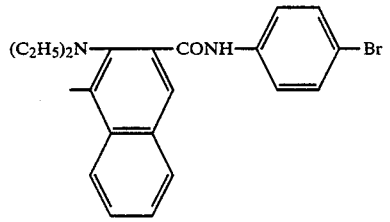 |
| VI-34 | " | " | 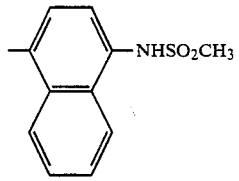 |
| VI-35 | " | " | 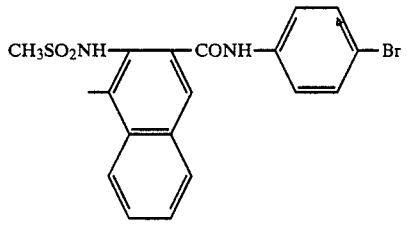 |
| VI-36 | " | " | 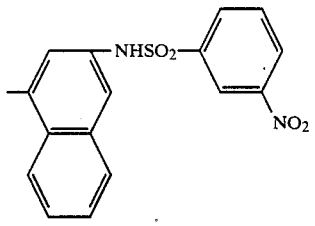 |
| VI-37 | " | " | 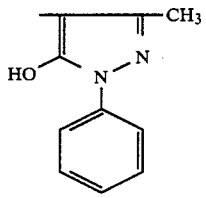 |
| VI-38 | " | " | 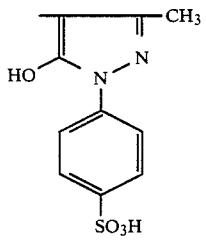 |

-continued
$X^2—N=N—A^2—N=N—A^3—N=N—X^3$
| Compound No. | $—A^2—$ | $—A^3—$ | $—X^2, —X^3$ |
|---|---|---|---|
| VI-39 | " | " | 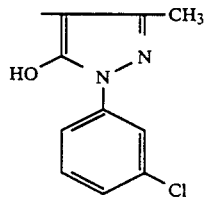 |
| VI-40 | " | " | 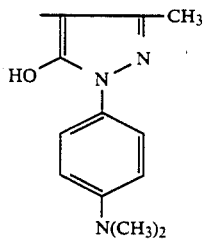 |
| VI-41 | " | " | 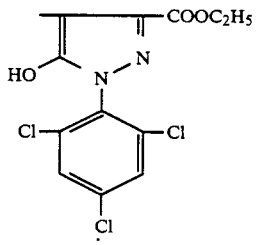 |
| VI-42 | " | " | 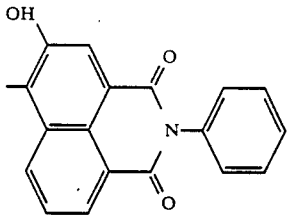 |
| VI-43 | " | " | 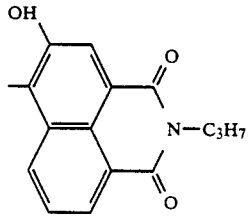 |
| VI-44 | " | " | 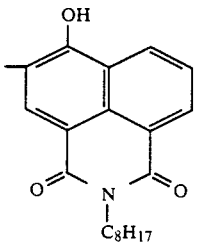 |

-continued
| Compound No. | $-A^2-$ | $-A^3-$ | $-X^2, -X^3$ |
|---|---|---|---|
| | $X^2-N=N-A^2-N=N-A^3-N=N-X^3$ | | |
| VI-45 | " | " | 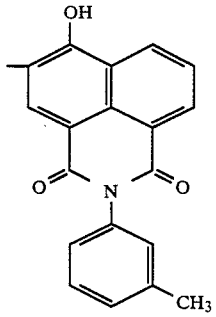 |
| VI-46 | 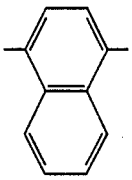 | 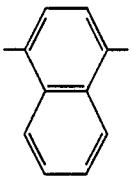 | 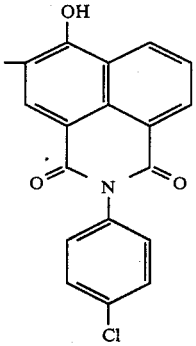 |
| VI-47 | " | " | 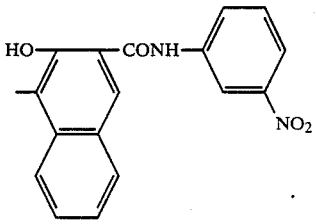 |
| VI-48 | " | 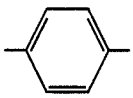 | " |
| VI-49 | 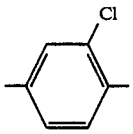 | 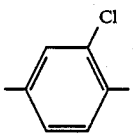 | 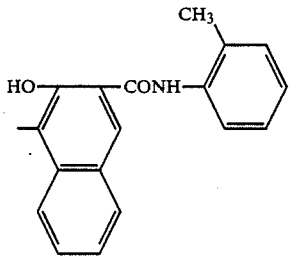 |
| VI-50 | 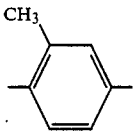 | 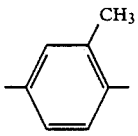 | 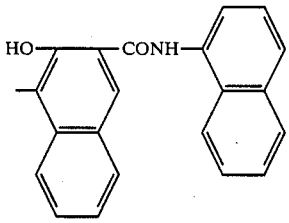 |

-continued
$X^2—N=N—A^2—N=N—A^3—N=N—X^3$
| Compound No. | $—A^2—$ | $—A^3—$ | $—X^2, —X^3$ |
|---|---|---|---|
| VI-51 | 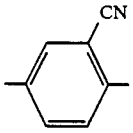 | 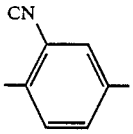 | " |
| VI-52 | 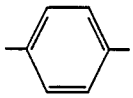 | 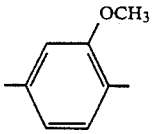 | 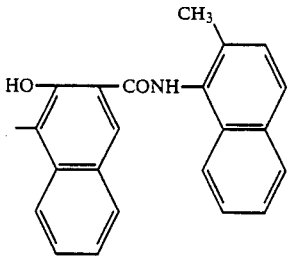 |
| VI-53 | " | 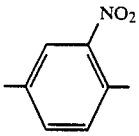 | 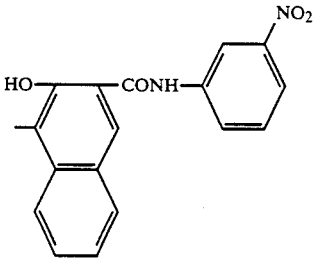 |
| VI-54 | 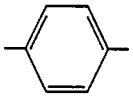 | 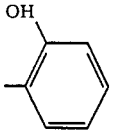 | 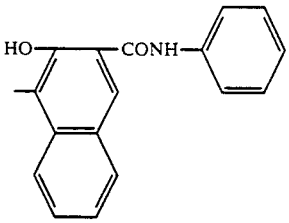 |
| VI-55 | 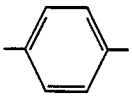 | 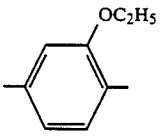 | 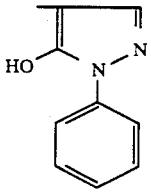 |
| VI-56 | 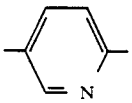 | 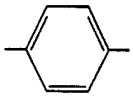 | 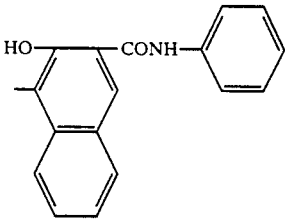 |

-continued
$X^2—N=N—A^2—N=N—A^3—N=N—X^3$
| Compound No. | $—A^2—$ | $—A^3—$ | $—X^2, —X^3$ |
|---|---|---|---|
| VI-57 | 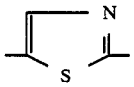 | 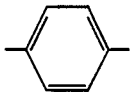 | 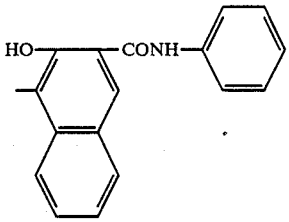 |
| VI-58 | 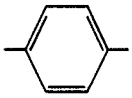 | 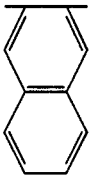 | 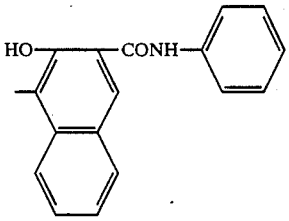 |
| VI-59 | 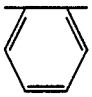 | 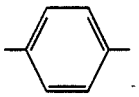 | 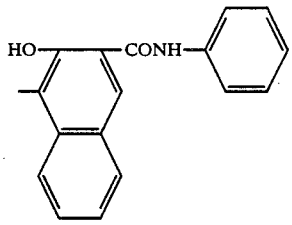 |
| VI-60 | 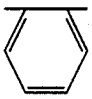 | 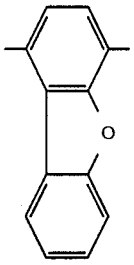 | 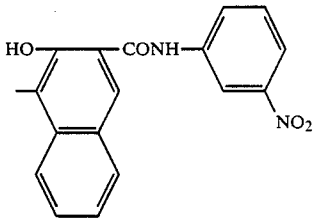 |
| VI-61 | 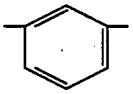 | 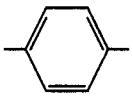 | 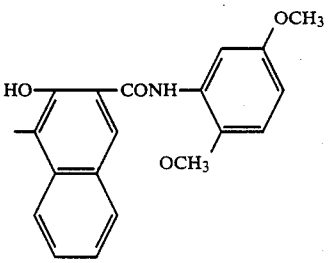 |
| VI-62 | 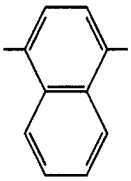 | 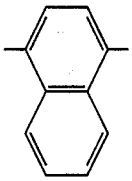 | 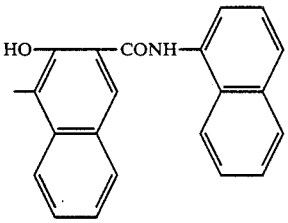 |

-continued
$X^2-N=N-A^2-N=N-A^3-N=N-X^3$
| Compound No. | $-A^2-$ | $-A^3-$ | $-X^2, -X^3$ |
|---|---|---|---|
| VI-63 | 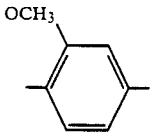 | 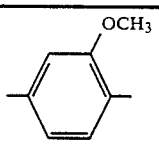 | 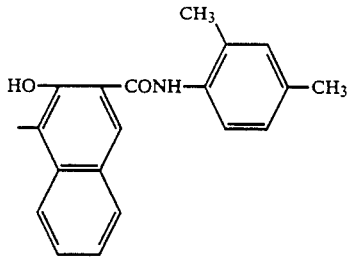 |
| VI-64 | 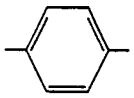 | 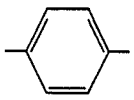 | 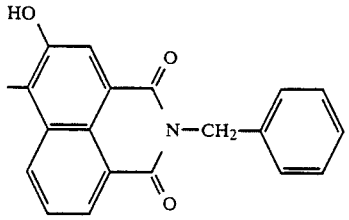 |
Exemplified compound group VII
$X^4-N=N-A^4-N=N-A^5-N=N-A^6-N=N-X^5$
| Compound No. | $-A^4-$ | $-A^5-$ | $-A^6-$ | $-X^4, -X^5$ |
|---|---|---|---|---|
| VII-1 | 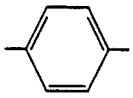 | 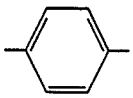 | 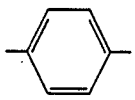 | 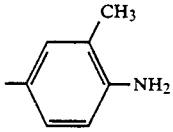 |
| VII-2 | " | " | " | 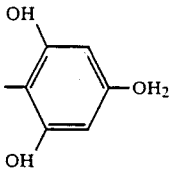 |
| VII-3 | " | " | " | 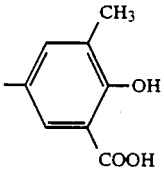 |
| VII-4 | " | " | " | 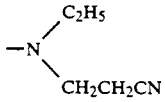 |
| VII-5 | " | " | " | 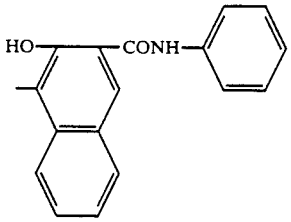 |

-continued
$X^4-N=N-A^4-N=N-A^5-N=N-A^6-N=N-X^5$
| Compound No. | $-A^4-$ | $-A^5-$ | $-A^6-$ | $-X^4$, $-X^5$ |
|---|---|---|---|---|
| VII-6 | " | " | " | 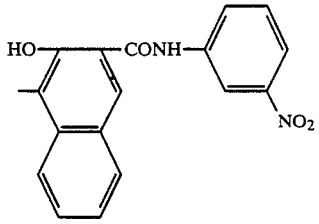 |
| VII-7 | 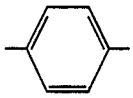 | 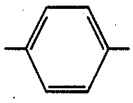 | 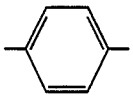 | 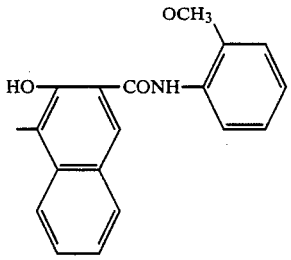 |
| VII-8 | " | " | " | 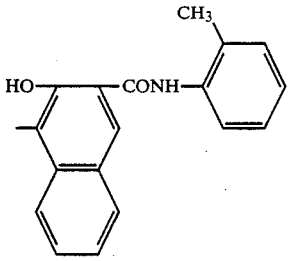 |
| VII-9 | " | " | " | 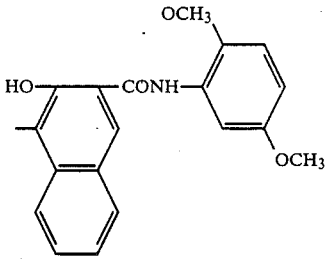 |
| VII-10 | " | " | " | 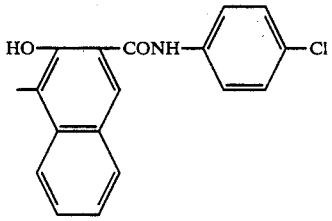 |
| VII-11 | 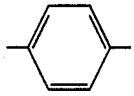 | 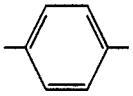 | 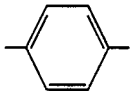 | 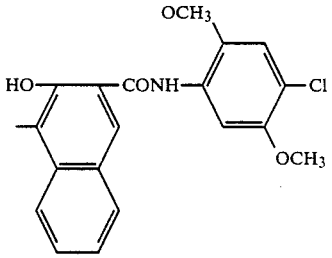 |

-continued
$X^4-N=N-A^4-N=N-A^5-N=N-A^6-N=N-X^5$
| Compound No. | $-A^4-$ | $-A^5-$ | $-A^6-$ | $-X^4$, $-X^5$ |
|---|---|---|---|---|
| VII-12 | " | " | " | 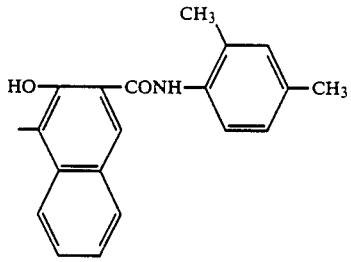 |
| VII-13 | " | " | " | 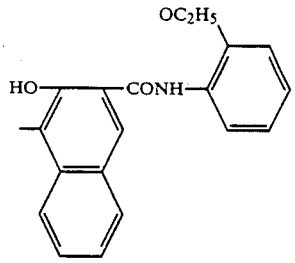 |
| VII-14 | " | " | " | 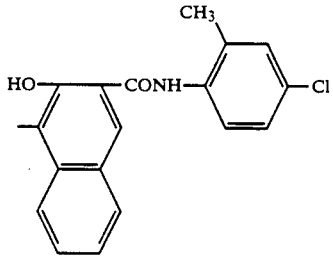 |
| VII-15 | 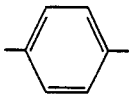 | 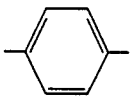 | 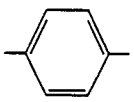 | 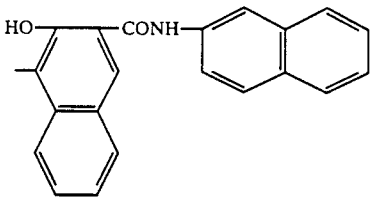 |
| VII-16 | " | " | " | 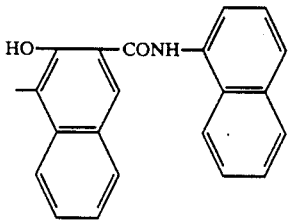 |
| VII-17 | " | " | " | 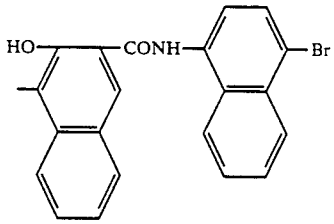 |

-continued
$X^4—N=N—A^4—N=N—A^5—N=N—A^6—N=N—X^5$
| Compound No. | $—A^4—$ | $—A^5—$ | $—A^6—$ | $—X^4, —X^5$ |
|---|---|---|---|---|
| VII-18 | " | " | " | 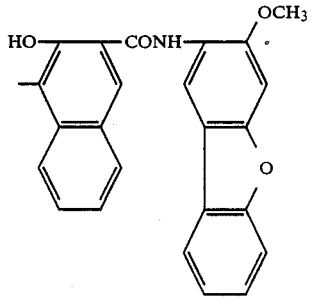 |
| VII-19 | 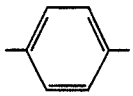 | 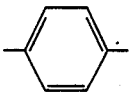 | 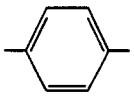 | 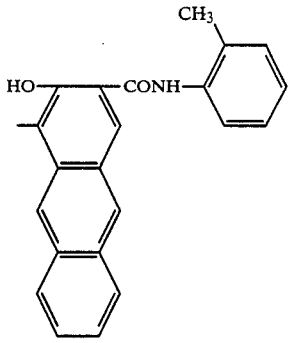 |
| VII-20 | " | " | " | 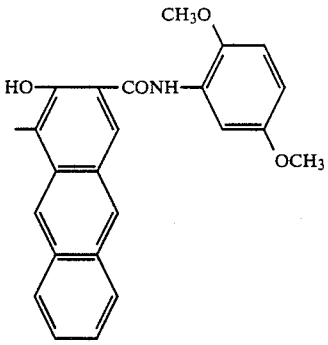 |
| VII-21 | " | " | " | 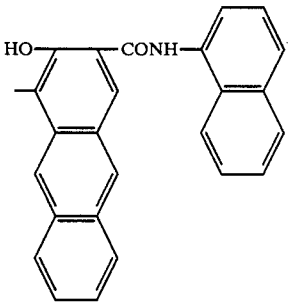 |

-continued
$X^4-N=N-A^4-N=N-A^5-N=N-A^6-N=N-X^5$
| Compound No. | $-A^4-$ | $-A^5-$ | $-A^6-$ | $-X^4$, $-X^5$ |
|---|---|---|---|---|
| VII-22 | 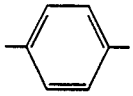 | 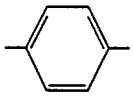 | 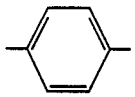 | 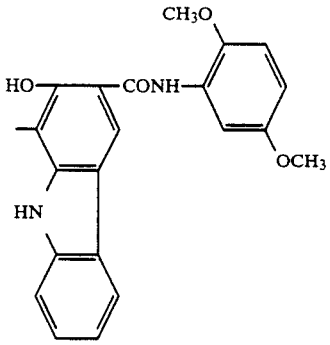 |
| VII-23 | " | " | " | 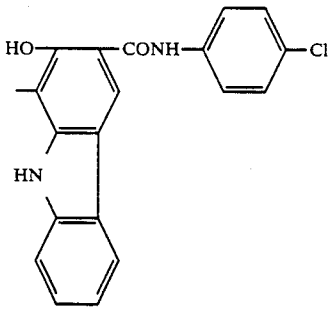 |
| VII-24 | " | " | " | 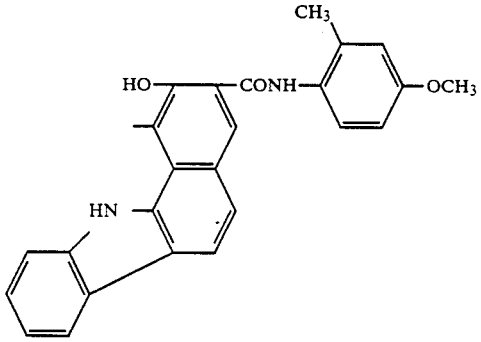 |
| VII-25 | 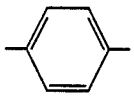 | 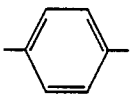 | 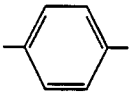 | 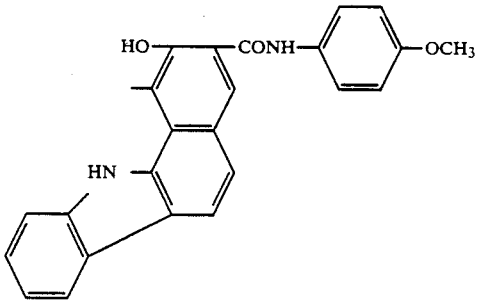 |
| VII-26 | " | " | " | 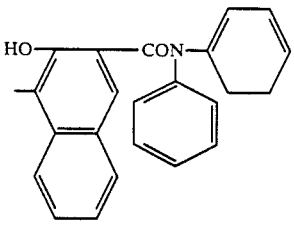 |

-continued
$X^4-N=N-A^4-N=N-A^5-N=N-A^6-N=N-X^5$
| Compound No. | $-A^4-$ | $-A^5-$ | $-A^6-$ | $-X^4$, $-X^5$ |
|---|---|---|---|---|
| VII-27 | " | " | " | 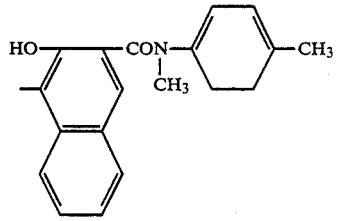 |
| VII-28 | 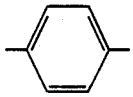 | 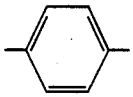 | 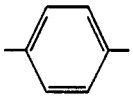 | 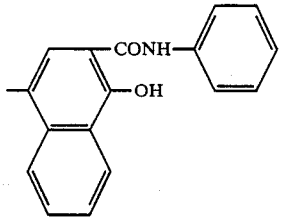 |
| VII-29 | " | " | " | 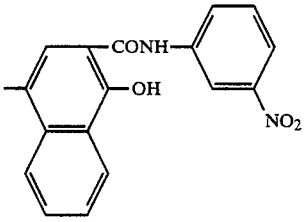 |
| VII-30 | " | " | " | 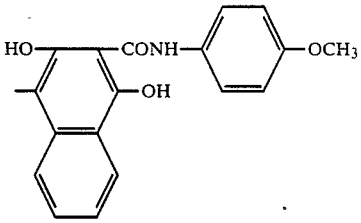 |
| VII-31 | " | " | " | 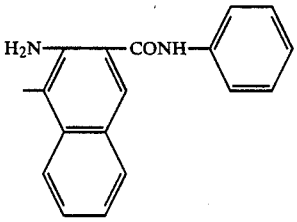 |
| VII-32 | 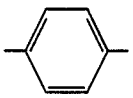 | 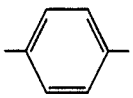 | 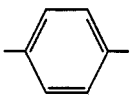 | 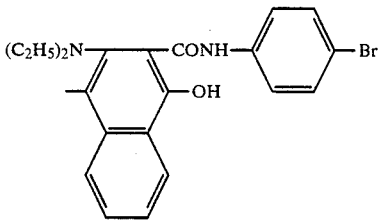 |

-continued
$X^4-N=N-A^4-N=N-A^5-N=N-A^6-N=N-X^5$
| Compound No. | $-A^4-$ | $-A^5-$ | $-A^6-$ | $-X^4, -X^5$ |
|---|---|---|---|---|
| VII-33 | " | " | " | 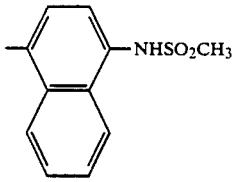 |
| VII-34 | " | " | " | 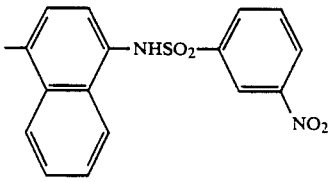 |
| VII-35 | " | " | " | 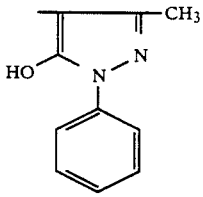 |
| VII-36 | 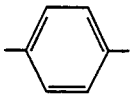 | 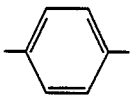 | 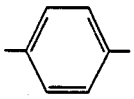 | 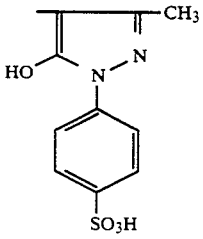 |
| VII-37 | " | " | " | 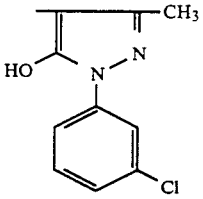 |
| VII-38 | " | " | " | 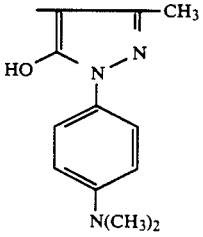 |
| VII-39 | 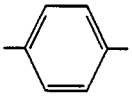 | 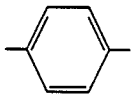 | 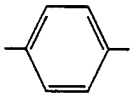 | 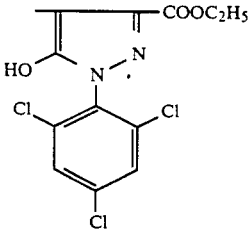 |

-continued
$X^4—N=N—A^4—N=N—A^5—N=N—A^6—N=N—X^5$
| Compound No. | $—A^4—$ | $—A^5—$ | $—A^6—$ | $—X^4, —X^5$ |
|---|---|---|---|---|
| VII-40 | " | " | " | 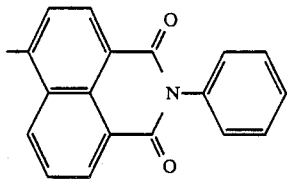 |
| VII-41 | " | " | " | 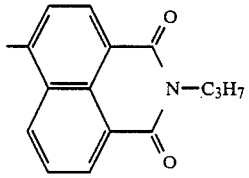 |
| VII-42 | " | " | " | 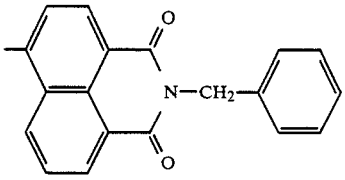 |
| VII-43 | 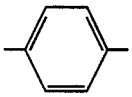 | 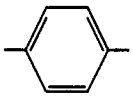 | 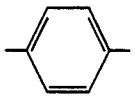 | 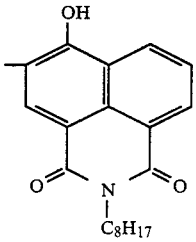 |
| VII-44 | " | " | " | 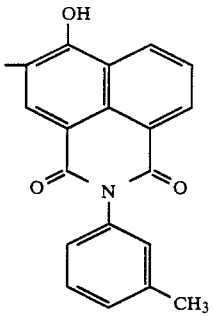 |
| VII-45 | " | " | " | 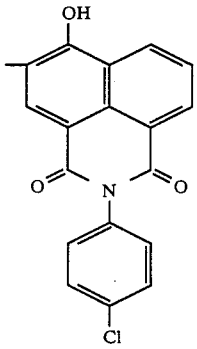 |

-continued
$X^4-N=N-A^4-N=N-A^5-N=N-A^6-N=N-X^5$
| Compound No. | $-A^4-$ | $-A^5-$ | $-A^6-$ | $-X^4$, $-X^5$ |
|---|---|---|---|---|
| VII-46 | 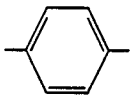 | 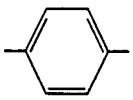 | 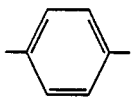 | 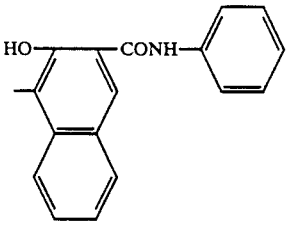 |
| VII-47 | " | " | " | 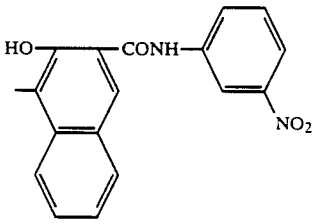 |
| VII-48 | 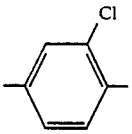 | " | 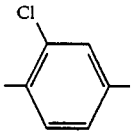 | 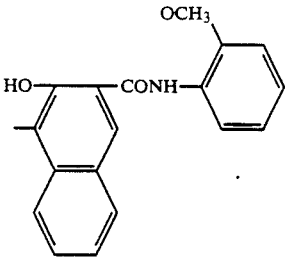 |
| VII-49 | 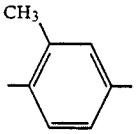 | " | 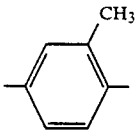 | 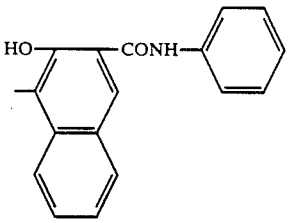 |
| VII-50 | 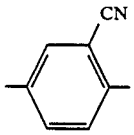 | 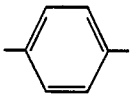 | 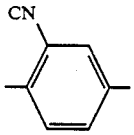 | 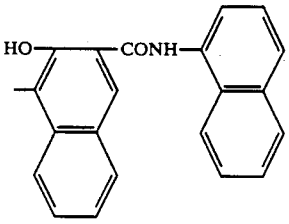 |
| VII-51 | 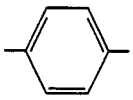 | " | 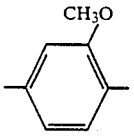 | 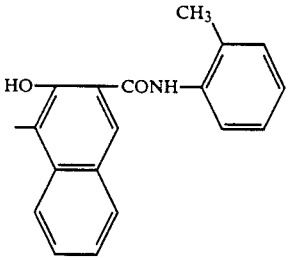 |

-continued
$X^4-N=N-A^4-N=N-A^5-N=N-A^6-N=N-X^5$
| Compound No. | $-A^4-$ | $-A^5-$ | $-A^6-$ | $-X^4$, $-X^5$ |
|---|---|---|---|---|
| VII-52 | " | " | 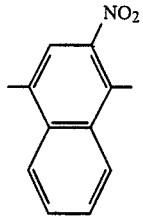 | 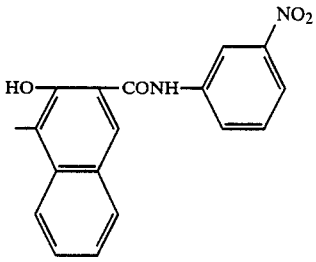 |
| VII-53 | " | " | 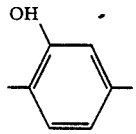 | 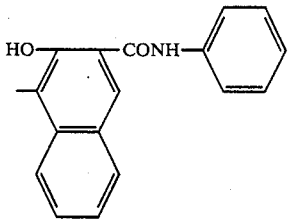 |
| VII-54 | 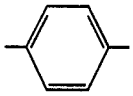 | 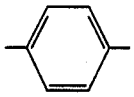 | 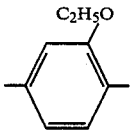 | 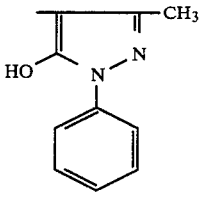 |
| VII-55 | 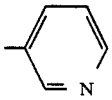 | " | 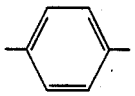 | 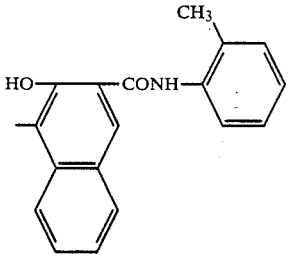 |
| VII-56 | 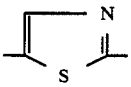 | " | " | 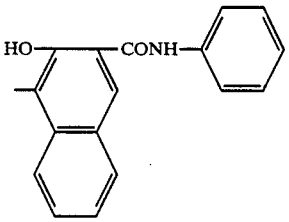 |
| VII-57 | 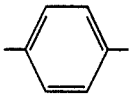 | " | 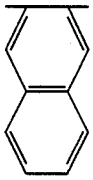 | 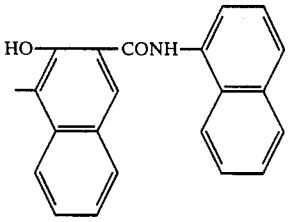 |

-continued
$X^4—N=N—A^4—N=N—A^5—N=N—A^6—N=N—X^5$
| Compound No. | $—A^4—$ | $—A^5—$ | $—A^6—$ | $—X^4$, $—X^5$ |
|---|---|---|---|---|
| VII-58 | 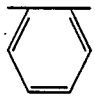 | 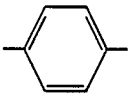 | 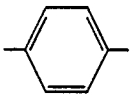 | 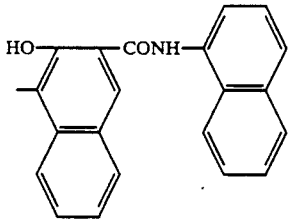 |
| VII-59 | " | " | 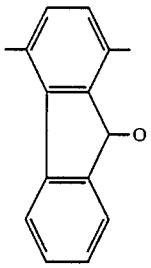 | 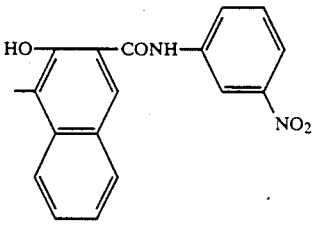 |
| | | | | $—X^4$ |
| VII-60 | 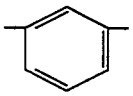 | " | 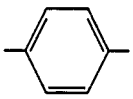 | 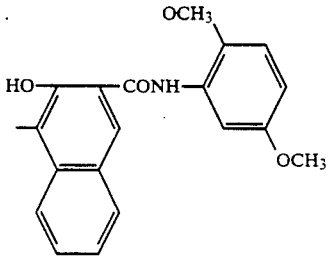 |
| | | | | $—X^5$ |
| | | | | 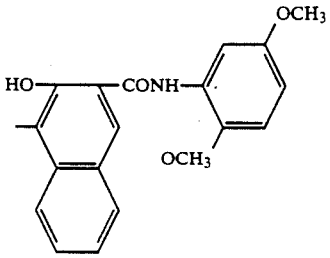 |
| VII-61 | 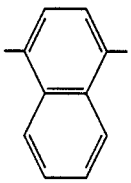 | 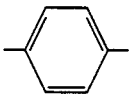 | 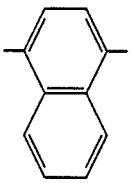 | 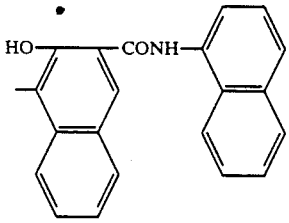 |

-continued
$X^4-N=N-A^4-N=N-A^5-N=N-A^6-N=N-X^5$
| Compound No. | $-A^4-$ | $-A^5-$ | $-A^6-$ | $-X^4$, $-X^5$ |
|---|---|---|---|---|
| VII-62 | 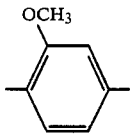 | " | 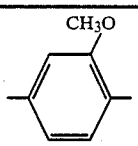 | 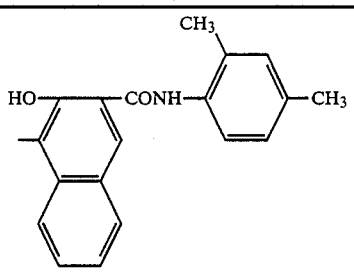 |
| VII-63 | 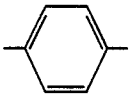 | " | 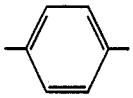 | 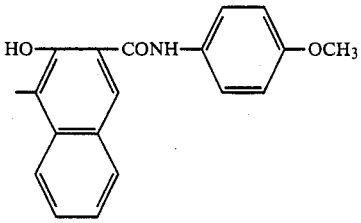 |
| VII-64 | " | " | " | 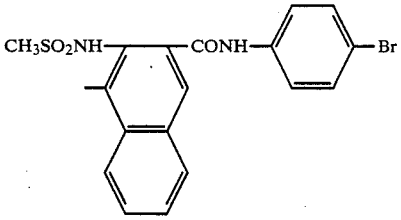 |

TABLE 3
| Comparative Example No. | Structural formula | $V_0(-V)$ | $V_1(-V)$ | $E_{\frac{1}{2}}$(lux · sec) | Initial potential $V_D(-V)$ | Initial potential $V_L(-V)$ | Potential after 10,000 sheet duration $V_D(-V)$ | Potential after 10,000 sheet duration $V_L(-V)$ |
|---|---|---|---|---|---|---|---|---|
| 2 | No additive | 700 | 690 | 1.1 | 700 | 200 | 640 | 295 |
| 3 | 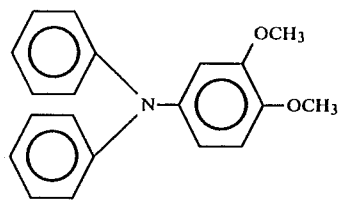 | 700 | 690 | 1.1 | 700 | 200 | 630 | 305 |
| 4 | 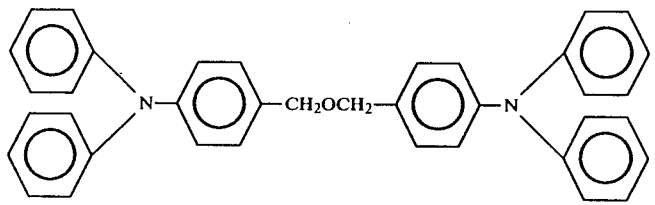 | 705 | 690 | 1.2 | 700 | 200 | 620 | 330 |
| 5 | 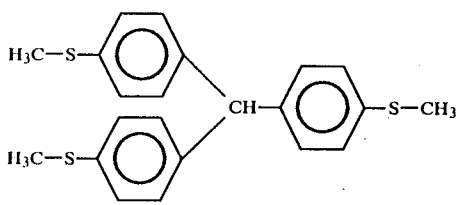 | 700 | 690 | 1.1 | 700 | 200 | 640 | 300 |
| 6 | 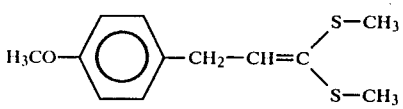 | 700 | 690 | 1.3 | 700 | 200 | 630 | 305 |
| 7 | 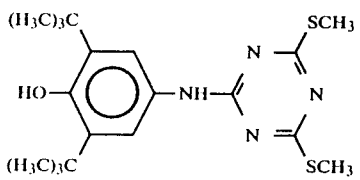 | 705 | 690 | 1.1 | 700 | 200 | 645 | 300 |

TABLE 3-continued
| Comparative Example No. | Structural formula | $V_0(-V)$ | $V_1(-V)$ | $E_{\frac{1}{2}}$(lux · sec) | Initial potential $V_D(-V)$ | Initial potential $V_L(-V)$ | Potential after 10,000 sheet duration $V_D(-V)$ | Potential after 10,000 sheet duration $V_L(-V)$ |
|---|---|---|---|---|---|---|---|---|
| 8 | 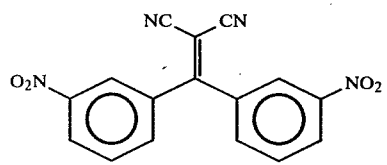 | 700 | 690 | 1.3 | 700 | 200 | 635 | 315 |
| 9 | 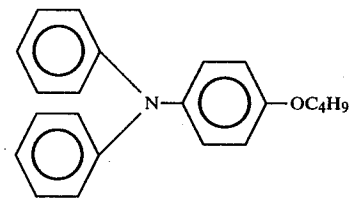 | 700 | 690 | 1.1 | 700 | 200 | 625 | 310 |
| 10 | 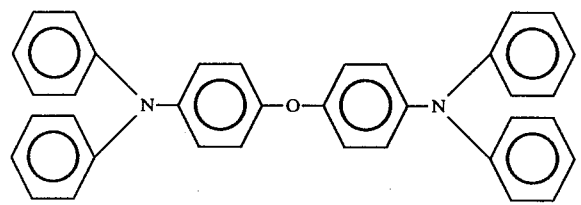 | 705 | 690 | 1.2 | 700 | 200 | 620 | 330 |
| 11 | 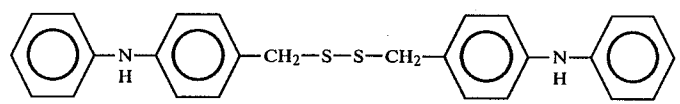 | 700 | 690 | 1.2 | 700 | 200 | 600 | 335 |
| 12 | 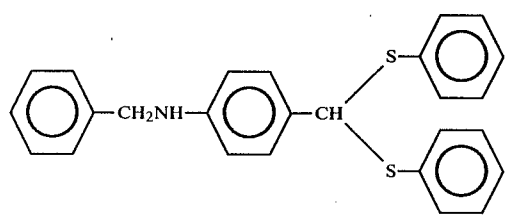 | 700 | 690 | 1.1 | 700 | 200 | 630 | 305 |

TABLE 3-continued
| Comparative Example No. | Structural formula | $V_0(-V)$ | $V_1(-V)$ | $E_{\frac{1}{2}}$(lux · sec) | Initial potential $V_D(-V)$ | Initial potential $V_L(-V)$ | Potential after 10,000 sheet duration $V_D(-V)$ | Potential after 10,000 sheet duration $V_L(-V)$ |
|---|---|---|---|---|---|---|---|---|
| 13 | 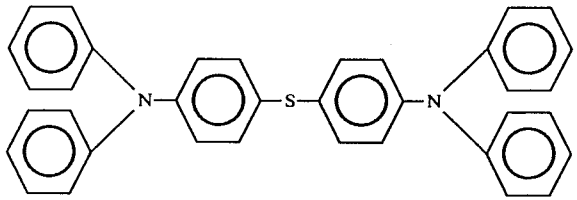 | 705 | 690 | 1.2 | 700 | 200 | 635 | 305 |
| 14 | 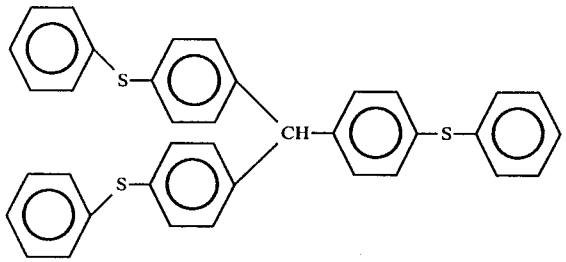 | 700 | 690 | 1.3 | 700 | 200 | 635 | 315 |
| 15 | 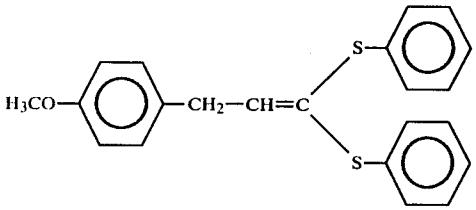 | 700 | 690 | 1.2 | 700 | 200 | 625 | 310 |
| 16 | 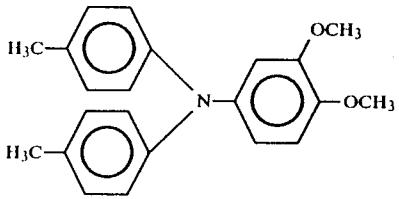 | 690 | 680 | 1.1 | 700 | 200 | 630 | 300 |

TABLE 3-continued
| Comparative Example No. | Structural formula | $V_0(-V)$ | $V_1(-V)$ | $E_{\frac{1}{2}}$(lux · sec) | Initial potential $V_D(-V)$ | Initial potential $V_L(-V)$ | Potential after 10,000 sheet duration $V_D(-V)$ | Potential after 10,000 sheet duration $V_L(-V)$ |
|---|---|---|---|---|---|---|---|---|
| 17 | 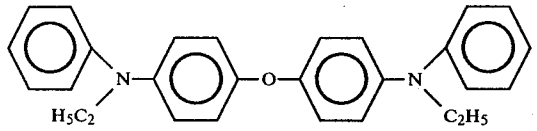 | 700 | 685 | 1.2 | 700 | 200 | 620 | 330 |
| 18 | 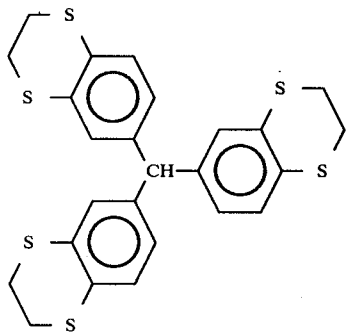 | 700 | 685 | 1.3 | 700 | 200 | 620 | 335 |
| 19 | 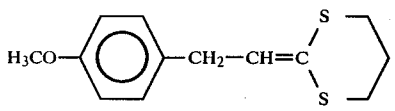 | 705 | 690 | 1.2 | 700 | 200 | 625 | 325 |
| 20 | 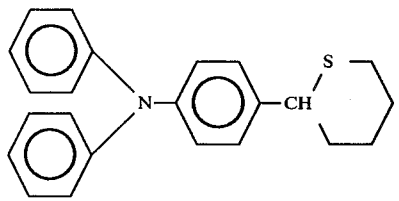 | 700 | 685 | 1.2 | 700 | 200 | 635 | 290 |
| 21 | 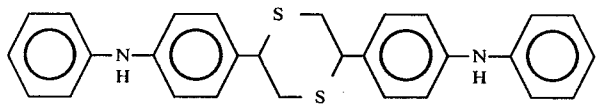 | 700 | 690 | 1.2 | 700 | 200 | 600 | 345 |

Exemplified compound group VIII
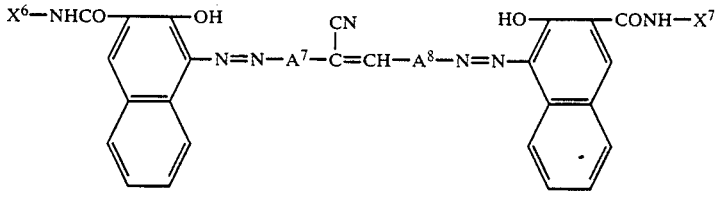
| Compound No. | $-A^7-$ | $-A^8-$ | $-X^6$, $-X^7$ |
|---|---|---|---|
| VIII-1 | 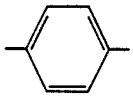 | 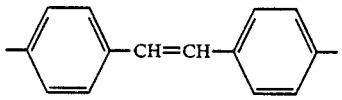 | 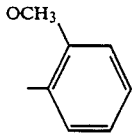 |
| VIII-2 | " | " | 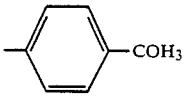 |
| VIII-3 | " | " | 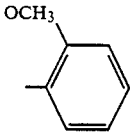 |
| VIII-4 | " | " | $-X^6$ 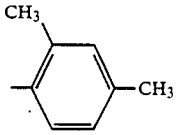 $-X^7$ 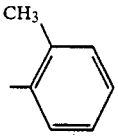 |
| VIII-5 | 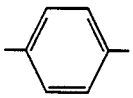 | 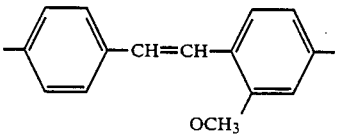 | 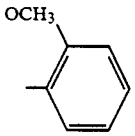 |
| VIII-6 | 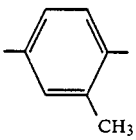 | 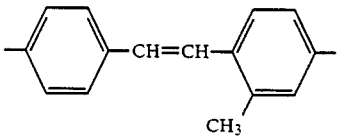 | 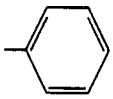 |
| VIII-7 | 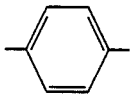 | 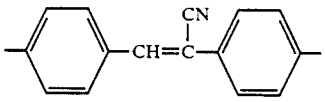 | 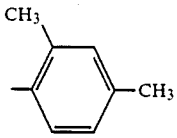 |

-continued
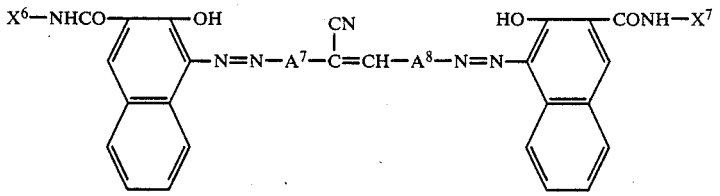
| Compound No. | —A7— | —A8— | —X6, —X7 |
|---|---|---|---|
| VIII-8 | 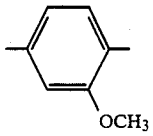 | 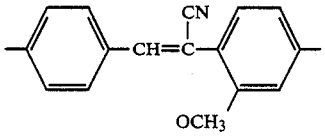 | 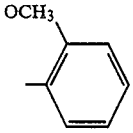 |
| VIII-9 | 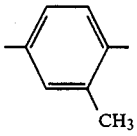 | 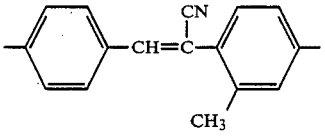 | 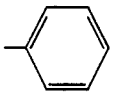 |
| VIII-10 | 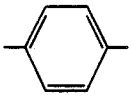 | 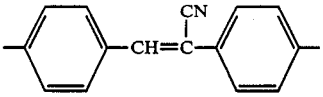 | 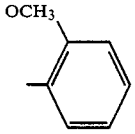 |
| VIII-11 | 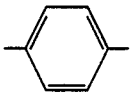 | 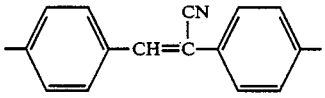 | 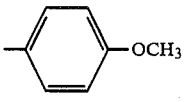 |
| VIII-12 | " | " | 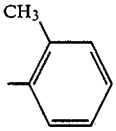 |
| VIII-13 | " | 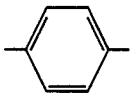 | 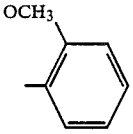 |
| VIII-14 | " | " | 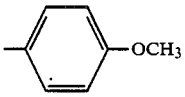 |
| VIII-15 | " | " | 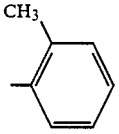 |
| VIII-16 | " | " | 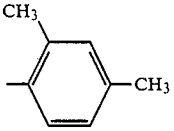 |

-continued
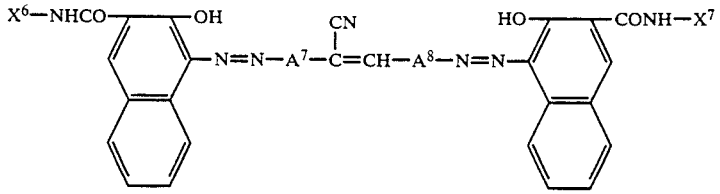
| Compound No. | —A7— | —A8— | —X6, —X7 |
|---|---|---|---|
| VIII-17 | 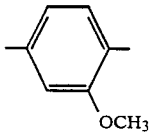 | " | 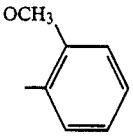 |
| VIII-18 | 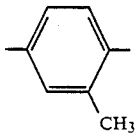 | " | 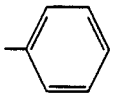 |
Exemplified compound group IX
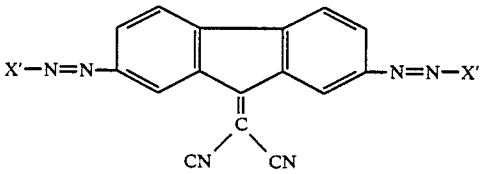
| Compound No. | —X8, —X9 |
|---|---|
| IX-1 | 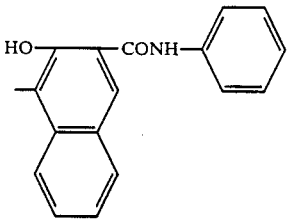 |
| IX-2 | 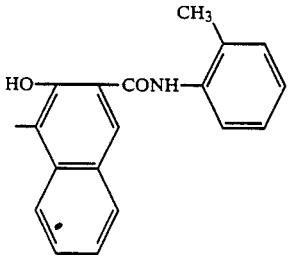 |
| IX-3 | 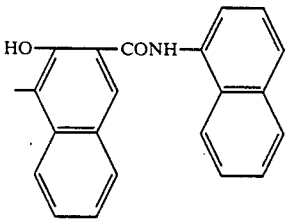 |

-continued
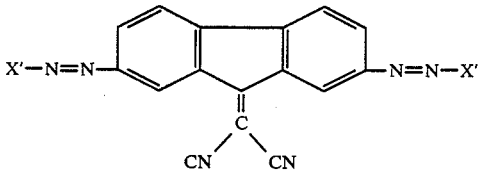
| Compound No. | $-X^8$, $-X^9$ |
|---|---|
| IX-4 | 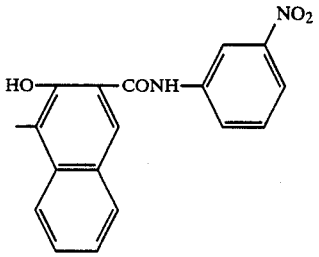 |
| IX-5 | 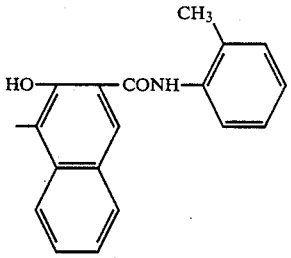 |
| IX-6 | 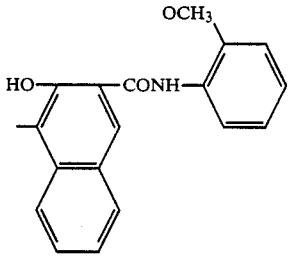 |
| IX-7 | 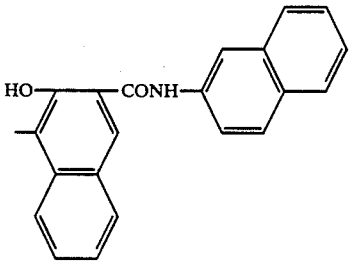 |
| IX-8 | 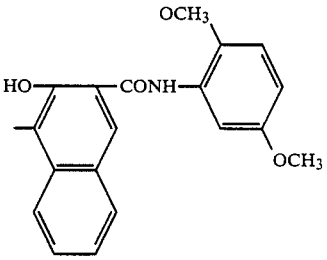 |

-continued
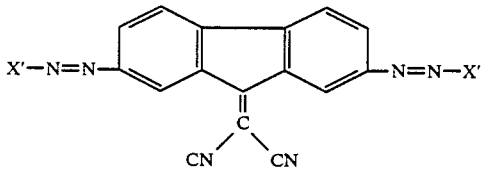
| Compound No. | $-X^8$, $-X^9$ |
|---|---|
| IX-9 | 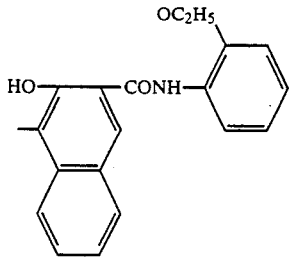 |
| IX-10 | 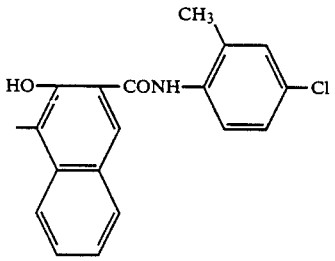 |
| IX-11 | 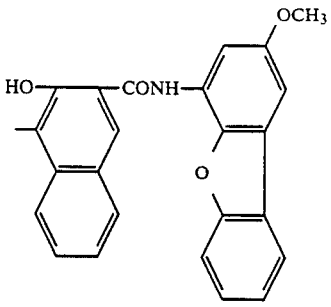 |
| IX-12 | 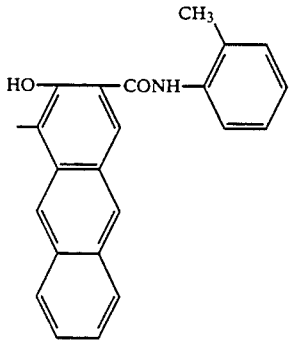 |

-continued
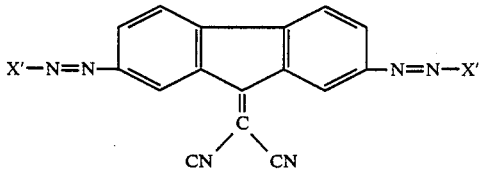
| Compound No. | $-X^8$, $-X^9$ |
|---|---|
| IX-13 | 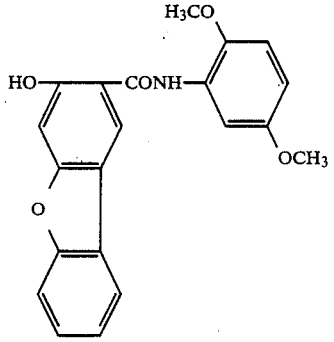 |
| IX-14 | 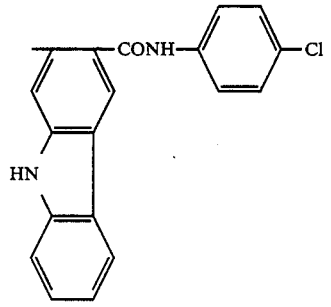 |
| IX-15 | 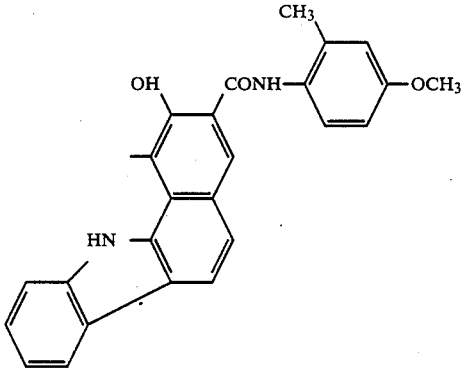 |
| IX-16 | 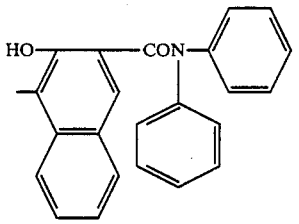 |

-continued
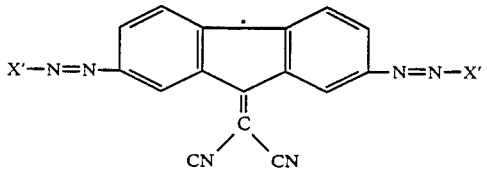
| Compound No. | $-X^8$, $-X^9$ |
|---|---|
| IX-17 | 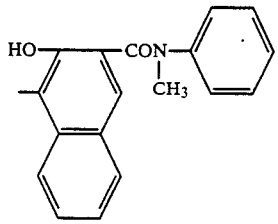 |
| IX-18 | 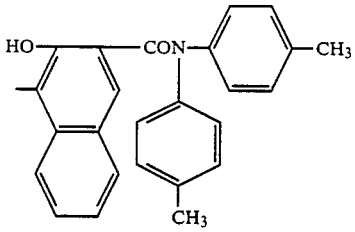 |
| IX-19 | 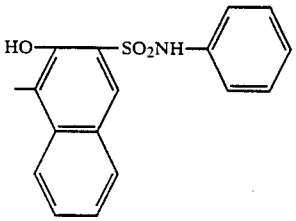 |
| IX-20 | 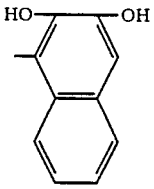 |
| IX-21 | 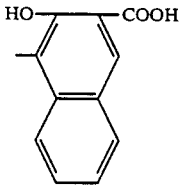 |
| IX-22 | 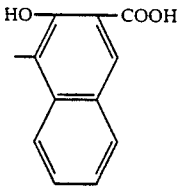 |

-continued
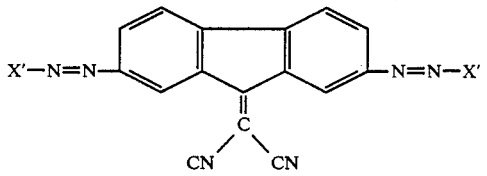
| Compound No. | $-X^8$, $-X^9$ |
|---|---|
| IX-23 | 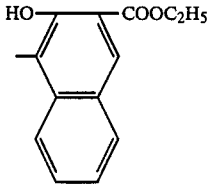 |
| IX-24 | 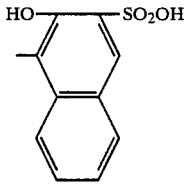 |
| IX-25 | 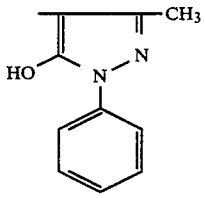 |
| IX-26 | 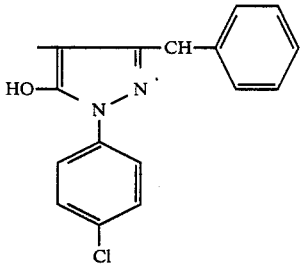 |
| IX-27 | 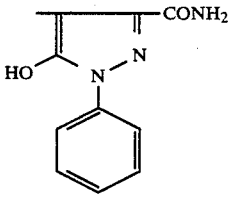 |
| IX-28 | 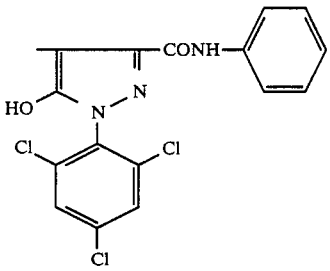 |

-continued
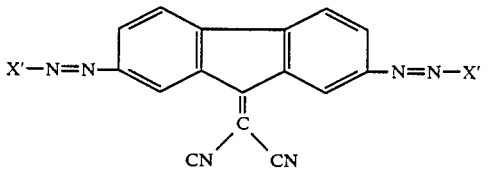
| Compound No. | $-X^8$, $-X^9$ |
|---|---|
| IX-29 | 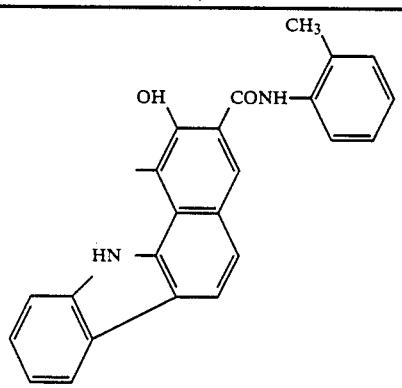 |

TABLE 7
| Comparative Example No. | Charge-transporting material | Stabilizer | $V_0$ (−V) | $V_1$ (−V) | $E_{\frac{1}{2}}$ (lux · sec) | | Initial potential (−V) | Potential after 50,000 sheet duration (−V) |
|---|---|---|---|---|---|---|---|---|
| 25 | 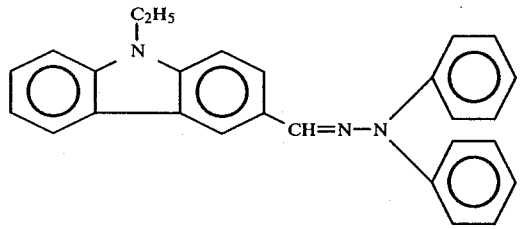 | None | 690 | 680 | 2.4 | $V_D$:<br>$V_L$: | 700<br>200 | 640<br>335 |
| 26 | 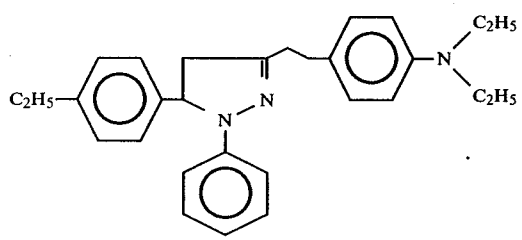 | None | 700 | 690 | 3.1 | $V_D$:<br>$V_L$: | 700<br>200 | 600<br>350 |
| 27 | 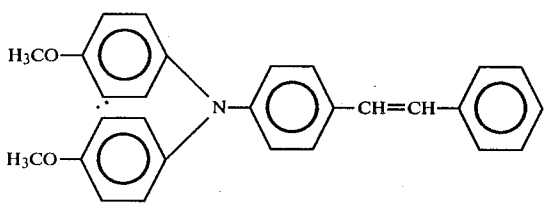 | None | 700 | 685 | 2.7 | $V_D$:<br>$V_L$: | 700<br>200 | 605<br>295 |
| 28 | 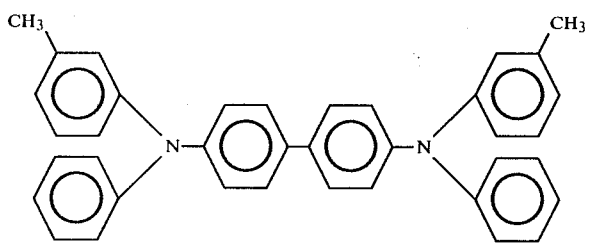 | None | 705 | 685 | 3.0 | $V_D$:<br>$V_L$: | 700<br>200 | 630<br>315 |

TABLE 7-continued
| Comparative Example No. | Charge-transporting material | Stabilizer | $V_0$ (−V) | $V_1$ (−V) | $E_{\frac{1}{2}}$ (lux · sec) | | Initial potential (−V) | Potential after 50,000 sheet duration (−V) |
|---|---|---|---|---|---|---|---|---|
| 29 | 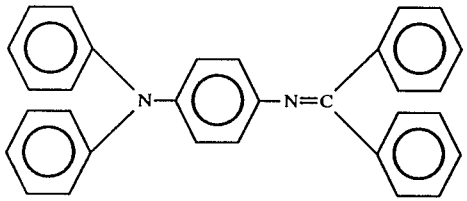 | None | 700 | 690 | 2.7 | $V_D$:<br>$V_L$: | 700<br>200 | 610<br>330 |
| 30 | 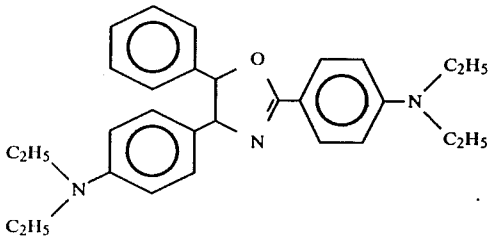 | None | 705 | 695 | 2.3 | $V_D$:<br>$V_L$: | 700<br>200 | 630<br>320 |
| 31 | 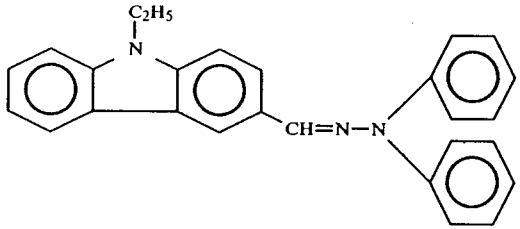 | 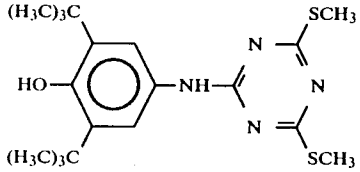 | 690 | 680 | 2.4 | $V_D$:<br>$V_L$: | 700<br>200 | 650<br>315 |
| 32 | " | 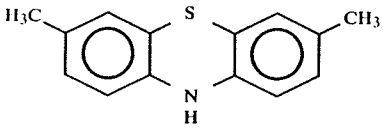 | 695 | 680 | 2.5 | $V_D$:<br>$V_L$: | 700<br>200 | 640<br>325 |

TABLE 7-continued
| Comparative Example No. | Charge-transporting material | Stabilizer | $V_0$ (−V) | $V_1$ (−V) | $E_{\frac{1}{2}}$ (lux · sec) | | Initial potential (−V) | Potential after 50,000 sheet duration (−V) |
|---|---|---|---|---|---|---|---|---|
| 33 | " | 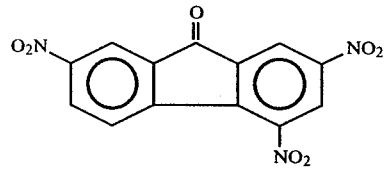 | 700 | 690 | 2.4 | $V_D$:<br>$V_L$: | 700<br>200 | 620<br>330 |
| 34 | " | 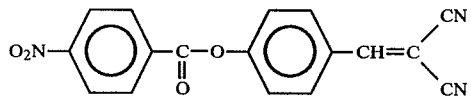 | 700 | 690 | 2.4 | $V_D$:<br>$V_L$: | 700<br>200 | 650<br>315 |

The compounds categorized into Exemplified compound group IX are described in Japanese Patent O.P.I. Publication No. 58-194035/1983.

The following compounds containing polycyclic quinone pigments, which are categorized into Exemplified compound groups X through XII, may most preferably be used.

Exemplified compound group X

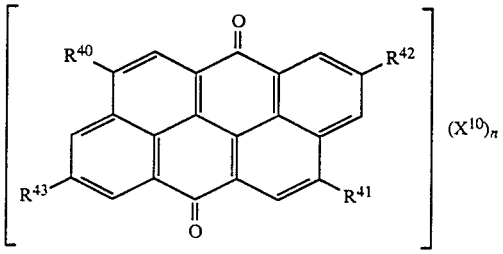

| Compound No. | $R^{40}$ | $R^{41}$ | $R^{42}$ | $R^{43}$ | $X^{10}$ | n |
|---|---|---|---|---|---|---|
| X-1 | — | — | — | — | — | 0 |
| X-2 | Cl | Cl | — | — | — | 0 |
| X-3 | Br | Br | — | — | — | 0 |
| X-4 | — | — | Br | Br | — | 0 |
| X-5 | Br | Br | Br | Br | — | 0 |
| X-6 | — | — | — | — | I | 2 |
| X-7 | — | — | — | — | " | 3 |
| X-8 | — | — | — | — | " | 4 |
| X-9 | — | — | — | — | $NO_2$ | 2 |
| X-10 | — | — | — | — | CN | 2 |
| X-11 | — | — | — | — | $COCH_3$ | 2 |

Exemplified compound group XI

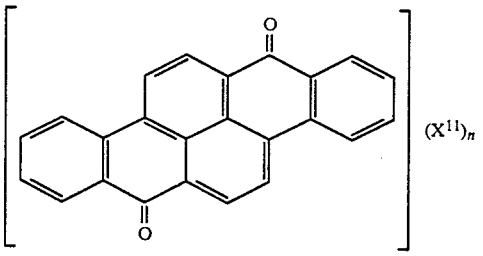

| Compound No. | $X^{11}$ | m |
|---|---|---|
| XI-1 | — | 0 |
| XI-2 | Cl | 2 |
| XI-3 | Br | 2 |
| XI-4 | I | 2 |
| XI-5 | I | 3 |
| XI-6 | I | 4 |
| XI-7 | $NO_2$ | 2 |
| XI-8 | CN | 2 |
| XI-9 | $COC_6H_5$ | 2 |

Exemplified compound group XII

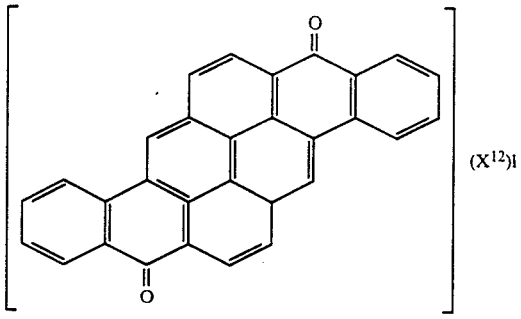

| Compound No. | $X^{12}$ | l |
|---|---|---|
| XII-1 | — | 0 |
| XII-2 | Cl | 2 |
| XII-3 | Br | 2 |
| XII-4 | " | 3 |
| XII-5 | " | 4 |
| XII-6 | I | 4 |
| XII-7 | $NO_2$ | 3 |
| XII-8 | CN | 4 |
| XII-9 | $COCH_3$ | 4 |

Next, there is no special limitation to CTM applicable to the invention. However, they may be one or not less than two kinds of the compounds selected from the group of the compounds including, for example, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzthiazole derivatives, benzimidazole derivatives, quinazoline derivatives, benzofuran derivatives, acridine derivatives, phenazine derivatives, aminostilbene derivatives, poly-N-vinyl carbazole, poly-1-vinyl pyrene, poly-9-vinyl anthracene and so forth. CGL and CTL are also allowed to use different CTMs from each other.

The preferably applicable CTMs are those excellent in the capability of transportation of a hole produced when irradiating light toward the support side and suitable for the combination thereof with the above-mentioned CGM. Such CTMs include, for example, the compounds represented by the following formulas XIII and XIV.

Exemplified compound group XIII

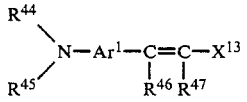
| Compound No. | $-R^{44}$ | $-R^{45}$ | $-R^{46}$ | $-R^{47}$ | $-Ar^1-$ | $-X^{13}$ |
|---|---|---|---|---|---|---|
| XIII-1 | 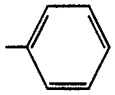 | 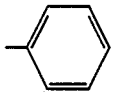 | $-H$ | 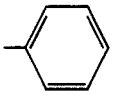 | 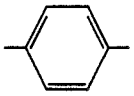 | 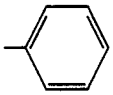 |
| XIII-2 | 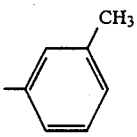 | " | " | " | " | 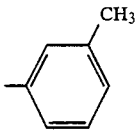 |
| XIII-3 | 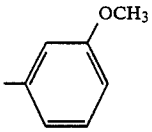 | " | " | " | " | 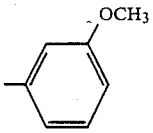 |
| XIII-4 | $-CH_3$ | $-CH_3$ | " | $-H$ | " | 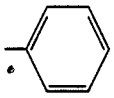 |
| XIII-5 | $-C_2H_5$ | $-C_2H_5$ | " | " | " | " |
| XIII-6 | " | " | " | " | " | 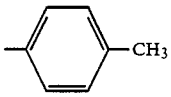 |
| XIII-7 | " | " | " | " | " | 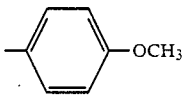 |
| XIII-8 | 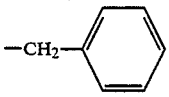 | 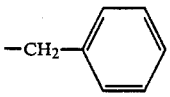 | " | " | " | 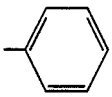 |
| XIII-9 | 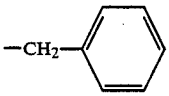 | 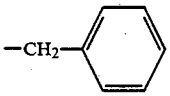 | $-H$ | 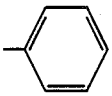 | 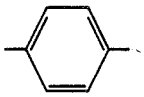 | 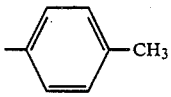 |
| XIII-10 | " | " | " | " | " | 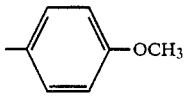 |
| XIII-11 | " | " | $-H$ | $-H$ | 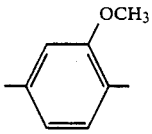 | 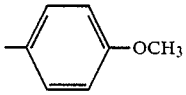 |
| XIII-12 | $-C_2H_5$ | " | " | " | 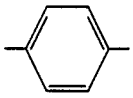 | " |

-continued
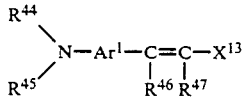
| Compound No. | $-R^{44}$ | $-R^{45}$ | $-R^{46}$ | $-R^{47}$ | $-Ar^1-$ | $-X^{13}$ |
|---|---|---|---|---|---|---|
| XIII-13 | 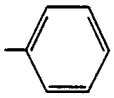 | 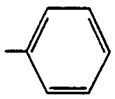 | " | " | " | 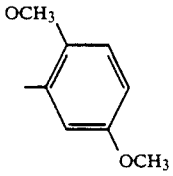 |
| XIII-14 | " | " | " | " | " | 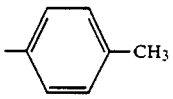 |
| XIII-15 | " | " | " | " | " | 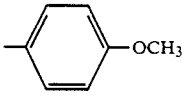 |
| XIII-16 | " | " | " | " | " | 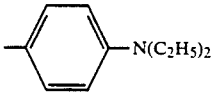 |
| XIII-17 | " | " | " | " | " | 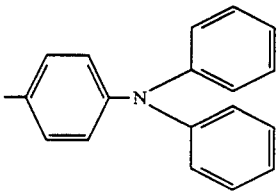 |
| XIII-18 | 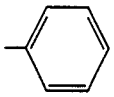 | 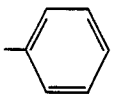 | —H | —H | 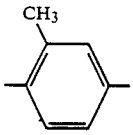 | 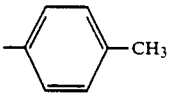 |
| XIII-19 | 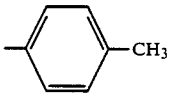 | 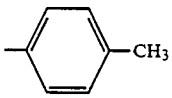 | —H | —H | 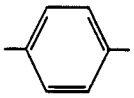 | 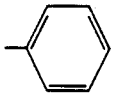 |
| XIII-20 | " | " | " | " | " | 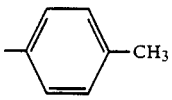 |
| XIII-21 | " | " | —H | —H | 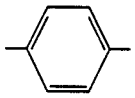 | 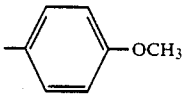 |
| XIII-22 | " | " | " | " | 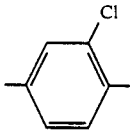 | 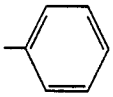 |

-continued
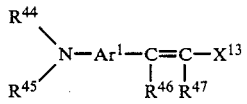
| Compound No. | $-R^{44}$ | $-R^{45}$ | $-R^{46}$ | $-R^{47}$ | $-Ar^1-$ | $-X^{13}$ |
|---|---|---|---|---|---|---|
| XIII-23 | " | " | " | " | $(C_2H_5)_2N$ | $CH_3$ |
| XIII-24 | $OCH_3$ | $OCH_3$ | " | " | | |
| XIII-25 | " | " | " | " | " | $CH_3$ |
| XIII-26 | " | " | " | " | " | $OCH_3$ |
| XIII-27 | $OCH_3$ | $OCH_3$ | $-H$ | $-H$ | $CH_3O$ | |
| XIII-28 | $-C_2H_5$ | $-C_2H_5$ | " | " | | |
| XIII-29 | $-CH_2-$ | $-CH_2-$ | " | " | | " |
| XIII-30 | " | " | " | " | $OCH_3$ | " |
| XIII-31 | | | " | " | | N, $C_2H_5$ |

-continued
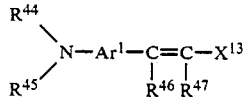
| Compound No. | $-R^{44}$ | $-R^{45}$ | $-R^{46}$ | $-R^{47}$ | $-Ar^1-$ | $-X^{13}$ |
|---|---|---|---|---|---|---|
| XIII-32 | " | " | " | " | " | 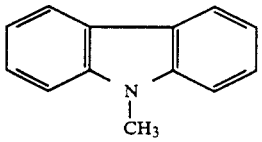 |
| XIII-33 | 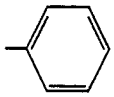 | 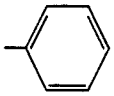 | " | " | " | 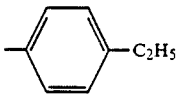 |
| XIII-34 | 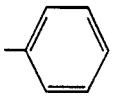 | 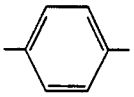 | —H | —H | 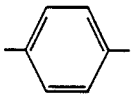 | 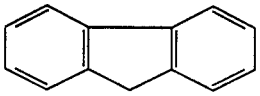 |
| XIII-35 | 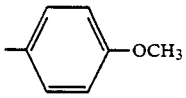 | " | " | " | " | 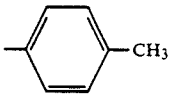 |
| XIII-36 | " | " | " | " | " | 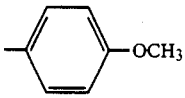 |
| XIII-37 | 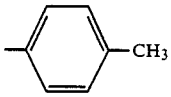 | " | " | " | " | " |
| XIII-38 | 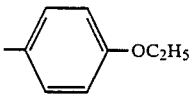 | " | " | " | " | 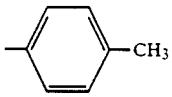 |
| XIII-39 | 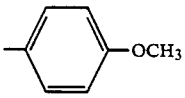 | " | " | " | " | 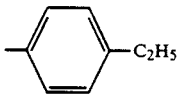 |
| XIII-40 | " | " | " | " | " | 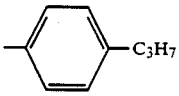 |
| XIII-41 | " | " | " | " | " | 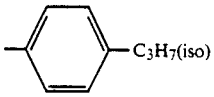 |
| XIII-42 | 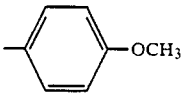 | 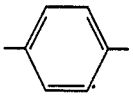 | —H | —H | 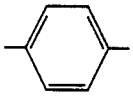 | 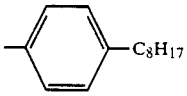 |
| XIII-43 | " | " | " | " | " | 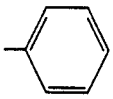 |

-continued
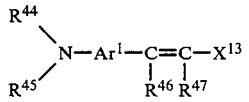
| Compound No. | $-R^{44}$ | $-R^{45}$ | $-R^{46}$ | $-R^{47}$ | $-Ar^1-$ | $-X^{13}$ |
|---|---|---|---|---|---|---|
| XIII-44 | " | " | " | " | " | 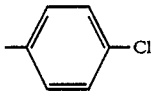 |
| XIII-45 | " | " | " | " | " | 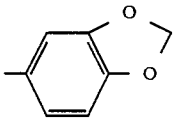 |
| XIII-46 | " | " | " | " | " | 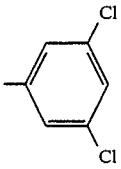 |
| XIII-47 | " | " | " | " | " | 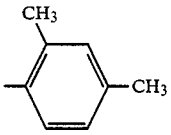 |
| XIII-48 | " | " | " | " | " | 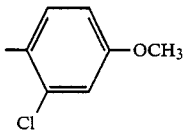 |
| XIII-49 | 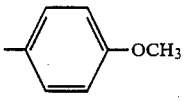 | 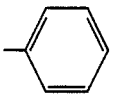 | $-H$ | $-H$ | 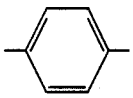 | 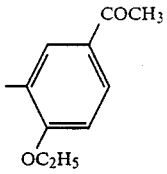 |
| XIII-50 | " | " | " | " | " | 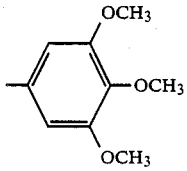 |
| XIII-51 | " | " | " | " | " | 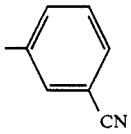 |
| XIII-52 | " | " | " | " | " | 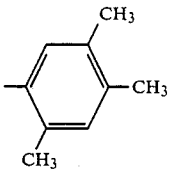 |

-continued
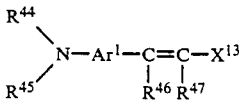
| Compound No. | $-R^{44}$ | $-R^{45}$ | $-R^{46}$ | $-R^{47}$ | $-Ar^1-$ | $-X^{13}$ |
|---|---|---|---|---|---|---|
| XIII-53 | " | " | " | " | " | 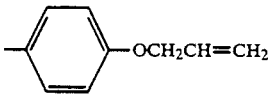 |
| XIII-54 | 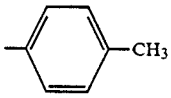 | " | " | " | " | 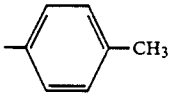 |
| XIII-55 | " | " | " | " | " | 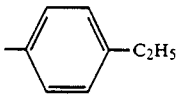 |
| XIII-56 | " | " | " | " | " | 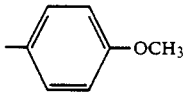 |
| XIII-57 | 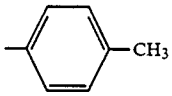 | 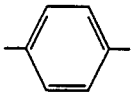 | —H | —H | 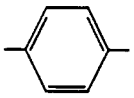 | 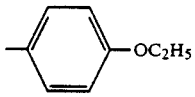 |
| XIII-58 | " | " | " | " | " | 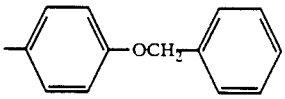 |
| XIII-59 | " | " | " | " | " | 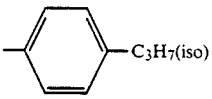 |
| XIII-60 | " | " | " | " | " | 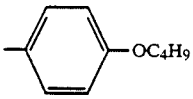 |
| XIII-61 | " | " | " | " | " | 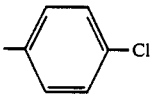 |
| XIII-62 | " | " | " | " | " | 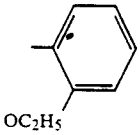 |
| XIII-63 | " | " | " | " | " | 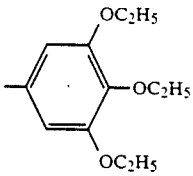 |

-continued
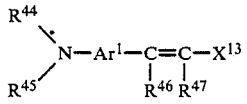
| Compound No. | $-R^{44}$ | $-R^{45}$ | $-R^{46}$ | $-R^{47}$ | $-Ar^1-$ | $-X^{13}$ |
|---|---|---|---|---|---|---|
| XIII-64 | " | " | " | " | " | 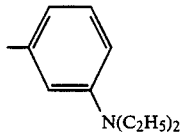 |
| XIII-65 | " | " | " | " | " | 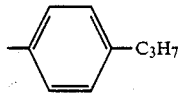 |
| XIII-66 | 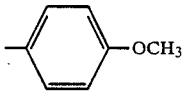 | 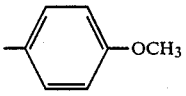 | $-H$ | $-H$ | 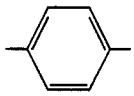 | 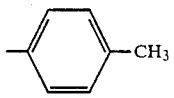 |
| XIII-67 | " | 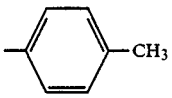 | " | " | " | 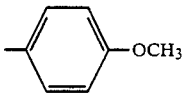 |
| XIII-68 | " | " | " | " | " | 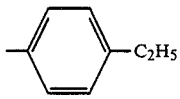 |
| XIII-69 | " | " | " | " | " | 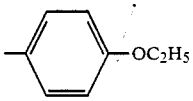 |
| XIII-70 | " | " | " | " | " | 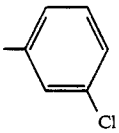 |
| XIII-71 | " | " | " | " | " | 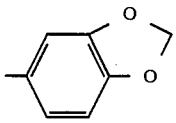 |
| XIII-72 | " | " | " | " | 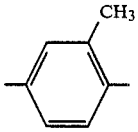 | 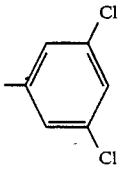 |
| XIII-73 | " | " | " | " | 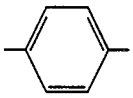 | 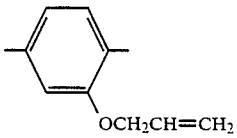 |

-continued
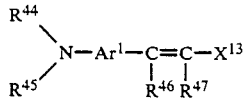
| Compound No. | $-R^{44}$ | $-R^{45}$ | $-R^{46}$ | $-R^{47}$ | $-Ar^1-$ | $-X^{13}$ |
|---|---|---|---|---|---|---|
| XIII-74 | " | | " | " | " | |
| XIII-75 | | | $-H$ | $-H$ | | |
| XIII-76 | | | " | " | " | " |
| XIII-77 | | | " | " | " | |
| XIII-78 | | " | $-CH_3$ | " | " | |
| XIII-79 | | | " | $-H$ | | |
| XIII-80 | | | $-H$ | $-CH_3$ | " | |
| XIII-81 | | | " | " | " | " |
Exemplified compound group XIV

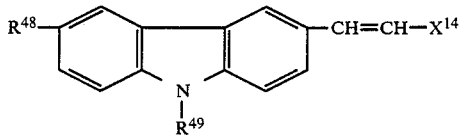
| Compound No. | —R48 | —R49 | —X14 |
|---|---|---|---|
| XIV-1 | —H | 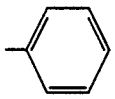 | 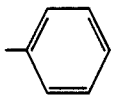 |
| XIV-2 | " | " | 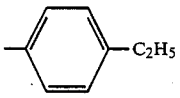  |
| XIV-3 | " | " | 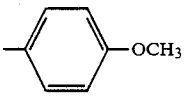  |
| XIV-4 | " | " | 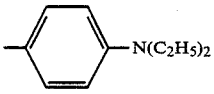  |
| XIV-5 | " | " | 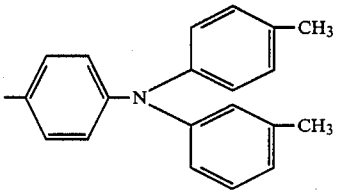  |
| XIV-6 | " | 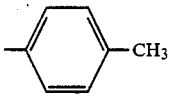  | 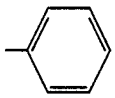 |
| XIV-7 | " | " | 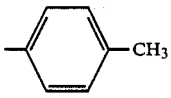  |
| XIV-8 | —H | 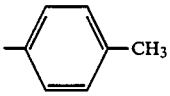  | 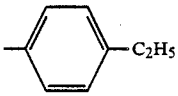  |
| XIV-9 | " | " | 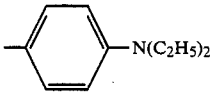  |
| XIV-10 | " | " | 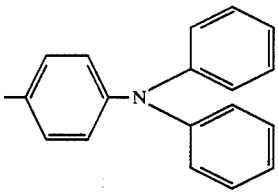  |

-continued
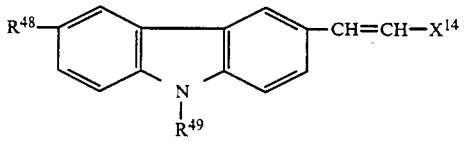
| Compound No. | —R48 | —R49 | —X14 |
|---|---|---|---|
| XIV-11 | " | 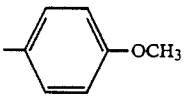  | 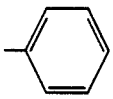 |
| XIV-12 | " | " | 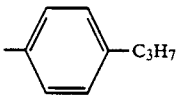  |
| XIV-13 | " | 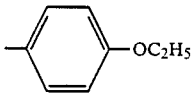  | 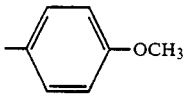  |
| XIV-14 | " | 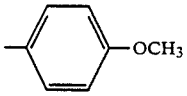  | 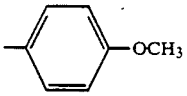  |
| XIV-15 | " | " | 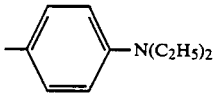  |
| XIV-16 | —H | 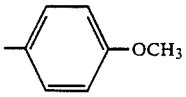  | 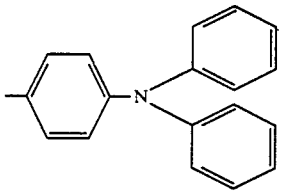  |
| XIV-17 | " | 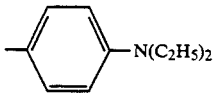  | 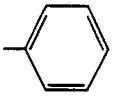 |
| XIV-18 | " | " | 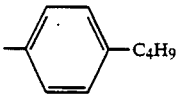  |
| XIV-19 | " | 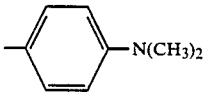  | 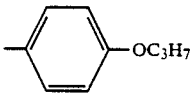  |
| XIV-20 | " | 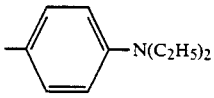  | 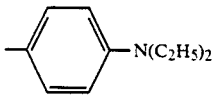  |
| XIV-21 | " | 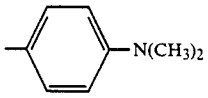  | 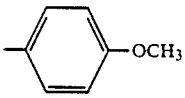  |

-continued
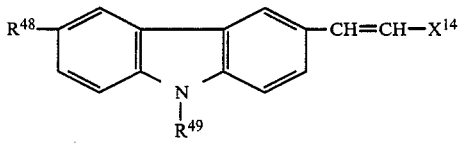
| Compound No. | —R48 | —R49 | —X14 |
|---|---|---|---|
| XIV-22 | —Cl | 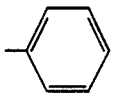 | 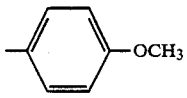  |
| XIV-23 | —OCH3 | 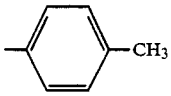  | 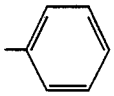 |
| XIV-24 | —OH | 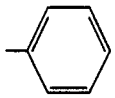 | 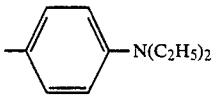  |
| XIV-25 | —N(C2H5)2 | 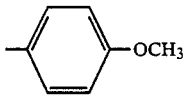  | 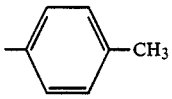  |
| XIV-26 | —H | 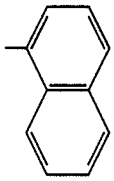 | 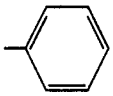 |
| XIV-27 | " | 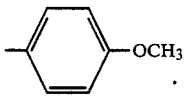  | 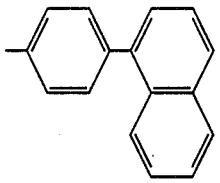 |
| XIV-28 | " | 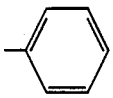 | 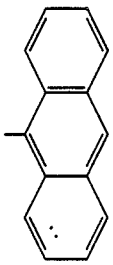 |
| XIV-29 | " | " | 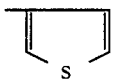  |

-continued
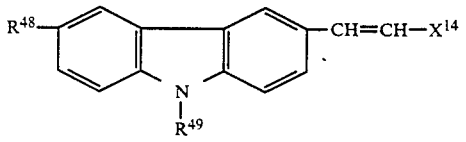
| Compound No. | $-R^{48}$ | $-R^{49}$ | $-X^{14}$ |
|---|---|---|---|
| XIV-30 | " | 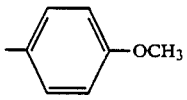 | 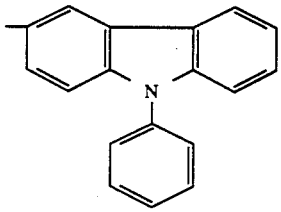 |
| XIV-31 | $-OCH_3$ | 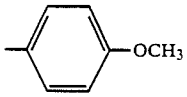 | 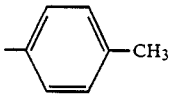 |
| XIV-32 | " | " | 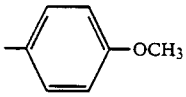 |
| XIV-33 | " | " | 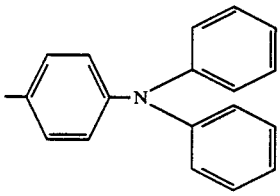 |
As for CTMs, it is also allowed to use the hydrazone compounds categorized into the following exemplified compound groups XV through XIX:
Exemplified compound group XV
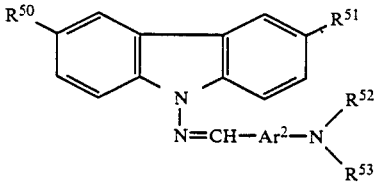
| Compound No. | $-R^{50}$ | $-R^{51}$ | $-R^{52}$ | $-R^{53}$ | $-Ar^2-$ |
|---|---|---|---|---|---|
| XV-1 | $-H$ | $-H$ | 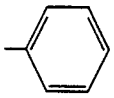 | 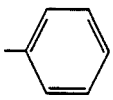 | 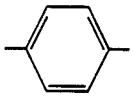 |
| XV-2 | " | " | 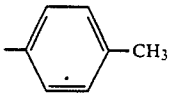 | 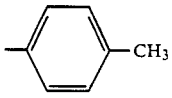 | " |
| XV-3 | " | " | " | 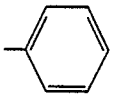 | " |

-continued
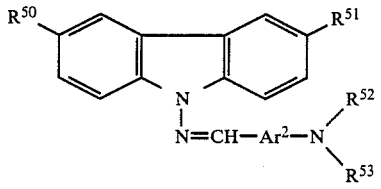
| Compound No. | —R50 | —R51 | —R52 | —R53 | —Ar2— |
|---|---|---|---|---|---|
| XV-4 | " | " | 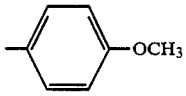 | " | " |
| XV-5 | " | " | " | 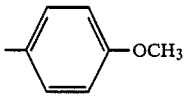 | " |
| XV-6 | " | —Cl | 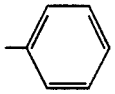 | 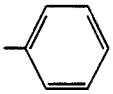 | " |
| XV-7 | " | " | 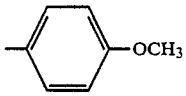 | 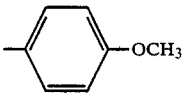 | " |
| XV-8 | " | " | 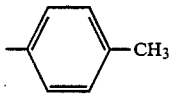 | 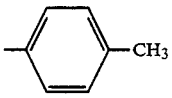 | " |
| XV-9 | —H | —H | 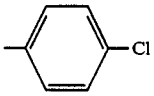 | 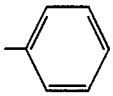 | 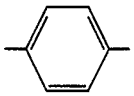 |
| XV-10 | " | " | 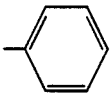 | " | 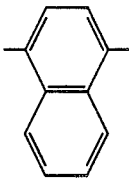 |
| XV-11 | " | " | 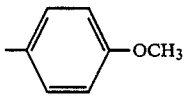 | 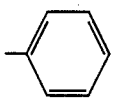 | 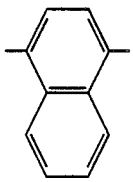 |
| XV-12 | " | " | 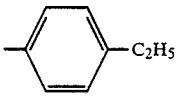 | " | 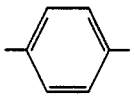 |
| XV-13 | " | " | 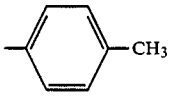 | 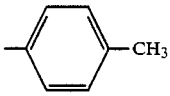 | " |

-continued

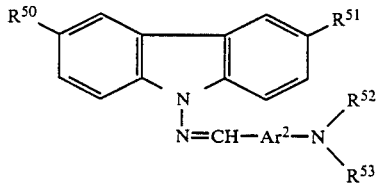

| Compound No. | $-R^{50}$ | $-R^{51}$ | $-R^{52}$ | $-R^{53}$ | $-Ar^2-$ |
|---|---|---|---|---|---|
| XV-14 | " | $-Cl$ | | | |

Exemplified compound group XVI

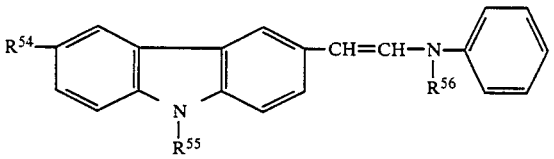

| Compound No. | $-R^{54}$ | $-R^{55}$ | $-R^{56}$ |
|---|---|---|---|
| XVI-1 | $-H$ | $-CH_3$ | $-CH_3$ |
| XVI-2 | " | " | $-C_2H_5$ |
| XVI-3 | " | " | |
| XVI-4 | " | " | |
| XVI-5 | " | $-C_2H_5$ | $-CH_3$ |
| XIV-6 | " | " | $-C_2H_5$ |

-continued

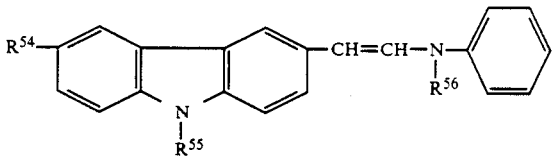

| Compound No. | $-R^{54}$ | $-R^{55}$ | $-R^{56}$ |
|---|---|---|---|
| XVI-7 | " | " | |
| XVI-8 | " | " | |
| XVI-9 | " | $-CH_2CH_2OH$ | $-CH_3$ |
| XVI-10 | " | " | $-C_2H_5$ |
| XVI-11 | " | " | |
| XVI-12 | $-Cl$ | " | " |

Exemplified compound group XVII

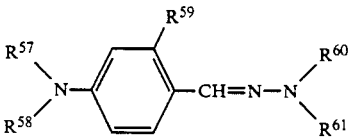

| Compound No. | $-R^{57}$ | $-R^{58}$ | $-R^{59}$ | $-R^{60}$ | $-R^{61}$ |
|---|---|---|---|---|---|
| XVII-1 | $-C_2H_5$ | $-C_2H_5$ | $-H$ | | |

-continued
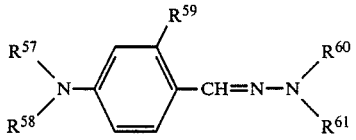
| Compound No. | $-R^{57}$ | $-R^{58}$ | $-R^{59}$ | $-R^{60}$ | $-R^{61}$ |
|---|---|---|---|---|---|
| XVII-2 | " | " | " | 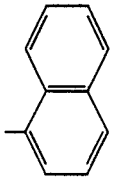 | " |
| XVII-3 | " | " | " | " | 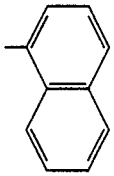 |
| XVII-4 | " | " | " | 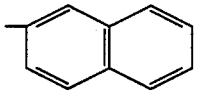 | 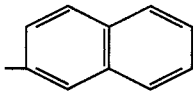 |
| XVII-5 | " | " | " | " | 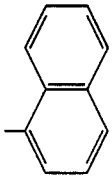 |
| XVII-6 | $-C_3H_7$ | $-C_3H_7$ | " | 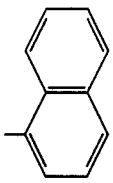 | 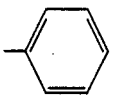 |
| XVII-7 | $-C_4H_9$ | $-C_4H_9$ | $-H$ | 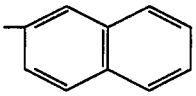 | 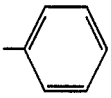 |
| XVII-8 | 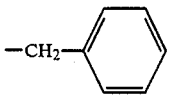 | 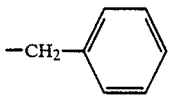 | " | 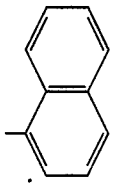 | " |
| XVII-9 | 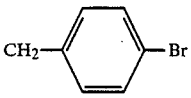 | 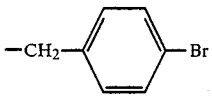 | $-H$ | 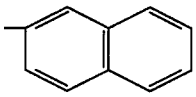 | 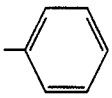 |

-continued
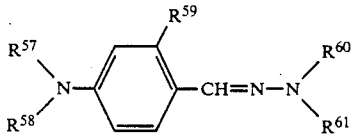
| Compound No. | $-R^{57}$ | $-R^{58}$ | $-R^{59}$ | $-R^{60}$ | $-R^{61}$ |
|---|---|---|---|---|---|
| XVII-10 | 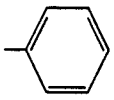 | 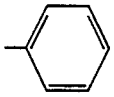 | $-H$ | 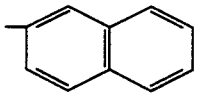 | " |
| XVII-11 | $-C_2H_5$ | $-(CH_2)_2N(CH_3)_2$ | " | " | 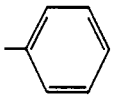 |
| XVII-12 | " | $-CH_2CH_2OCH_3$ | " | " | " |
| XVII-13 | " | $-C_2H_5$ | $-CH_3$ | 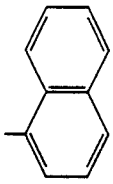 | " |
| XVII-14 | " | " | $-OCH_3$ | " | " |
| XVII-15 | " | " | $-OC_4H_9$ | " | " |
| XVII-16 | 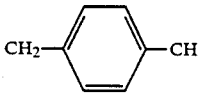 | 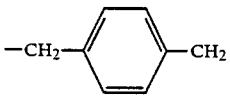 | $-H$ | " | " |
| XVII-17 | $-C_2H_5$ | $-C_2H_5$ | $-H$ | 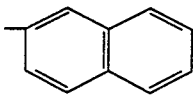 | 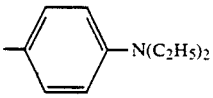 |
| XVII-18 | " | " | " | " | 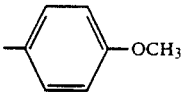 |
| XVII-19 | " | $-CH_2CH_2Cl$ | " | 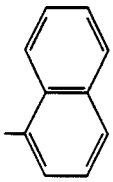 | 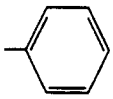 |
| XVII-20 | " | $-C_2H_5$ | | 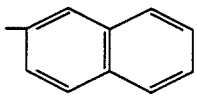 | 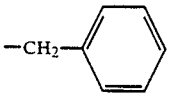 |
| XVII-21 | " | " | " | " | $-C_2H_5$ |
| XVII-22 | $-C_3H_7$ | $-C_3H_7$ | | 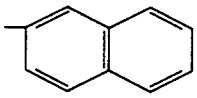 | 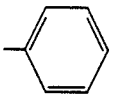 |
Exemplified compound group XVIII

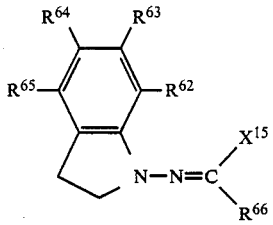
| Compound No. | $-R^{62}$ | $-R^{63}$ | $-R^{64}$ | $-R^{65}$ | $-R^{66}$ | $-X^{15}$ |
|---|---|---|---|---|---|---|
| XVIII-1 | —H | —H | —H | —H | —H | 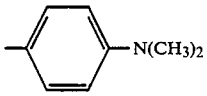 |
| XVIII-2 | " | " | " | " | " | 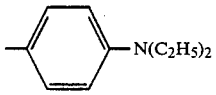 |
| XVIII-3 | " | " | " | " | " | 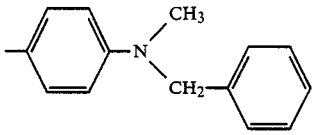 |
| XVIII-4 | " | " | $-CH_3$ | " | " | 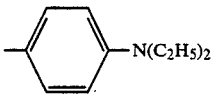 |
| XVIII-5 | " | " | —H | " | " | 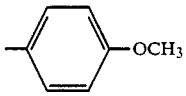 |
| XVIII-6 | " | " | $-OCH_3$ | " | " | 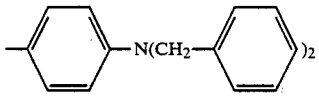 |
| XVIII-7 | " | " | —H | " | " | 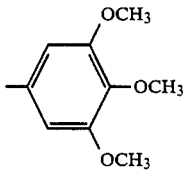 |
| XVIII-8 | " | " | " | " | " | 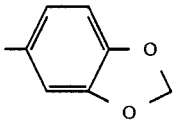 |
| XVIII-9 | " | " | " | " | " | 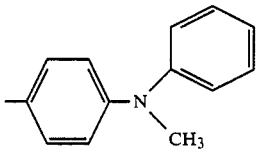 |

-continued
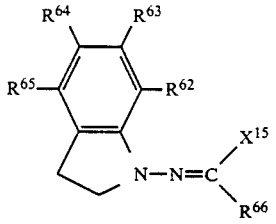
| Compound No. | $-R^{62}$ | $-R^{63}$ | $-R^{64}$ | $-R^{65}$ | $-R^{66}$ | $-X^{15}$ |
|---|---|---|---|---|---|---|
| XVIII-10 | " | " | " | " | " | 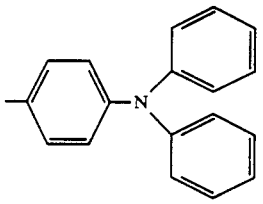 |
| XVIII-11 | " | $-CH_3$ | " | " | " | " |
| XVIII-12 | " | $-H$ | " | " | " | 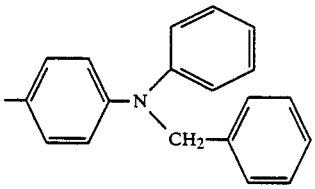 |
| XVIII-13 | " | " | " | " | " | 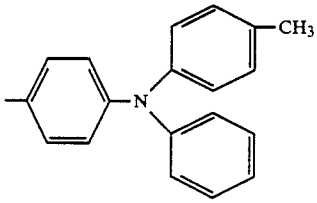 |
| XVIII-14 | " | " | " | " | " | 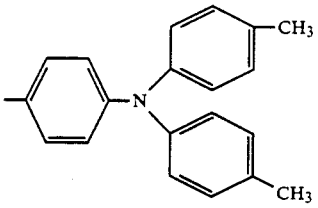 |
| XVIII-15 | " | " | " | " | " | 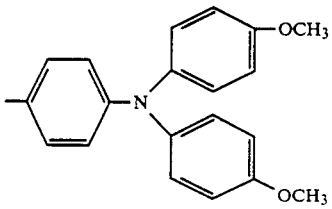 |
| XVIII-16 | " | $-OCH_3$ | " | " | " | 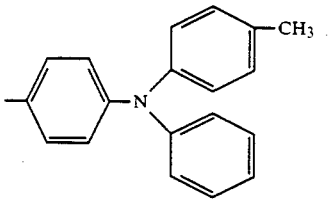 |

-continued
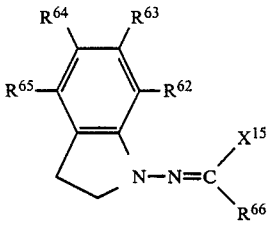
| Compound No. | $-R^{62}$ | $-R^{63}$ | $-R^{64}$ | $-R^{65}$ | $-R^{66}$ | $-X^{15}$ |
|---|---|---|---|---|---|---|
| XVIII-17 | " | —H | " | —Cl | " | 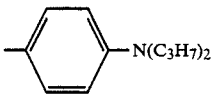 |
| XVIII-18 | $C_2H_5$ | " | " | —H | $-CH_3$ | 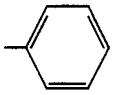 |
| XVIII-19 | —H | " | " | " | 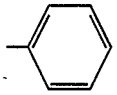 | 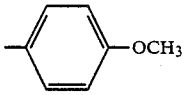 |
| XVIII-20 | " | " | " | " | $-C_2H_5$ | 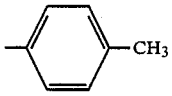 |
| XVIII-21 | " | " | " | " | 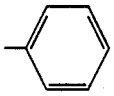 | 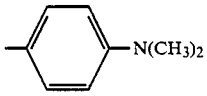 |
| XVIII-22 | " | " | " | " | $-CH_3$ | 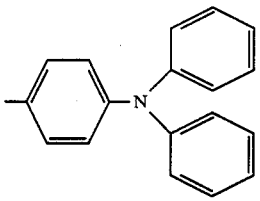 |
| XVIII-23 | " | " | " | " | —H | 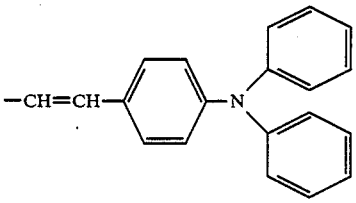 |
| XVIII-24 | " | " | " | " | " | 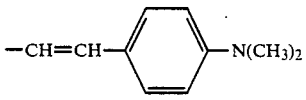 |
| XVIII-25 | " | " | " | " | " | 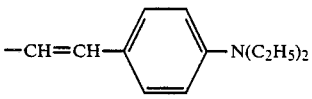 |

-continued
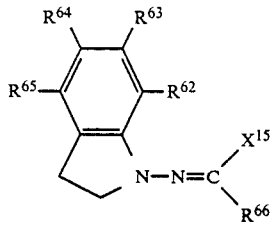
| Compound No. | $-R^{62}$ | $-R^{63}$ | $-R^{64}$ | $-R^{65}$ | $-R^{66}$ | $-X^{15}$ |
|---|---|---|---|---|---|---|
| XVIII-26 | " | " | " | " | " | 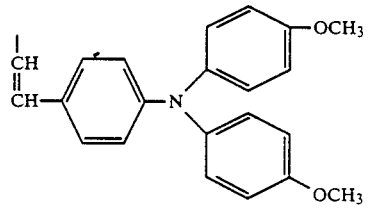 |
| XVIII-27 | " | " | " | " | " | 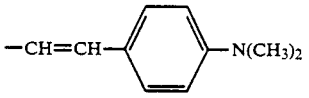 |
| XVIII-28 | " | " | " | " | " | 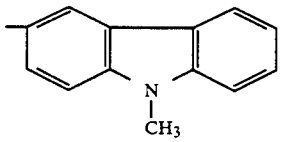 |
| XVIII-29 | " | " | " | " | " | 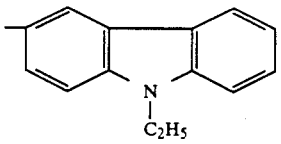 |
| XVIII-30 | " | " | " | " | " | 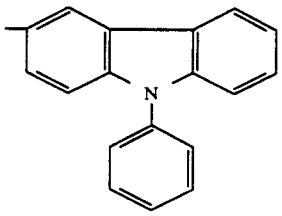 |
| XVIII-31 | " | " | " | " | " | 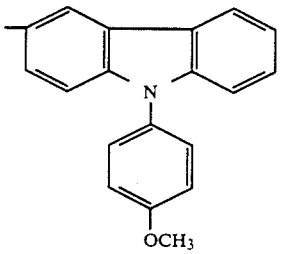 |

-continued
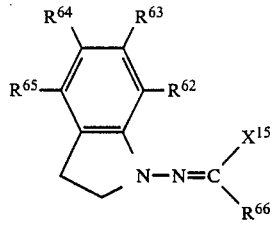
| Compound No. | $-R^{62}$ | $-R^{63}$ | $-R^{64}$ | $-R^{65}$ | $-R^{66}$ | $-X^{15}$ |
|---|---|---|---|---|---|---|
| XVIII-32 | " | " | " | " | " | 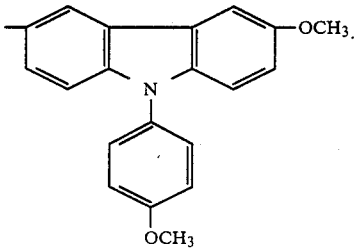 |
| XVIII-33 | " | " | $-CH_3$ | " | " | 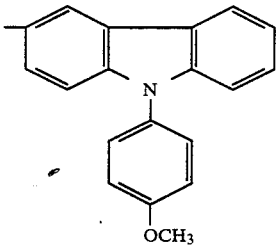 |
| XVIII-34 | " | " | " | " | " | 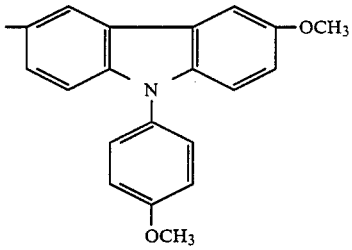 |
| XVIII-35 | " | " | —H | " | " | 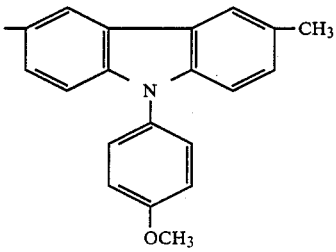 |
| XVIII-36 | " | $-CH_3$ | " | " | " | 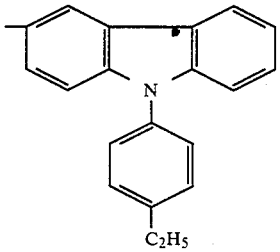 |

-continued
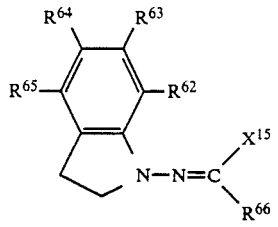
| Compound No. | $-R^{62}$ | $-R^{63}$ | $-R^{64}$ | $-R^{65}$ | $-R^{66}$ | $-X^{15}$ |
|---|---|---|---|---|---|---|
| XVIII-37 | " | —H | " | " | " | 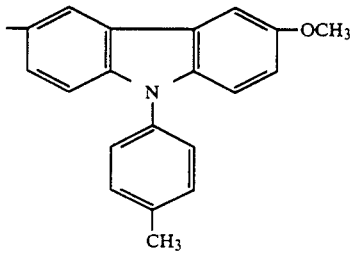 |
| XVIII-38 | " | " | " | " | " | 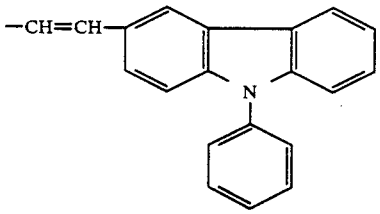 |
| XVIII-39 | " | " | " | " | " | 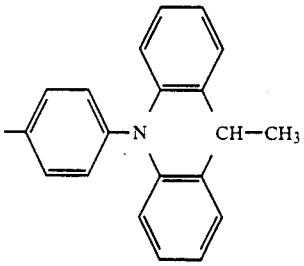 |
| XVIII-40 | $-N(CH_3)_2$ | " | " | " | " | 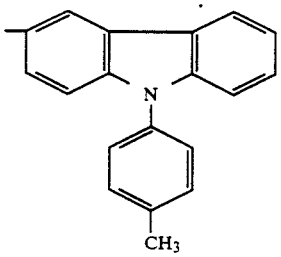 |
| XVIII-41 | —H | " | " | " | " | 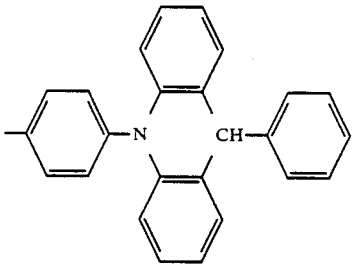 |

-continued
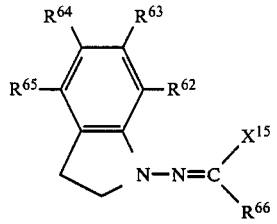
| Compound No. | $-R^{62}$ | $-R^{63}$ | $-R^{64}$ | $-R^{65}$ | $-R^{66}$ | $-X^{15}$ |
|---|---|---|---|---|---|---|
| XVIII-42 | " | " | " | " | " | 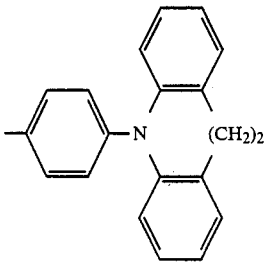 |
| XVIII-43 | " | " | " | " | " | 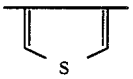 |
| XVIII-44 | " | " | " | " | " | 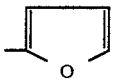 |
| XVIII-45 | " | " | " | " | " | 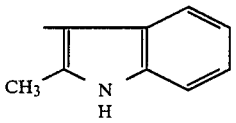 |
| XVIII-46 | " | " | " | " | " | 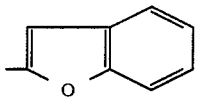 |
Exemplified compound group XIX
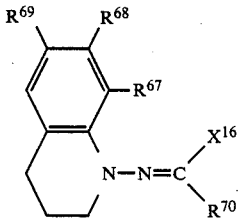
| Compound No. | $-R^{67}$ | $-R^{68}$ | $-R^{69}$ | $-R^{70}$ | $-X^{16}$ |
|---|---|---|---|---|---|
| XIX-1 | —H | —H | —H | —H | 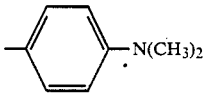 |

-continued
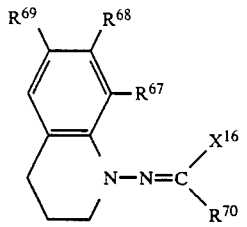
| Compound No. | $-R^{67}$ | $-R^{68}$ | $-R^{69}$ | $-R^{70}$ | $-X^{16}$ |
|---|---|---|---|---|---|
| XIX-2 | " | " | " | " | 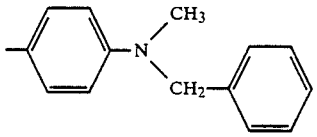 |
| XIX-3 | " | " | $-CH_3$ | $-H$ | 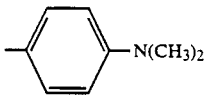 |
| XIX-4 | " | " | $-H$ | " | " |
| XIX-5 | " | " | " | " | 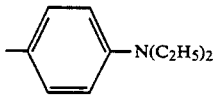 |
| XIX-6 | " | $-OCH_3$ | " | " | " |
| XIX-7 | " | $-H$ | " | " | 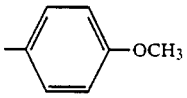 |
| XIX-8 | " | " | " | " | 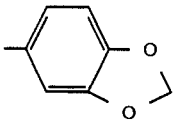 |
| XIX-9 | " | " | " | " | 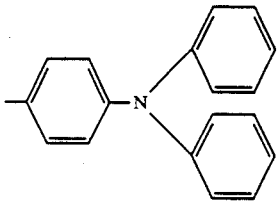 |
| XIX-10 | " | " | " | " | 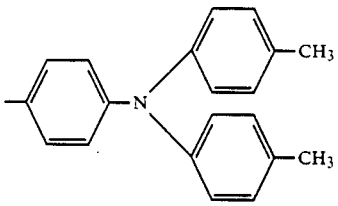 |

-continued
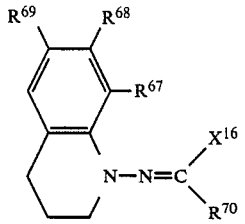
| Compound No. | $-R^{67}$ | $-R^{68}$ | $-R^{69}$ | $-R^{70}$ | $-X^{16}$ |
|---|---|---|---|---|---|
| XIX-11 | " | " | " | " | 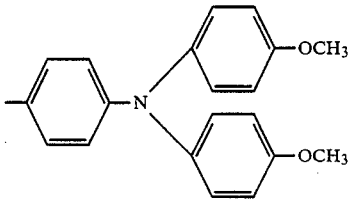 |
| XIX-12 | " | " | $-CH_3$ | " | 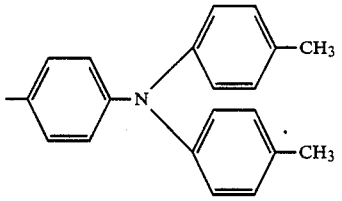 |
| XIX-13 | " | " | $-OCH_3$ | " | 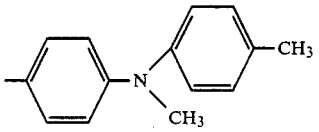 |
| XIX-14 | " | " | $-Cl$ | 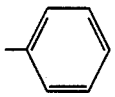 | 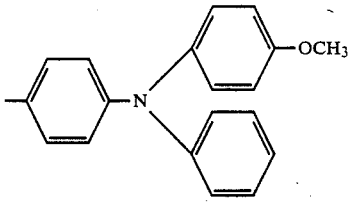 |
| XIX-15 | " | " | $-H$ | " | 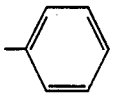 |
| XIX-16 | " | " | " | " | 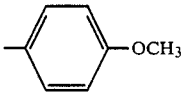 |
| XIX-17 | " | " | " | $-CH_3$ | 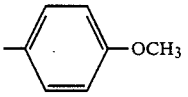 |

-continued
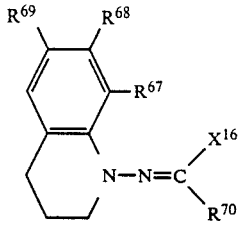
| Compound No. | $-R^{67}$ | $-R^{68}$ | $-R^{69}$ | $-R^{70}$ | $-X^{16}$ |
|---|---|---|---|---|---|
| XIX-18 | " | " | " | " | 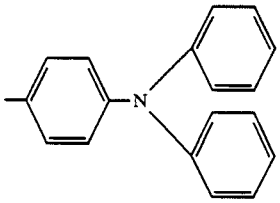 |
| XIX-19 | " | " | " | 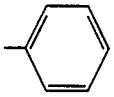 | 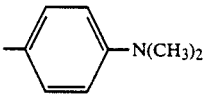 |
| XIX-20 | " | " | " | $-H$ | 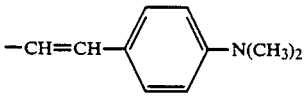 |
| XIX-21 | " | " | " | " | 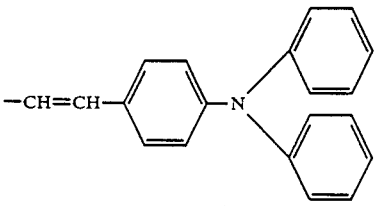 |
| XIX-22 | $-CH_3$ | " | " | " | 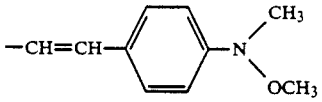 |
| XIX-23 | $-H$ | " | " | $-CH_3$ | 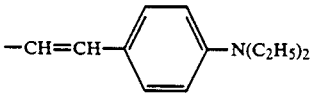 |
| XIX-24 | " | " | " | $-H$ | 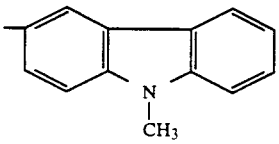 |
| XIX-25 | " | " | " | " | 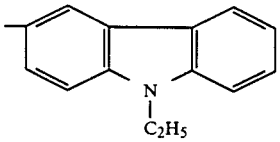 |

-continued
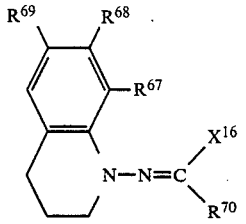
| Compound No. | $-R^{67}$ | $-R^{68}$ | $-R^{69}$ | $-R^{70}$ | $-X^{16}$ |
|---|---|---|---|---|---|
| XIX-26 | " | " | " | " | 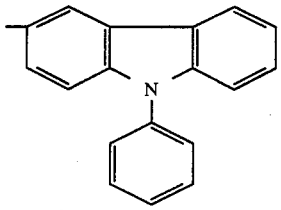 |
| XIX-27 | " | " | $-CH_3$ | " | 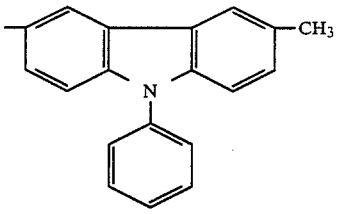 |
| XIX-28 | " | " | $-H$ | " | 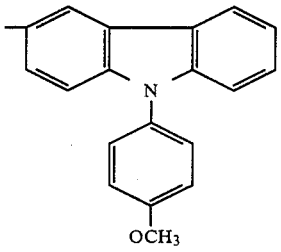 |
| XIX-29 | " | " | $-CH_3$ | " | 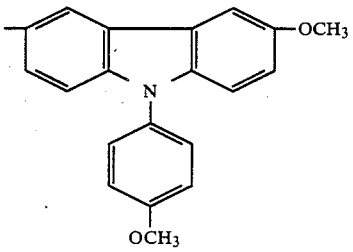 |
| XIX-30 | " | " | $-H$ | " | 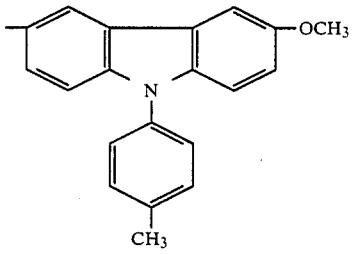 |

-continued
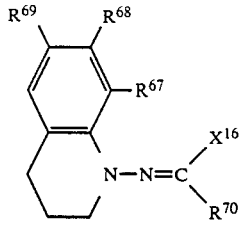
| Compound No. | —R67 | —R68 | —R69 | —R70 | —X16 |
|---|---|---|---|---|---|
| XIX-31 | " | " | " | " | 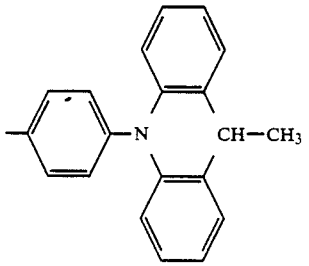 |
| XIX-32 | " | " | " | " | 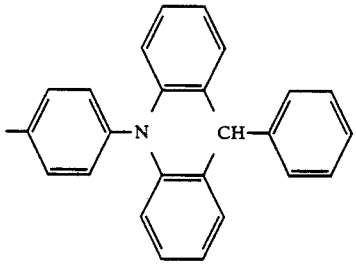 |
| XIX-33 | " | " | " | " | 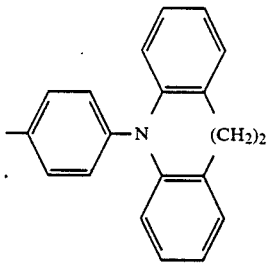 |
| XIX-34 | " | " | " | " | 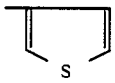 |
| XIX-35 | " | " | —CN | " | 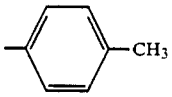 |
| XIX-36 | " | —$(C_2H_5)_2$ | —H | " | 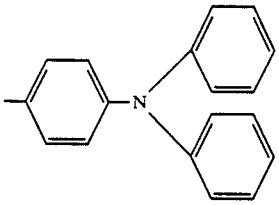 |

-continued
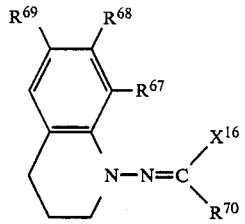
| Compound No. | $-R^{67}$ | $-R^{68}$ | $-R^{69}$ | $-R^{70}$ | $-X^{16}$ |
|---|---|---|---|---|---|
| XIX-37 | $-C_2H_5$ | $-H$ | " | " | 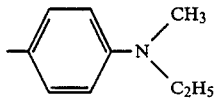 |
| XIX-38 | $-H$ | " | " | " | 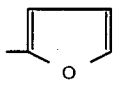 |
| XIX-39 | " | " | " | " | 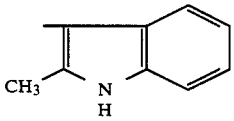 |
| XIX-40 | " | " | " | " | 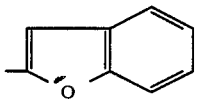 |
| XIX-41 | " | " | " | " | 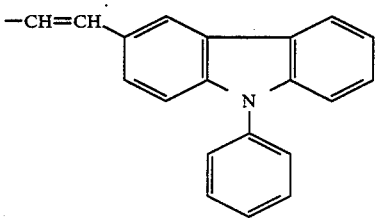 |
| XIX-42 | $-C_3H_7$ | " | " | $-CH_3$ | 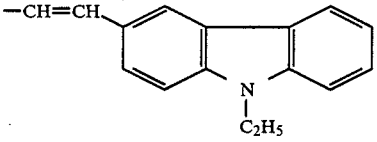 |
As for CTMs, it is also allowed to use the pyrazoline compounds given in the following exemplified compound group XX:
Exemplified compound group XX
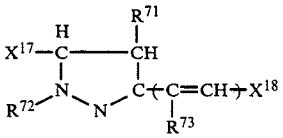
| Compound No. | $-X^{17}$ | $-R^{71}$ | $-R^{72}$ | $-R^{73}$ | (l = 0 1) l | $-X^{18}$ |
|---|---|---|---|---|---|---|
| XX-1 | 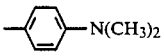 | $-CH_3$ | 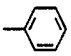 | $-H$ | 1 | 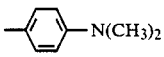 |

-continued

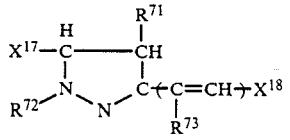

| Compound No. | $-X^{17}$ | $-R^{71}$ | $-R^{72}$ | $-R^{73}$ | (l = 0 1) l | $-X^{18}$ |
|---|---|---|---|---|---|---|
| XX-2 | " | $-H$ | " | $-CH_3$ | " | " |
| XX-3 | $-C_6H_4-N(C_2H_5)_2$ | $-CH_3$ | " | " | " | $-C_6H_4-N(C_2H_5)_2$ |
| XX-4 | $-C_6H_4-OCH_3$ | " | " | $-H$ | " | $-C_6H_4-OCH_3$ |
| XX-5 | " | $-H$ | " | $-CH_3$ | " | " |
| XX-6 | $-C_6H_4-N(C_2H_5)_2$ | $-CH_3$ | $-C_6H_4-OCH_3$ | $-H$ | " | $-C_6H_4-N(C_2H_5)_2$ |
| XX-7 | $-C_6H_4-N(CH_3)_2$ | " | $-C_6H_5$ | " | " | $-C_6H_4-OCH_3$ |
| XX-8 | $-C_6H_4-OCH_3$ | " | " | " | " | $-C_6H_4-N(CH_3)_2$ |
| XX-9 | $-C_6H_4-N(CH_3)_2$ | $-H$ | " | $-CH_3$ | " | $-C_6H_4-OC_2H_5$ |
| XX-10 | $-C_6H_4-OC_2H_5$ | $-H$ | $-C_6H_5$ | $-CH_3$ | 1 | $-C_6H_4-N(C_2H_5)_2$ |
| XX-11 | $-C_6H_4-N(C_2H_5)_2$ | $-C_6H_5$ | " | $-C_6H_5$ | " | " |
| XX-12 | $-C_6H_4-N(CH_3)_2$ | $-CH_3$ | " | $-H$ | " | $-C_6H_4-N(CH-C_6H_5)_2$ |
| XX-13 | $-C_6H_4-N(C_2H_5)_2$ | " | " | " | 0 | $-C_6H_4-N(C_2H_5)_2$ |
| XX-14 | " | $-C_2H_5$ | " | " | 1 | " |
| XX-15 | $-C_6H_4-N(C_4H_9)_2$ | $-H$ | " | $-C_3H_7$ | " | $-C_6H_4-OC_2H_5$ |
| XX-16 | $-C_6H_4-N(C_2H_5)_2$ | $-CH_2-C_6H_5$ | $-C_6H_4-OC_2H_5$ | $-H$ | " | $-C_6H_4-N(C_2H_5)_2$ |
| XX-17 | " | $-H$ | $-C_6H_5$ | $-CH_2-C_6H_5$ | " | " |
| XX-18 | $-C_6H_4-N(CH_3)_2$ | " | " | $-CH_3$ | | $-C_6H_4-N(C_6H_5)_2$ |
| XVI-19 | $-C_6H_4-N(C_2H_5)_2$ | $-CH_3$ | " | $-H$ | " | $-C_6H_4-N(C_2H_5)_2$ |

As for CTMs, it is also allowed to use the amine derivatives given in the following exemplified compound group XXI.
Exemplified compound group XXI
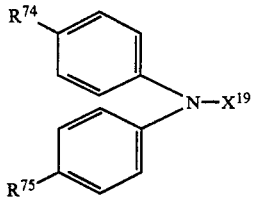
| Compound No. | $-R^{74}$ | $-R^{75}$ | $-X^{19}$ |
|---|---|---|---|
| XXI-1 | —H | —H | 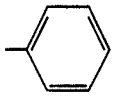 |
| XXI-2 | " | " | 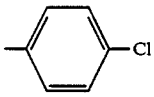  |
| XXI-3 | —Br | —Br | 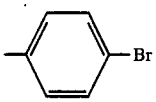  |
| XXI-4 | —H | —H | 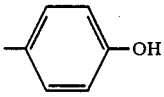  |
| XXI-5 | " | " | 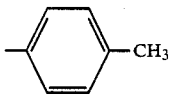  |
| XXI-6 | " | " | 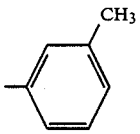  |
| XXI-7 | " | " | 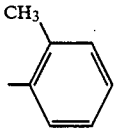  |
| XXI-8 | $-CH_3$ | —H | 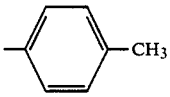  |
| XXI-9 | " | $-CH_3$ | " |
| XXI-10 | —H | —H | 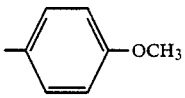  |

-continued
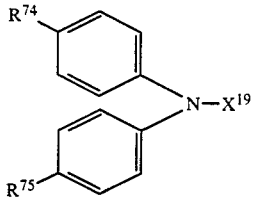
| Compound No. | $-R^{74}$ | $-R^{75}$ | $-X^{19}$ |
|---|---|---|---|
| XXI-11 | " | " | 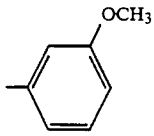 |
| XXI-12 | " | " | 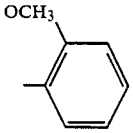 |
| XXI-13 | $-OCH_3$ | " | 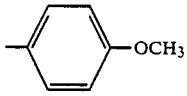 |
| XXI-14 | " | $-OCH_3$ | " |
| XXI-15 | $-CH_3$ | $-H$ | " |
| XXI-16 | $-H$ | " | 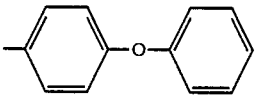 |
| XXI-17 | " | " | 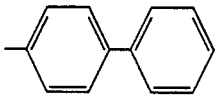 |
| XXI-18 | $-H$ | $-H$ | 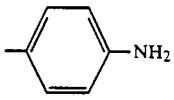 |
| XXI-19 | " | " | 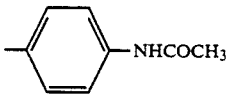 |
| XXI-20 | " | " | 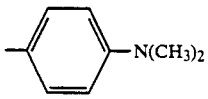 |
| XXI-21 | " | " | 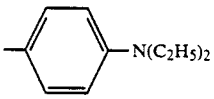 |
| XXI-22 | " | " | 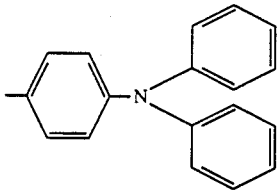 |

-continued
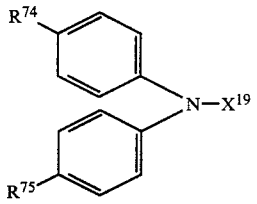
| Compound No. | —R74 | —R75 | —X19 |
|---|---|---|---|
| XXI-23 | " | " | 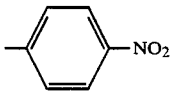 |
| XXI-24 | —NO2 | " | 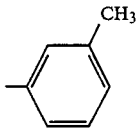 |
| XXI-25 | —H | " | 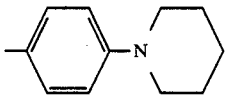 |
| XXI-26 | " | " | 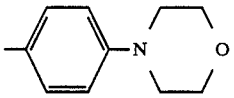 |
| XXI-27 | —H | —H | 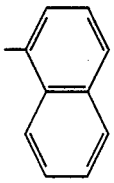 |
| XXI-28 | —CH3 | —CH3 | " |
| XXI-29 | —H | —H | 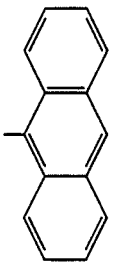 |
| XXI-30 | —CH3 | —CH3 | 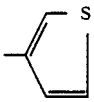 |
| XXI-31 | —H | —H | 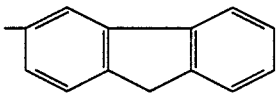 |
| XXI-32 | —CH3 | —CH3 | 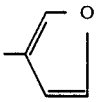 |

-continued

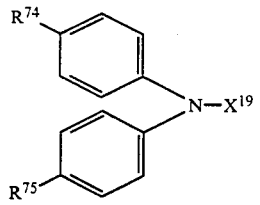

| Compound No. | —R74 | —R75 | —X19 |
|---|---|---|---|
| XXI-33 | —H | —H | 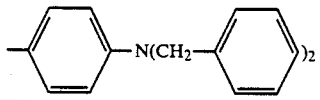 |

In the photoreceptors of the invention, the layer constructions of image forming layers are classified into a multilayered construction and a singlelayered construction. CTL, CGL, either one of a singlelayered photoreceptive layer or OCL, or a plurality of layers are allowed to contain one or not less than two kinds of electron receptive material, with the purposes of improving sensitivity, reducing residual potential or fatigue caused in repetition use and so forth.

The electron receptive materials applicable to the image forming layers of the invention include, for example, succinic anhydride, maleic anhydride, dibromomaleic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, paranitrobenzonitrile, picryl chloride, quinonechlorimide, chloranil, bromanil, 2-methylnaphthoquinone, dichlorodicyanoparabenzoquinone, anthraquinone, dinitroanthraquinone, trinitrofluorenone, 9-fluorenylidene-[dicyanomethylenemalonodinitrile], polynitro-9-fluorenylidene-[dicyanomethylenemalonodinitrile], picric acid, o-nitrobenzoate, p-nitrobenzoate, 3,5-dinitrobenzoate, pentafluorobenzoate, 5-nitrosalicyl acid, 3,5-dinitrosalcylic acid phthalic acid, and so forth.

It is also allowed to make silicone oil present to serve as a surface modifier. It is further allowed to contain an ammonium compound to serve as a durability improver.

Besides the polycarbonates having the principal repetition unit that is a structural unit represented by the aforegiven Formula I or II, other binder resins may be used in combination in the invention.

The above-mentioned binder resins include, for example, such an addition-polymerization type resins as polyethylene, polypropylene, acrylic resin, methacrylic resin, vinyl chloride resin, vinyl acetate resin, epoxy resin, polyurethane resin, phenol resin, polyhydroxystyrene resin, polyester resin, alkyd resin, polycarbonate resin other than those of the invention, silicone resin, melamine resin and so forth; polyaddition type resins; polycondensation type resins; and copolymeric resins containing not less than two of the repetition units of the above-given resins including, for example, insulating resins such as vinyl chloride-vinyl acetate copolymeric resin, vinyl chloride-vinyl acetate-maleic anhydride copolymeric resin and so forth; and, besides, macromolecular organic semiconductors such as poly-N-vinyl carbazole and so forth.

Further, an interlayer will function as an adhesive layer, a barrier layer or the like. Besides the above-mentioned binder resins, it is allowed to jointly use, for example, polyvinyl alcohol, ethyl cellulose, carboxymethyl cellulose, vinyl chloride-vinyl acetate copolymer, vinyl chloride-vinyl acetate-maleic anhydride copolymer, casein, N-alkoxymethylated nylon, starch and so forth.

Next, to serve as an electroconductive support capable of supporting a photoreceptive layer, it is allowed to use a metal plate of aluminium, nickel or the like; a metal drum or metal foil; a plastic film sheet deposited thereon with aluminium, tin oxide, indium oxide or the like; a sheet of paper, film or drum of plastics or the like coated thereon with an electroconductive material.

CGL may be provided in such a manner that CGM is dissolved or dispersed in an appropriate solvent independently or in combination with an appropriate binder resin and the resulting solution is coated and dried.

CGM may be dispersed by making use of a ball-mill, a homomixer, a san-mill, a super-sonic disperser, an attriter or the like.

The solvents applicable to the formation of CGL include, for example, N,N-dimethylformaldehyde, benzene, toluene, xylene, monochlorobenzene, 1,2-dichloroethane, dichloromethane, 1,2-trichlorethane, tetrahydrofuran, methylethylketone, ethyl acetate, butyl acetate and so forth.

The CGM contents of CGL should preferably be not less than 20 parts by weight to 100 parts by weight of the binder resin used and, more preferably be 25 to 400 parts by weight.

The layer thickness of CGL thus formed should preferably be 0.01 to 10 μm and more preferably be 0.1 to 5μ.

Meantime, CTL may be formed in such a manner that the aforementioned CTM is dissolved or dispersed independently or in combination with the above-mentioned binder resin and the resulting solution is coated and dried, in the same manner as in CGL.

The CTM contents of CTL is to be 20 to 200 parts by weight to 100 parts by weight of the binder resin used and should preferably be 30 to 150 parts by weight thereto.

The layer thickness of CTL thus formed should preferably be 5 to 50 μm and more preferably be 5 to 30 μm.

On the other hand, the aforementioned protective layer is allowed to contain an electron receptive material and, besides, if required, a UV absorbent or the like with the purpose of protecting CGM. The layer thickness of such a protective layer should preferably be not thicker than 2 μm and more preferably be not thicker than 1 μm.

When coating the above-mentioned each layer, a dip-coating, a spray-coating, a blade-coating, a roller-coating or the like, for example, may be used.

EXAMPLES

Now, the examples of the invention will be described below. It is, however, to be understood that the embodiments of the examples of the invention shall not be limited thereto.

EXAMPLE 1

Over an aluminium drum support having an outer diameter of 80 mmϕ was provided with an interlayer having a thickness of about 0.1 μm comprising a vinyl chloride-vinyl acetate-maleic anhydride copolymer, 'S-lec MF-10', (manufactured by Sekiusi Chemical Co.). Next, 60 g of polycyclic quinone pigment having Formula X-3 were pulverized for 24 hours with a ball-mill. The resulted pulverized pigment was added with a solution prepared by dissolving 30 g of bisphenol A type polycarbonate, 'Panlite L-1250', (manufactured by Teijin Chemical Co.) in 3000 ml of 1,2-dichloroethane and then dispersed for 24 hours. The drum with interlayer was dipped into the resulted dispersion so as to be coated. The coated dispersion layer was then dried enough, so that CGL having a thickness of about 0.3 mm was formed.

On the other hand, 352.5 g of the stylyl compound having the aforegiven Formula XIII-61, 7.1 g of the hindered phenol type compound having Formula III-117 and 450 of 'IUPILON Z-200' (manufactured by Mitsubishi Gas Chemical Co.), that is a polycarbonate having the principal repetition structural unit having the aforegiven Formula II-2, were dissolved in 3000 ml of 1,2-dichloroethane. The aforementioned drum with CGL was dipped into the resulted solution so as to be coated and dried at 80° C. for one hour, so that CTL having a thickness of 20 μm was formed. Thus, an electrophotographic photoreceptor according to the invention was produced.

EXAMPLE 2

An electrophotographic photoreceptor was produced in the same manner as in Example 1, except that 'IUPILON Z-200' that is a polycarbonate having the structural unit represented by Formula II-2 having been applied to CTL of Example 1 was used as the binder for CGL in this example.

EXAMPLE 3

An electrophotographic photoreceptor was produced in the same manner as in Example 2, except that 0.6 g of the hindered phenol type compound represented by Formula III-4 (in an amount of 2wt% of the binder used) were further added into CGL.

EXAMPLE 4

Over an aluminium drum having an outer diameter of 80 mmϕ was provided with the same interlayer as that of Example 1. Next, 15 g of 'Dianal BR-85' (manufactured by Mitsubishi Rayon Co.) that is an acryl resin were dissolved in 3000 ml of 1,2-dichloroethane and the resulted solution was added with 30 g of bisazo pigment represented by Formula IX-15 and dispersed for 8 hours with a sand-glinder. The aforementioned drum with interlayer was dipped in the resulted dispersion so as to be coated, so that CGL having a thickness of 0.2μ was formed.

On the other hand, 352.5 g of hydrazone compound represented by Formula XIX-25, 17.6 g of hindered phenol type compound represented by Formula III-41 and 450 g of polycarbonate having the repetition unit represented by Formula II-4 were dissolved in 3000 ml of 1,2-dichloroethane. The resulted solution was soaked over the aforementioned CGL so as to be coated and dried for one hour at 80° C., so that a CTL having a thickness of 20 μm was formed. Thus, an electrophotographic photoreceptor of the invention was produced.

EXAMPLE 5

An electrophotographic photoreceptor was produced in the same manner as in Example 4, except that the bisazo pigment of Example 4 was replaced by an X type metal free-phthalocyanine and a compound represented by Formula XX-6 was used as the CTM in this example.

EXAMPLE 6

The same interlayer as that of Example 1 was provided onto an aluminium drum support having an outer diameter of 80 mmϕ.

Next, the same CTL solution as that of Example 1 was soaked over the interlayer so as to be coated, so that the CTL having a thickness of 15 μm was formed. On the other hand, 60 g of 'IUPILON Z-200' that is a polycarbonate having the principal repetition unit represented by Formula II-2 the same CTL solution as that of Example 1 so as to be coated. On the other hand, 60 g of 'U-pyrone Z-200' that is a polycarbonate having the principal repetition unit represented by Formula II-2 were dissolved in 3000 ml of monochlorobenzene. The resulted solution was added with 30 g of polycyclic quinone pigment represented by Formula X-3 and was then dispersed for 24 hours with a ball-mill. Further, the dispersion was added with 45 g of stylyl compound represented by Formula XIII-20 and 2.2 g of hindered phenol compound represented by Formula III-117 and was then dissolved together. The resulted dispersion was spray-coated over the above-mentioned CTL so as to form a CGL having a thickness of 5 μm. Thus, an electrophotographic photoreceptor of the invention of positive-charge type was obtained as shown in FIG. 2.

EXAMPLE 7

A photoreceptor such as that of Example 6 was produced and a protective layer was provided thereon in the following manner, so that a photoreceptor such as that shown in FIG. 4 was produced.

The protective layer having a thickness of 2 μm was formed in such a manner that 30 of 'IUPILON Z-200' that is polycarbonate having the repetition unit represented by Formula II-2 and 0.6 g of hindered phenol type compound represented by Formula III-54 were dissolved in 3000 ml of monochlorobenzene, and the resulted solution was spray-coated over an electrophotographic photoreceptor produced in the same manner as in Example 6.

EXAMPLE 8

An interlayer was provided in the same manner as in Example 1 to an aluminium drum support having an outer diameter of 80 mmϕ. Next, 300 g of 'IUPILON Z-200' that is polycarbonate having a repetition unit represented by Formula II-2 were dissolved in 3000 ml of monochlorobenzene. The resulted solution was added with 60 g of CGM represented by Formula VIII-7 and was then dispersed for 24 hours with a ball-mill. The resulted dispersion was further added with 225 g of CTM represented by Formula VIII-37 and 15 g of hindered phenol type compound represented by Formula III-128 and then dissolved together. The resulted dispersion was coated over to the aforementioned interlayer and then dried so as to form a photoreceptive layer. Thus, an electrophotographic photoreceptor of the invention was produced as shown in FIG. 3.

COMPARATIVE EXAMPLES 1 THROUGH 5

Photoreceptors of Comparative Examples 1 through 5 were produced in the same manner as in Examples 1 through 5, except that the hindered phenol type compounds were removed from CTLs, respectively.

COMPARATIVE EXAMPLE 6

A photoreceptor of Comparative Example 6 was produced in the same manner as in Example 6, except that the hindered phenol type compound was removed from the CGL.

COMPARATIVE EXAMPLE 7

A photoreceptor of Comparative Example 7 was produced in the same manner as in Example 7, except that the hindered phenol type compound was removed from the OCL.

COMPARATIVE EXAMPLE 8

A photoreceptor of Comparative Example 8 was produced in the same manner as in Example 8, except that the hindered phenol type compound was removed from the single-layered photoreceptive layer.

COMPARATIVE EXAMPLE 9

A photoreceptor of Comparative Example 9 was produced in the same manner as in Example 1, except that the binder resin of the CTL, that was the polycarbonate of the invention in Example 1, was replaced by 'Panlite L-1250' (manufactured by Teijin Chemical Co.) that is a bisphenol A type polycarbonate in this comparative example.

COMPARATIVE EXAMPLE 10

A photoreceptor of Comparative Example 10 was produced in the same manner as in Example 6, except that the binder resin of the CGL, that was the polycarbonate of the invention, was replaced by 'Panlite L-1250' (manufactured by Teijin Chemical Co.) that is a bisphenol A type polycarbonate in this comparative example.

COMPARATIVE EXAMPLE 11

A photoreceptor of Comparative Example 11 was produced in the same manner as in Example 7, except that the binder resin of the OCL, that was the polycarbonate of the invention, was replaced by 'Panlite L-1250' (manufactured by Teijin Chemical Co.) that is a bisphenol A type polycarbonate in this comparative example.

COMPARATIVE EXAMPLE 12

A photoreceptor of Comparative Example 12 was produced in the same manner as in Example 8, except that the binder resin of the single-layered photoreceptive layer, that was the polycarbonate of the invention, was replaced by 'Panlite L-1250' (manufactured by Teijin Chemical Co.) that is a bisphenol A type polycarbonate in this comparative example.

Thus produced electrophotographic photoreceptor samples were loaded in a 'U-Bix 1550MR' copier (manufactured by Konica Corporation) and the practical copying tests of 50000 times were tried and, at the same time, black paper potentials Vb, white paper potentials Vw and residual potentials Vr were measured, respectively. After the 50000 copying tests were tried, the thickness reductions and damage to images were also inspected, respectively. The results of the measurements and inspections are shown in Table 1. The table shows each Vb, Vw and Vr each of the initial value, and $\Delta|Vb|$, $\Delta|Vw|$ and $\Delta|Vr|$ which represent the respective amounts of variations found after each of the 50,000 copies was made.

With the photoreceptors of Examples 6, 7 and 8, and Comparative Examples 6, 7, 8, 10, 11 and 12, the tests thereof were tried by changing the polarities of charge and transfer from the negative to the positive and the developers to negatively chargeable two-component type developers.

For reference, the term, 'black paper potential', means a surface potential of a photoreceptor generated when using a black paper original having a reflection density of 1.3 in the above-mentioned copying cycle. The term, 'white paper potential', means a surface potential of a photoreceptor generated when using a white paper original. The results of these potentials are also shown in the table. In the table, 'Inv' and 'Comp' represent the xamples of the invention and the comparative examples, respectively.

TABLE 1

| Example No. | Vb(V) | Vw(V) | Vr(V) | Δ\|Vb\| (V) | Δ\|Vw\| (V) | Δ\|Vr\| (V) | Thickness reduction (μm) | Damage of image |
|---|---|---|---|---|---|---|---|---|
| Inv.-1 | −620 | −75 | −5 | +35 | +50 | +45 | 1.0 | Not damaged |
| Comp.-1 | −585 | −70 | −5 | −60 | +110 | +105 | 1.2 | " |
| Comp.-9 | −610 | −80 | −5 | −110 | +55 | +40 | 5.5 | Damaged |
| Inv.-2 | −635 | −80 | −5 | +40 | +45 | +45 | 1.1 | Not damaged |
| Comp.-2 | −590 | −75 | −5 | −85 | +120 | +110 | 1.2 | " |
| Inv.-3 | −640 | −80 | −5 | +40 | +45 | +40 | 1.0 | Not damaged |
| Comp.-3 | −600 | −75 | −5 | −35 | +85 | +85 | 1.1 | " |
| Inv.-4 | −660 | −45 | −5 | +45 | +70 | +55 | 0.8 | Not damaged |
| Comp.-4 | −620 | −40 | −5 | −70 | +155 | +140 | 0.7 | " |

TABLE 1-continued

| Example No. | Vb(V) | Vw(V) | Vr(V) | Δ\|Vb\| (V) | Δ\|Vw\| (V) | Δ\|Vr\| (V) | Thickness reduction (μm) | Damage of image |
|---|---|---|---|---|---|---|---|---|
| Inv.-5 | −600 | −40 | −5 | +50 | +75 | +60 | 0.8 | Not damaged |
| Comp.-5 | −555 | −35 | −5 | −110 | +160 | +130 | 0.8 | " |
| Inv.-6 | +665 | +120 | +15 | −20 | +25 | +20 | 1.3 | Not damaged |
| Comp.-6 | +625 | +120 | +15 | −155 | +45 | +40 | 1.7 | " |
| Comp.-10 | +650 | +115 | +15 | −60 | +20 | +20 | 4.2 | Damaged |
| Inv.-7 | +710 | +155 | +40 | +45 | +80 | +90 | 0.6 | Not damaged |
| Comp.-7 | +690 | +160 | +45 | −20 | +145 | +130 | 0.8 | " |
| Comp.-11 | +720 | +160 | +45 | −20 | +70 | +85 | 3.4 | Damaged |
| Inv.-8 | −600 | −135 | −10 | −85 | +25 | +20 | 1.2 | Not damaged |
| Comp.-8 | −570 | −125 | −10 | −210 | +55 | +40 | 1.2 | " |
| Comp.-12 | −605 | −135 | −10 | −130 | +30 | +20 | 4.5 | Damaged |

EXAMPLE 9

An electrophotographic photoreceptor relating to the invention was produced in the same manner as in Example 1, except that the hindered phenol type compound III-117 was replaced by 7.1 g of a hindered amine-hindered phenol type compound represented by Formula III-141.

EXAMPLE 10

An electrophotographic photoreceptor was produced in the same manner as in Example 9, except that 'IUPILON Z-200' that is the polycarbonate having the structural unit represented by Formula II-2 used in the CTL of Example 9 was used for the binder of the CGL of this example.

EXAMPLE 11

An electrophotographic photoreceptor was produced in the same manner as in Example 10, except that 0.6 g of the hindered amine-hindered phenol type compound represented by Formula III-141 (in a proportion of 2wt% of the binder) were further added into the CGL of this example.

EXAMPLE 12

An electrophotographic photoreceptor was produced in the same manner as in Example 4, except that the the hindered-phenol type compound III-41 of Example 4 was replaced by 17.6 g of hindered amine-hindered phenol type compound represented by Formula III-148 in this example.

EXAMPLE 13

An electrophotographic photoreceptor of the invention was produced in the same manner as in Example 12, except that the bisazo pigment of Example 12 was replaced by an X type metal free-phthalocyanine and the compound represented by Formula XX-6 was used for the CTM of this example.

EXAMPLE 14

An electrophotographic photoreceptor of the positive-charge type of the invention such as that shown in FIG. 2 was produced in the same manner as in Example 6, except that the hindered-phenol type compound III-117 of Example 6 was replaced by 2.2 g of hindered amine-hindered phenol type compound represented by Formula III-7 in this example.

EXAMPLE 15

A photoreceptor such as that shown in FIG. 4 was produced in the manner that the photoreceptor of Example 14 was produced and thereonto a OCL was provided in the following manner.

'IUPILON Z-200' that is a polycarbonate in an amount of 30 g and 0.6 g of hindered amine-hindered phenol type compound represented by Formula III-9 were dissolved in 3000 ml of monochlorobenzene, and the resulted solution was spray-coated over to the electrophotographic photoreceptor produced in the same manner as in Example 14, so that an OCL having a thickness of 2 μm was formed.

EXAMPLE 16

An electrophotographic photoreceptor of the invention such as that shown in FIG. 3 was produced in the same manner as in Example 8, except that the hindered phenol compound III-128 of Example 8 was replaced by 3 g of hindered amine-hindered phenol type compound represented by Formula III-154 in this example.

COMPARATIVE EXAMPLES 13

A photoreceptor of Comparative Example 13 was produced in the same manner as in Example 9, except that the binder resin of the CTL was changed from the polycarbonate of the invention to 'Panlite L-1250' (manufactured by Teijin Chemical Co.) that is a bisphenol A type polycarbonate, in this Comparative Example.

COMPARATIVE EXAMPLE 14

A photoreceptor of Comparative Example 14 was produced in the same manner as in Example 14, except that the binder resin of the CGL was changed from the polycarbonate of the invention to 'Panlite L-1250' that is a bisphenol A type polycarbonate, in this Comparative Example.

COMPARATIVE EXAMPLE 15

A photoreceptor of Comparative Example 15 was produced in the same manner as in Example 15, except that the binder resin of the OCL was changed from the polycarbonate of the invention to 'Panlite L-1250' that is a bisphenol A type polycarbonate, in this Comparative Example.

COMPARATIVE EXAMPLE 16

A photoreceptor of Comparative Example 16 was produced in the same manner as in Example 16, except that the binder resin of the single-layered photoreceptive layer of Example 16 was changed from the polycarbonate of the invention to 'Panlite L-1250' that is a bisphenol A type polycarbonate, in this Comparative Example.

Among the electrophotographic photoreceptor samples thus produced, the samples of Examples 9 through 16 and Comparative Examples 13 through 16 were measured and inspected in the same manners as in the samples shown in the aforegiven Table 1, provided however that the samples of Examples 14, 15 and 16 and Comparative Examples 14, 15 and 16 each were tested in the same conditions as in the samples of Examples 6, 7 and 8 and Comparative Examples 6, 7, 8, 10, 11 and 12, respectively.

The results of the measurements and inspections thereof are shown in Table 2 wherein the results from Comparative Examples 1 through 8 which are originally shown in Table 1 are shown again for the convenience of the comparison.

TABLE 2

| Example No. | Vb(V) | Vw(V) | Vr(V) | Δ\|Vb\| (V) | Δ\|Vw\| (V) | Δ\|Vr\| (V) | Thickness reduction (μm) | Damage of image |
|---|---|---|---|---|---|---|---|---|
| Inv.-9 | −650 | −85 | −5 | +30 | +55 | +50 | 1.0 | Not damaged |
| Comp.-1 | −585 | −70 | −5 | −60 | +110 | +105 | 1.2 | " |
| Comp.-9 | −635 | −85 | −5 | −130 | +55 | +40 | 5.7 | Damaged |
| Inv.-10 | −650 | −85 | −5 | +45 | +50 | +50 | 1.0 | Not damaged |
| Comp.-2 | −590 | −75 | −5 | −85 | +120 | +110 | 1.2 | " |
| Inv.-11 | −670 | −60 | −5 | +40 | +50 | +45 | 1.0 | Not damaged |
| Comp.-3 | −600 | −75 | −5 | −35 | +85 | +85 | 1.1 | " |
| Inv.-12 | −680 | −50 | −5 | +35 | +80 | +60 | 0.8 | Not damaged |
| Comp.-4 | −620 | −40 | −5 | −70 | +155 | +140 | 0.7 | " |
| Inv.-13 | −630 | −50 | −5 | +45 | +80 | +70 | 0.8 | Not damaged |
| Comp.-5 | −555 | −35 | −5 | −110 | +160 | +130 | 0.8 | " |
| Inv.-14 | +680 | +125 | +20 | −10 | +30 | +25 | 1.2 | Not damaged |
| Comp.-6 | +625 | +120 | +15 | −155 | +45 | +40 | 1.7 | " |
| Comp.-14 | +670 | +120 | +20 | −75 | +40 | +30 | 4.0 | Damaged |
| Inv.-15 | +720 | +160 | +40 | +50 | +85 | +90 | 0.6 | Not damaged |
| Comp.-7 | +690 | +160 | +45 | −20 | +145 | +130 | 0.8 | " |
| Comp.-15 | +730 | +155 | +45 | −40 | +75 | +85 | 3.8 | Damaged |
| Inv.-16 | −620 | −140 | −15 | −20 | +30 | +25 | 1.2 | Not damaged |
| Comp.-8 | −570 | −125 | −10 | −210 | +55 | +40 | 1.2 | " |
| Comp.-16 | −630 | −130 | −15 | −105 | +30 | +25 | 4.1 | Damaged |

As is apparent from the above-described examples and comparative examples, the electrophotographic photoreceptors of the invention are excellent in scratch and abrasion resistance and have few decrease in black paper potential (Vb) and few increase in both white paper potential (Vw) and residual potential (Vr) even when carrying out a number of copying continuously. It may therefore be understood that they may be able to reproduce copied images stably and to display the durability excellently.

What is claimed is:

1. An electrophotographic photoreceptor comprising a support having thereon a photoreceptive layer, wherein a surface portion of said layer, which is outermost from the support, contains a polycarbonate having at least one of principal repetition units represented by the following formulas I and II, and a compound having a hindered phenol structual unit in the molecules thereof;

Formula I

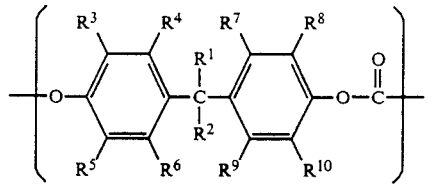

wherein $R^1$ and $R^2$ each represents a hydrogen atom, a substituted or unsubstituted aliphatic group, a substituted or unsubstituted carbon ring group, or a substituted or unsubstituted aromatic group; and at least either one of $R^1$ and $R^2$ is a bulky group; $R^3$, $R^4$, $R^5$, $R^6$, $R^7$, $R^8$, $R^9$, $R^{10}$ each represents a hydrogenatom, a hydrogen atom, a substituted or unsubstituted aliphatic group, or a substituted or unsubstituted carbon ring group, Formula II

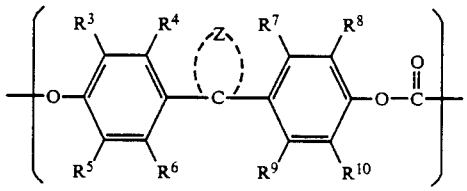

wherein $R^3$, $R^4$, $R^5$, $R^6$, $R^7$, $R^8$, $R^9$, $R^{10}$ each represents the same as denoted in the formula I, Z represents a group of atoms necessary for completing a substituted or unsubstituted carbon ring or a sabstituted or unsubstituted heterocyclic ring.

2. The photoreceptor of claim 1, wherein said bulky group is a

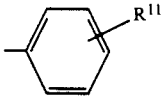

group,

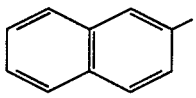

group, an alkyl group having four or more carbon atoms, or an alkyl ester group represented by the formula of $-(CH_2)mCOOR^{12}$, wherein $R^{11}$ is a hydrogen atom, an alkyl group or a $-(CH_2)m'COOR$ group and m is an integer of not less than 1; R is an alkyl group; $R^{12}$ is an alkyl group having two or more carbon atoms and m' is an integer of not less than 2.

3. The photoreceptor of claim 1, wherein said polycarbonate is represented by the following formula Ia;

Formula Ia

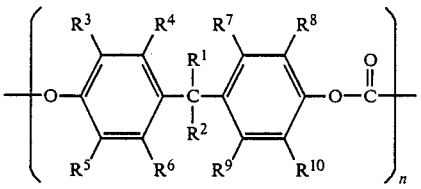

wherein $R^1$, $R^2$, $R^3$, $R^4$, $R^5$, $R^6$, $R^7$, $R^8$, $R^9$, and $R^{10}$ each is the same as deneted in the formula II and n is an integer of from 10 to 5000.

4. The photoreceptor of claim 3, wherein said n is an integer of from 50 to 1000.

5. The photoreceptor of claim 1, wherein said polycarbonate is represented by the following formula IIa;

Formula IIa

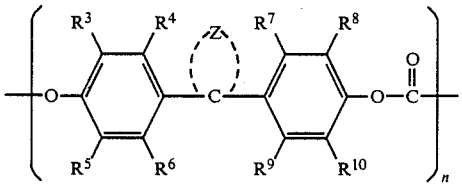

wherein $R^3$, $R^4$, $R^5$, $R^6$, $R^7$, $R^8$, $R^9$, $R^{10}$ and Z each is the same as denoted in the formula II and n is an integer of from 10 to 5000.

6. The photoreceptor of claim 5, wherein said n is an integer of from 50 to 1000.

7. The photoreceptor of claim 1, wherein said hindered phenol compound is selected from the group consisting of compounds represented by the following formula IIIa, IIIb, IIIc, IIId and IIIe.

Formula IIIa

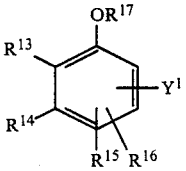

wherein $R^{13}$ represents an branched alkyl group; $R^{14}$, $R^{15}$ and $R^{16}$ each represents a hydrogen atom, a hydroxy group, an alkyl group or an aryl group, and $R^{15}$ and $R^{16}$ are allowed to be coupled to each other to complete a ring; and $R^{17}$ represents a hydrogen atom, an alkyl group or an alkylidene group, $Y^1$ represents a hydrogen atom or an organic residual group, Formula IIIb

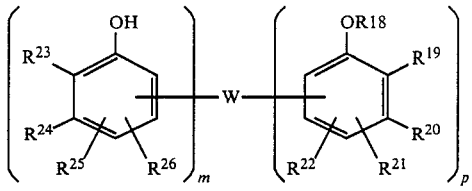

wherein $R^{18}$ represents a hydrogen atom, an alkyl group, an aryl group or an aralkyl group; $R^{19}$ and $R^{23}$ each represents a branched alkyl group; $R^{20}$, $R^{21}$, $R^{22}$, $R^{24}$, $R^{25}$ and $R^{26}$ each represents a hydrogen atom or a substituent; m and p each is zero or a positive integer, and sum of m plus p is from 2 to 4; and W represents a linkage group, Formula IIIc

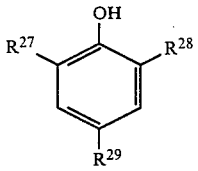

wherein $R^{27}$, $R^{28}$ and $R^{28}$ each represents an straight- or branched chained alkyl group having 1 to 4 carbon atoms, Formula IIId

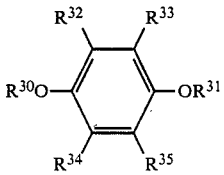

wherein $R^{30}$ and $R^{31}$ each represents an alkyl group, alkenyl group, cycloalkyl group, arylgroup or a heterocyclic group; $R^{32}$, $R^{33}$, $R^{34}$ and $R^{35}$ each represents a hydrogen atom, a halogen atom, an alkyl group, alkenyl group, cycloalkyl group, aryl group, alkoxyl group, alkylthio group, aryloxy group, arylthio group, acyl group, acylamino group, alkylamino group, alkoxycarbonyl group or a sulfonamido group, Formula IIIe

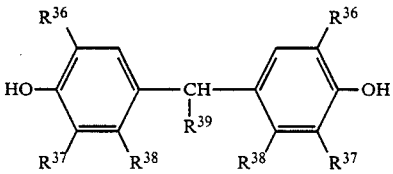

wherein $R^{36}$, represents an alkyl group having 1 to 18 carbon atoms; $R^{37}$ and $R^{38}$ each represents a hydrogen atom or an alkyl grouphaving 1 to 18 carbon atoms; and $R^{39}$ represents an alkyl group having 1 to 10 carbon atoms.

8. The photoreceptor of claim 1, wherein said hindered phenol compound is a compound containing a hindered amine stractual unit and a hindered phenol structual unit in molecular thereof.

9. The photoreceptor of claim 8, wherein said hindered amine structual unit and hindered phenol structual unit are represented by the following formula IIIf and IIIg, respectively.

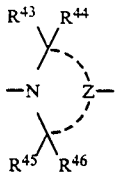

Formula IIIf wherein $R^{43}$, $R^{44}$, $R^{45}$ and $R^{46}$ each represents a hydrogen atom, an alkyl group or an aryl group; and Z represents a group of atoms necessary to complete a nitrogen containing aliphatic ring, provided that in a pair of $R^{43}$ and $R^{44}$ and a pair of $R^{45}$ and $R^{46}$, one or each pair may be incorporated into Z to give a double bond.

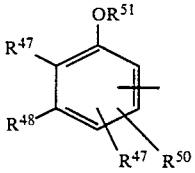

Formula IIIg wherein $R^{47}$ represents a branched alkyl group; $R^{48}$, $R^{49}$ and $R^{50}$ each represents a hydrogen atom, a hydroxy group, alkyl group or an aryl group, $R^{49}$ and $R^{50}$ are allowed to be coupled to each other to complete a ring; and $R^{51}$ represents a hydrogen atom or an alkyl group or an alkylidene group.

10. The photoreceptor of claim 1, wherein said polycarbonate and said compound having a hindered phenol structual unit are contained in a carrier generation layer arranged at the outermost protion of said photoreceptive layer.

11. The photoreceptor of claim 10, wherein said compound having a hindered phenol structual unit is contained in said carrier generation layer in an amount of from 0.01 to 50 parts by weight to 100 parts by weight of said polycarbnate.

12. The photoreceptor of claim 11, wherein said compound having a hindered phenol structual unit is contained in said carrier generation layer in an amount of from 0.1 to 10 parts by weight to 100 parts by weight of said polycarbnate.

13. The photoreceptor of claim 1, wherein said polycarbonate and said compound having a hindered phenol structual unit are contained in a carrier transportion layer arranged at the outermost portion of said photoreceptive layer.

14. The photoreceptor of claim 13, wherein said compound having a hindered phenol structual unit is contained in said carrier transportion layer in an amount of from 0.01 to 50 parts by weight to 100 parts by weight of said polycarbnate.

15. The photoreceptor of claim 14, wherein said compound having a hindered phenol structual unit is contained in said carrier transportion layer in an amount of from 0.1 to 10 parts by weight to 100 parts by weight of said polycarbnate.

16. The photoreceptor of claim 1, wherein said polycarbonate and said compound having a hindered phenol structual unit are contained in a single-layered photoreceptive layer.

17. The photoreceptor of claim 16, wherein said compound having a hindered phenol structual unit is contained in said single-layered photoreceptive layer in an amount of from 0.01 to 50 parts by weight to 100 parts by weight of said polycarbnate.

18. The photoreceptor of claim 17, wherein said compound having a hindered phenol structual unit is contained in said single-layered photoreceptive layer in an amount of from 0.1 to 10 parts by weight to 100 parts by weight of said polycarbnate.

19. The photoreceptor of claim 1, wherein said polycarbonate and said compound having a hindered phenol structual unit are contained in a over coating layer.

20. The photoreceptor of claim 19, wherein said compound having a hindered phenol structual unit is contained in said over coating layer in an amount of from 0.01 to 50 parts by weight to 100 parts by weight of said polycarbnate.

21. The photoreceptor of claim 20, wherein said compound having a hindered phenol structual unit is contained in said over coating layer in an amount of from 0.1 to 10 parts by weight to 100 parts by weight of said polycarbnate.

* * * * *

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI; EIICHI SAKAI

It is certified that error appears in the above-identified patent and that said Letters Patent is hereby corrected as shown below:

| Col. | Lines | |
|---|---|---|
| 2 | 19 | "Compatability" should read --Compatibility-- |
| 8 | 45 | Formula (II-10) |

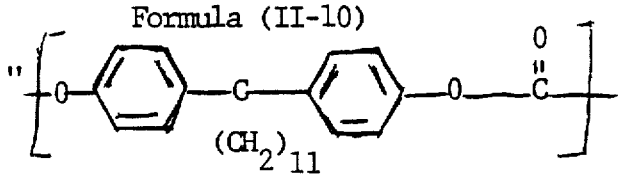

should be

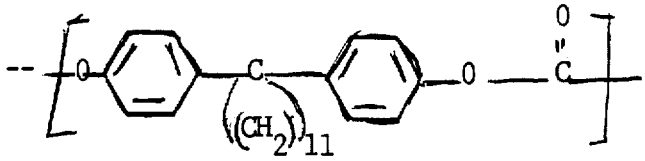

| | | |
|---|---|---|
| 9 | 40 to 50 | |

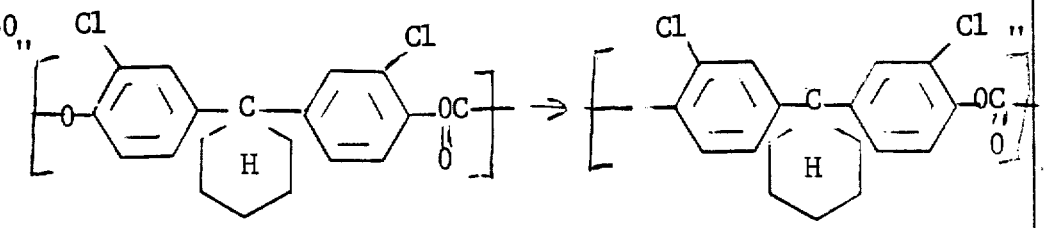

should be

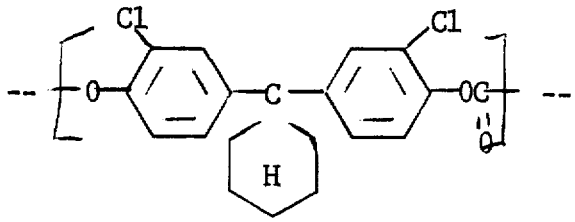

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI: EIICHI SAKAI

It is certified that error appears in the above-identified patent and that said Letters Patent is hereby corrected as shown below:

| Col. | Lines | |
|---|---|---|
| 9 | 55 to 65 | Formula (II-11) |

"

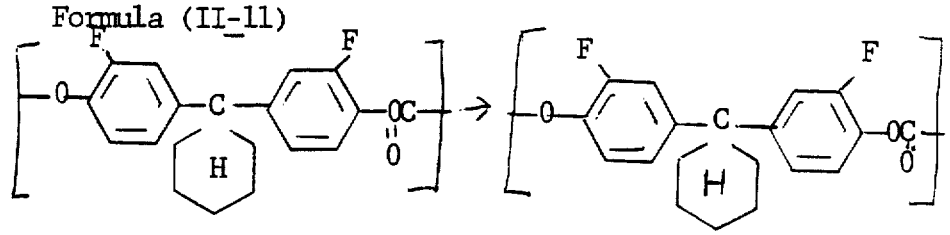

"

should be

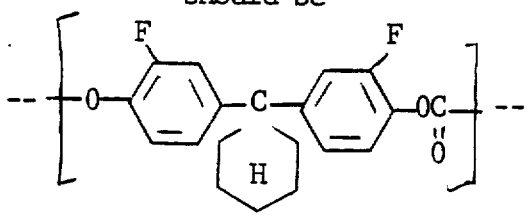

| | | |
|---|---|---|
| 10 | 5 to 15 | Formula (II-12) |

"

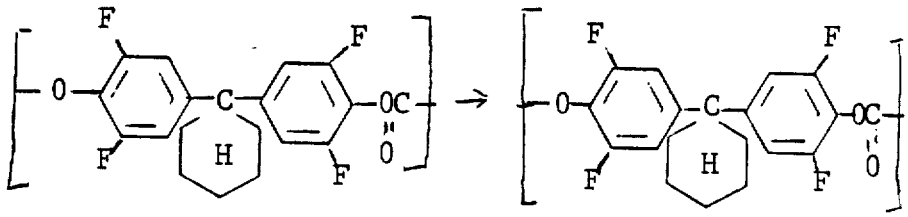

"

should be

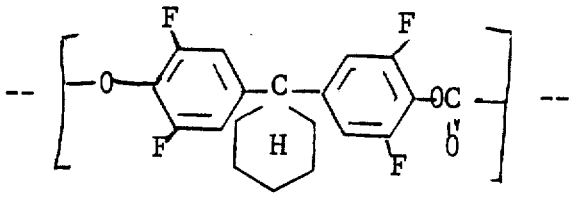

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI; EIICHI SAKAI

It is certified that error appears in the above-identified patent and that said Letters Patent is hereby corrected as shown below:

Col. 10 Lines 20 to 30

Formula (II-13)

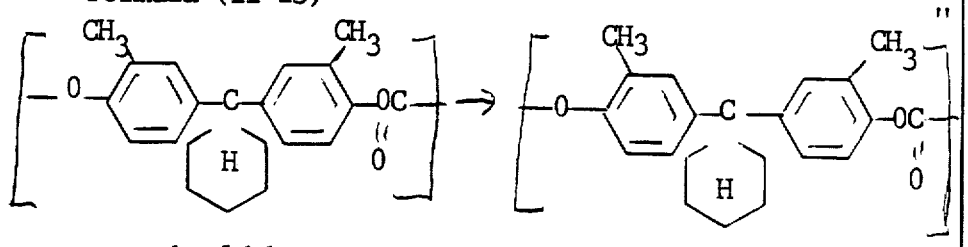

should be

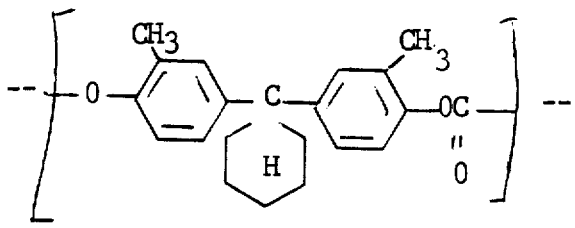

Col. 10 Lines 35 to 45

Formula (II-14)

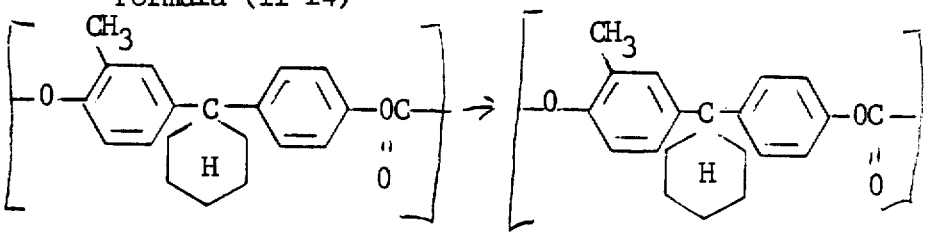

should be

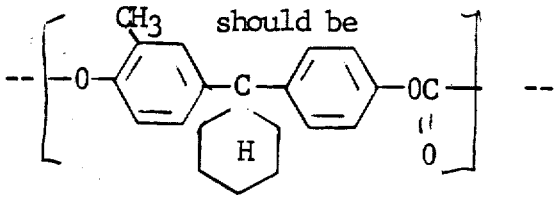

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI; EIICHI SAKAI

It is certified that error appears in the above-identified patent and that said Letters Patent is hereby corrected as shown below:

| Col. | Lines | |
|---|---|---|
| 10 | 50 to 60 | Formula (II-15) |

" 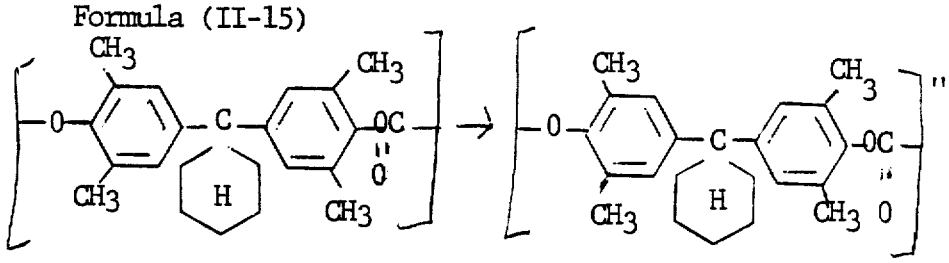 "

should be

-- 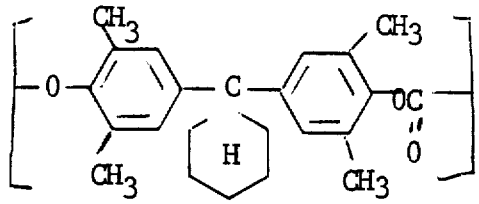 --

| | | |
|---|---|---|
| 11 | 1 | Delete "one" |
| 11 | 14 | "dohydroxyphenyl" should be --dihydroxyphenyl-- |

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI: EIICHI SAKAI

It is certified that error appears in the above-identified patent and that said Letters Patent is hereby corrected as shown below:

Col. Lines Formula (III-118)

22

" 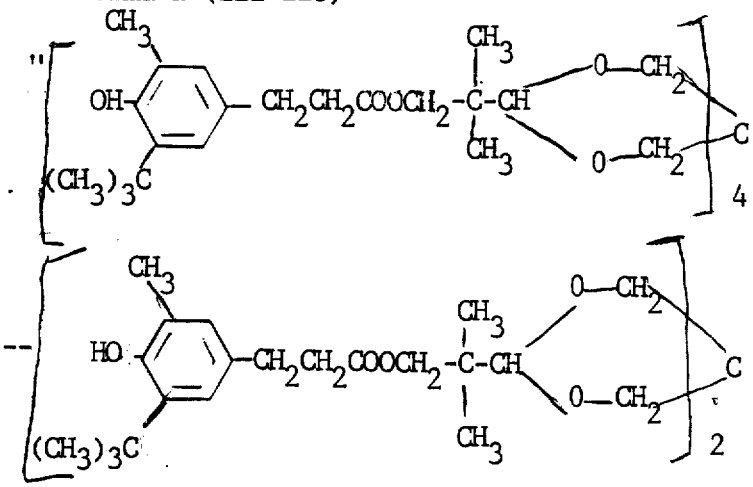 " should be

--  --

30 15 Formula IIIf

" 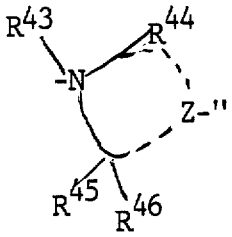 " should be -- 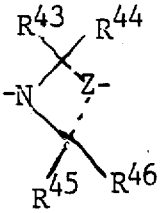 --

30 53 "dohydroisoquinoline" should be --dihydroisoquinoline--

UNITED STATES PATENT AND TRADEMARK OFFICE
CERTIFICATE OF CORRECTION

PATENT NO. : 4,931,372

DATED : June 5, 1990

INVENTOR(S) : YOSHIAKI TAKEI: EIICHI SAKAI

It is certified that error appears in the above-identified patent and that said Letters Patent is hereby corrected as shown below:

| Col. | Lines | |
|---|---|---|
| 30 | 57 | "$R^{41}$" should be --$R^{47}$-- |
| 35 | 54 | "Fig. 1" should be --Fig. 2-- |
| 36 | 39 | "Fig. 5" should be --Fig. 4-- |
| 39 | | Formula V-5 |

" 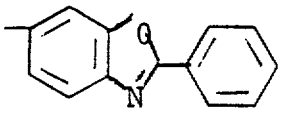 " should be -- 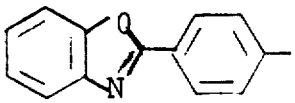 --

| | |
|---|---|
| 87 to 94 | Cancel |
| 99 | |

99 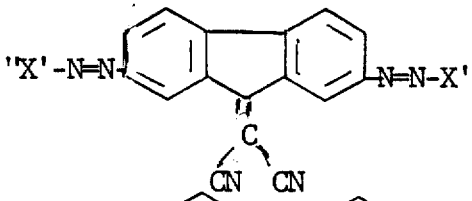 " should be

-- 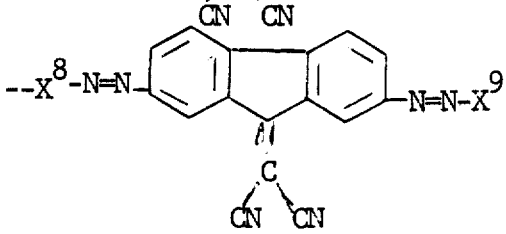 --

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI: EIICHI SAKAI

It is certified that error appears in the above-identified patent and that said Letters Patent is hereby corrected as shown below:

Col. Lines

101 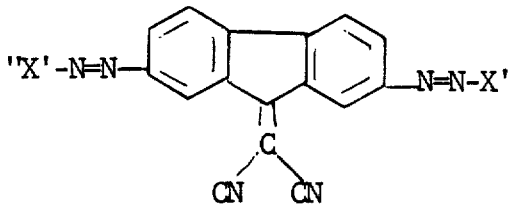

" should be

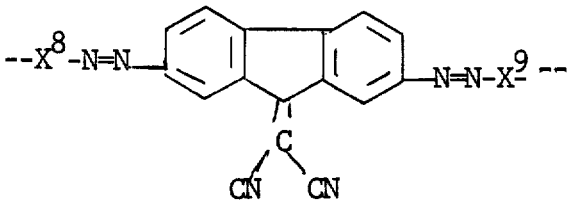

103 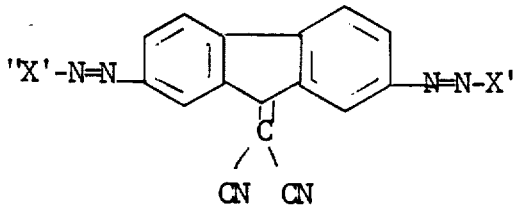

should be

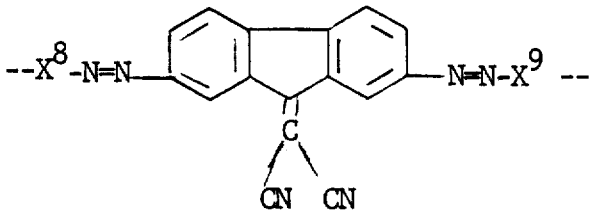

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI; EIICHI SAKAI

It is certified that error appears in the above-identified patent and that said Letters Patent is hereby corrected as shown below:

Col. Line

105 "X'-N=N 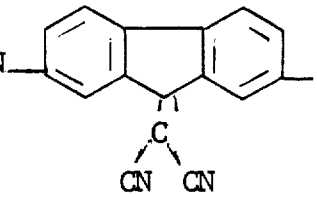 N=N-X' " should be

--$X^8$-N=N 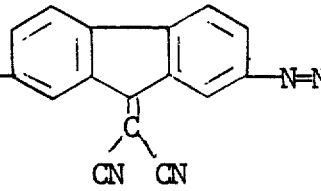 N=N-$X^9$ --

107 "X'-N=N 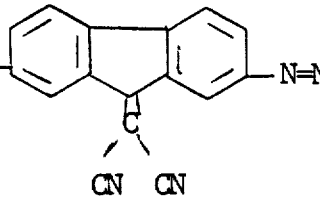 N=N-X' " should be

--$X^8$-N=N 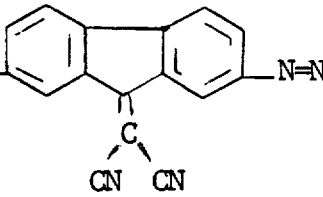 N=N-$X^9$ --

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI; EIICHI SAKAI

It is certified that error appears in the above-identified patent and that said Letters Patent is hereby corrected as shown below:

Col. Line

109 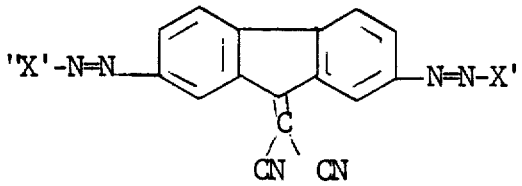

" should be

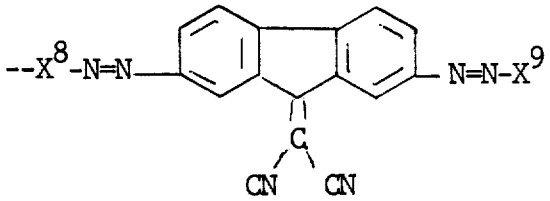

111 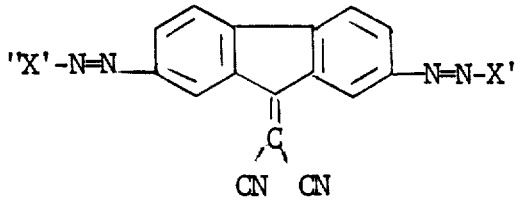

" should be

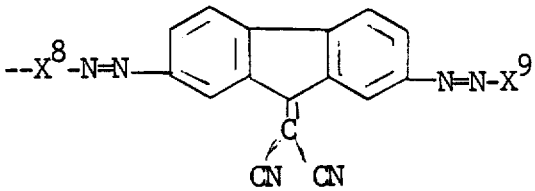

113 to 118 Cancel

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI; EIICHI SAKAI

It is certified that error appears in the above-identified patent and that said Letters Patent is hereby corrected as shown below:

| Col. | Formula | |
|---|---|---|
| 125 | XIII-31 $-R^{45}$ | " 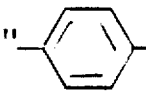 " should be -- 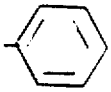 -- |
| 127 | XIII-34 $-R^{45}$ | " 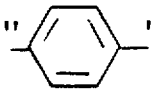 " should be -- 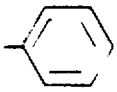 -- |
| 127 | XIII-42 $-R^{45}$ | " 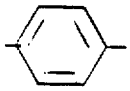 " should be -- 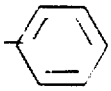 -- |
| 131 | XIII-57 $-R^{45}$ | " 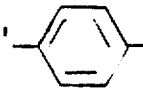 " should be -- 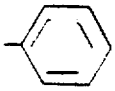 -- |

138 Formula XIV-5 $-X^{14}$

" 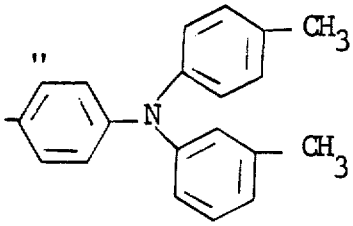 " should be

-- 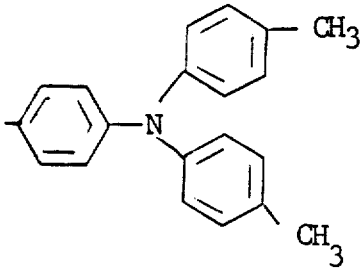 --

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI; EIICHI SAKAI

It is certified that error appears in the above-identified patent and that said Letters Patent is hereby corrected as shown below:

| Col. | Line |
|---|---|
| 147 | 25 - 30 |

" 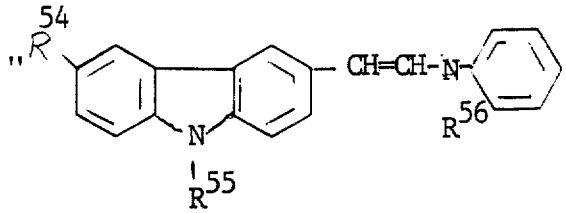 " should be

-- 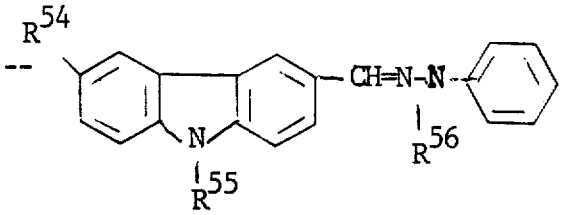 --

| | |
|---|---|
| 148 | 25-30 |

" 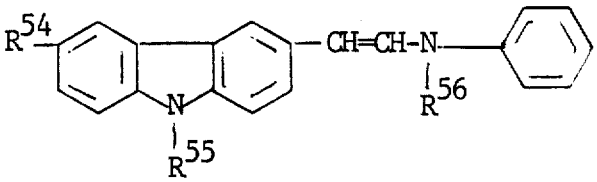 " should be

-- 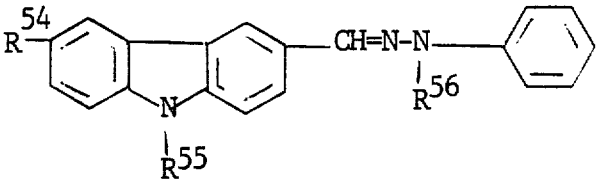 --

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI; EIICHI SAKAI

It is certified that error appears in the above-identified patent and that said Letters Patent is hereby corrected as shown below:

| Col. | Lines | |
|---|---|---|
| 166 | XVIII-43 | $X^{15}$ " 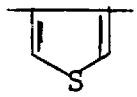 " should be -- 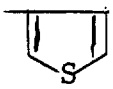 -- |
| 171,172 | Formula XIX-22 | $X^{16}$ " 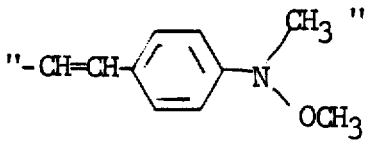 " should be -- 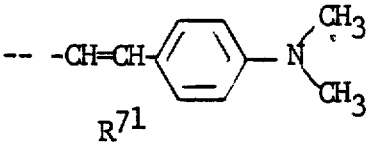 -- |
| 177,178 | | " 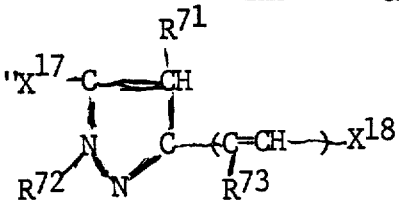 " should be -- 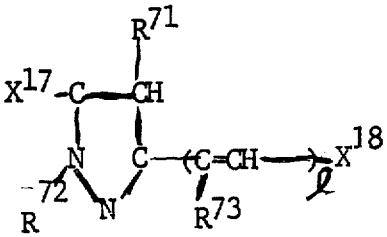 -- (1 = 0, 1) |

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI; EIICHI SAKAI

It is certified that error appears in the above-identified patent and that said Letters Patent is hereby corrected as shown below:

| Col. | Lines | |
|---|---|---|
| 180 | XX-12 X18 | " 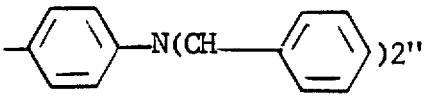 should be |
| | | -- 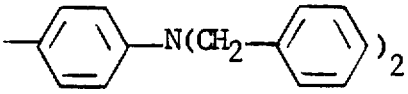 -- |
| 188 | 47 | "1,2-trichlorethane", should be --1,1,2-trichloroethane-- |
| 189 | 34 | "mm" should be --μm-- |
| 189 | 38 | "450" should be --450 g-- |
| 190 | 35 to 38 | Delete "On the other hand, 60 g of 'IUPILON Z-200' that is a polycarbonate having the principal repetition unit represented by Formula II-2 the same CTL solution as that of Example 1 so as to be coated." |
| 190 | 39 | "U-pyrone Z-200" should be --IUPILON Z-200'-- |
| 196 | 17 to 18 | "hydrogenatom, a hydrogen atom" should be --hydrogen atom, a halogen atom-- |

UNITED STATES PATENT AND TRADEMARK OFFICE

CERTIFICATE OF CORRECTION

PATENT NO. : 4,931,372

DATED : June 5, 1990

INVENTOR(S) : YOSHIAKI TAKEI; EIICHI SAKAI

It is certified that error appears in the above-identified patent and that said Letters Patent is hereby corrected as shown below:

| Col. | Lines | |
|---|---|---|
| 197 | 29 | "deneted" should be --denoted-- |
| 197 | 29 | "formula II" should be --formula I-- |
| 198 | 30 | "$R^{28}$ and $R^{28}$" should be --$R^{28}$ and $R^{29}$-- |
| 199 | 20 | Formula IIIg |

" 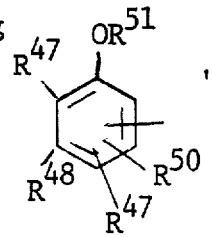 " should be -- 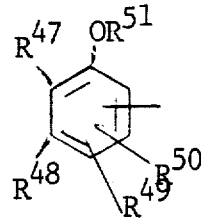 --

Signed and Sealed this

Seventh Day of April, 1992

*Attest:*

*Attesting Officer*

HARRY F. MANBECK, JR.

*Commissioner of Patents and Trademarks*